US007105283B2

(12) United States Patent
Ohzeki

(10) Patent No.: US 7,105,283 B2
(45) Date of Patent: Sep. 12, 2006

(54) BLACK AND WHITE PHOTOTHERMOGRAPHIC MATERIAL AND IMAGE FORMING METHOD

(75) Inventor: Tomoyuki Ohzeki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 157 days.

(21) Appl. No.: 11/008,202

(22) Filed: Dec. 10, 2004

(65) Prior Publication Data

US 2005/0208437 A1 Sep. 22, 2005

(30) Foreign Application Priority Data

Mar. 18, 2004 (JP) ..... 2004-078776
Oct. 19, 2004 (JP) ..... 2004-304472

(51) Int. Cl.
*G03C 5/16* (2006.01)
*G03C 1/00* (2006.01)

(52) U.S. Cl. ..... 430/350; 430/348; 430/617; 430/618; 430/619; 430/620

(58) Field of Classification Search ..... 430/348, 430/350, 617, 618, 619, 620
See application file for complete search history.

(56) References Cited

U.S. PATENT DOCUMENTS 6,576,410 B1 6/2003 Zou et al.
6,824,962 B1 * 11/2004 Oikawa ..... 430/350

* cited by examiner

*Primary Examiner*—Geraldine Letscher
(74) *Attorney, Agent, or Firm*—Margaret A. Burke; Sheldon J. Moss

(57) ABSTRACT

The present invention provides a black and white photothermographic material having, on at least one surface of a support, an image forming layer containing at least a photosensitive silver halide, a non-photosensitive organic silver salt, a reducing agent for silver ions, and a binder, wherein 70% or more of a total projected area of the photosensitive silver halide is occupied by tabular grains having an aspect ratio of 2.5 or more, a mean projected area equivalent diameter of 0.5 μm to 8 μm, and a mean grain thickness of 0.02 μm to 0.2 μm, and a ratio of a number of sites capable of forming a development initiation point on a corner portion or a fringe portion of the photosensitive silver halide grain to all development initiation points is 50% or more. Also disclosed is an image forming method of forming a radiation image by using a fluorescent intensifying screen.

17 Claims, No Drawings

BLACK AND WHITE PHOTOTHERMOGRAPHIC MATERIAL AND IMAGE FORMING METHOD

CROSS-REFERENCE TO RELATED APPLICATION

This application claims priority under 35 USC 119 from Japanese Patent Application Nos. 2004-78776 and 2004-304472, the disclosures of which are incorporated by reference herein.

BACKGROUND OF THE INVENTION

1. Field of the Invention

The present invention relates to a black and white photothermographic material and an image forming method. More particularly, the invention relates to a black and white photothermographic material whose image tone is a preferable blue-black tone and which exhibits little change in color tone during image storage after a thermal developing process and an image forming method thereof.

2. Description of the Related Art

In recent years, in the medical field and the graphic arts field, there has been a strong desire for a dry photographic process from the viewpoints of environmental conservation and economy of space. Further, the development of digitization in these fields has resulted in the rapid development of systems in which image information is captured and stored in a computer, and then when necessary processed and output by communicating it to a desired location where the image information is output onto a photosensitive material using a laser image setter or a laser imager, and developed to form an image at the location on the photosensitive material. It is necessary for the photosensitive material to be able to record an image with high-intensity laser exposure and that a clear black-tone image with a high resolution and sharpness can be formed. While various kinds of hard copy systems using a pigment or a dye, such as ink-jet printers or electrophotographic systems, have been distributed as general image forming systems using such digital imaging recording material, images in the digital imaging recording material obtained by such a general image forming system are insufficient in terms of image quality (sharpness, granularity, gradation, and tone) needed for medical images used in making diagnoses and high recording speed (sensitivity). These kinds of digital imaging recording materials have not reached a level at which they can replace medical silver halide film processed with conventional wet development.

A photothermographic material using an organic silver salt has already been known. The photothermographic material has an image forming layer including a reducible silver salt (for example, an organic silver salt), a photosensitive silver halide, and if necessary, a toner for controlling the color tone of silver, dispersed in a binder.

A photothermographic material forms a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. There is much literature in which photothermographic materials are described, and the Fuji Medical Dry Imager FM-DP L is a practical example of a medical image forming system using a photothermographic material that has been marketed.

Photothermographic materials utilizing organic silver salts incorporate all essential components in the film and have a characteristic of being able to provide an image by only heat treatment after exposure. However on the other hand, there are many technical problems to be solved.

The first is a problem regarding a color tone of the developed silver image. Because the image is composed of developed silver, the color tone of the developed silver is one of the important characteristics concerning the medical diagnosis quality of a final image. A clear and easy-to-read color tone suitable for diagnosis is preferred. Furthermore, doctors and technicians are accustomed to the images of conventional wet developing silver halide film for medical use. Therefore, similar color tone to that of the conventional wet film is preferable. However, color tone of a developed silver image is readily changed depending on the various thermal development conditions, and color tone may be changed to an unfavorable color when a composition of an image forming layer is changed to adjust the various photographic properties. Therefore, it is a very hard task to satisfy overall photographic properties while maintaining preferable color tone.

Another problem is that, because, in a photothermographic material, all silver halides and all components used for forming an image remain in the film after thermal development, the material has significant problems with regard to degradation of image quality during storage. In particular, even a slight change in color tone can be sensed visually, and this is an important problem, particularly in uses for medical diagnosis, because image quality may affect diagnostic performance.

On the other hand, attempts have also been made at applying the above-mentioned photothermographic material as photosensitive material for photographing. The "photosensitive material for photographing" as used herein means a photosensitive material on which images are recorded by a one-shot exposure through a lens, rather than by writing the image information by a scanning exposure with a laser beam or the like. Conventionally, photosensitive materials for photographing are generally known in the field of wet developing photosensitive materials, and include films for medical use such as direct or indirect radiography films, mammography films and the like, various kinds of photomechanical films used in printing, industrial recording films, films for photographing with general-purpose cameras, and the like. For example, an X-ray photothermographic material coated on both sides using a blue fluorescent intensifying screen, a photothermographic material containing tabular silver iodobromide grains described in Japanese Patent Application Laid-Open (JP-A) No. 59-142539, and a photosensitive material for medical use containing tabular grains that have a high content of silver chloride and have (100) major faces, and that are coated on both sides of a support, which is described in JP-A No. 10-282606, are known. Double-sided coated photothermographic materials are also disclosed in other patent documents. However, these known methods for high sensitivity cause extreme deterioration in quality such as deteriorations in color tone of a developed silver image and image storability, and thus they are not usable for practical applications.

SUMMARY OF THE INVENTION

A first aspect of the invention is to provide a black and white photothermographic material comprising, on at least one surface of a support, an image forming layer containing at least a photosensitive silver halide, a non-photosensitive organic silver salt, a reducing agent for silver ions and a binder, wherein 70% or more of a total projected area of the photosensitive silver halide is occupied by tabular grains having an aspect ratio of 2.5 or more, a mean projected area equivalent diameter of 0.5 μm to 8 μm and a mean grain thickness of 0.02 μm to 0.2 μm, and a ratio of a number of sites capable of forming a development initiation point on a corner portion or a fringe portion of the photosensitive silver halide grain to all development initiation points is 50% or more.

A second aspect of the invention is to provide an image forming method of forming an image by imagewise exposing a photothermographic material followed by thermal developing thereof, the method comprising the steps of: (a) providing an assembly for forming an image by placing the black and white photothermographic material according to the first aspect between a pair of fluorescent intensifying screens, (b) putting an analyte between the assembly and an X-ray source, (c) applying imagewise exposure to the analyte using X-rays having an energy level in a range of 25 kvp to 125 kvp, (d) taking the black and white photothermographic material out of the assembly, and (e) thermally developing the thus taken out black and white photothermographic material in a temperature range of 90° C. to 180° C.

DETAILED DESCRIPTION OF THE INVENTION

An object of the present invention is to provide an improved black and white photothermographic material and an image forming method thereof, particularly, an excellent black and white photothermographic material with high sensitivity, preferred blue-black image tone and reduced change in color tone during image storage after a thermal developing process, and an image forming method using the photothermographic material.

1. Black and White Photothermographic Material

In the present invention, a photographic characteristic curve is a D-log E curve representing a relationship between the common logarithm (log E) of a light exposure, i.e., the exposure energy, and the optical density (D), i.e., a scattered light photographic density, by plotting the former on the abscissa and the latter on the ordinate. In the present invention, fog is expressed in terms of the density of the unexposed part. An average gradient according to the invention represents a gradient of a line joining the points (fog+optical density of 0.25) and (fog+optical density of 2.0) on the photographic characteristic curve (i.e., the value equals to tan θ when the angle between the line and the abscissa is θ).

An average gradient according to the invention is in a range of 1.8 to 4.3, and preferably is in a range of 2.0 to 4.0.

In the invention, it is preferred that the amount of coated silver is 2.0 g/m$^2$ or less, and the optical density after thermal development is 2.5 or more. And more preferably, the amount of coated silver is 1.8 g/m$^2$ or less, and the optical density after thermal development is 2.7 or more.

The development initiation point in the present invention indicates the site of the silver halide grains where the developed silver is deposited, when the silver image is formed by thermal development after imagewise exposure. When developed silvers are observed by an electron microscope, the developed silvers are not deposited evenly on the surface of the silver halide grains. The inventor found that developed silvers can be deposited on specific sites depending on the composition of photosensitive silver halide grains and the other composites in the image forming layer. This invention is attained by the black and white photothermographic material that can form the development initiation point on a specific site of the silver halide grain.

The ultrathin slices of a maximum density part of exposed and thermally developed photothermographic materials of the present invention are prepared by cutting the samples by a diamond knife in parallel direction to the support surface. The thickness of the slices is in a range of from 0.1 μm to 0.2 μm, and the length and width of the slices may be at arbitrary size. Thereafter the slice is placed on the mesh and observed through a transmission electron microscope. The photothermographic material of the present invention may have the development initiation point at least on either corner portion or fringe portion of photosensitive silver halide grain. Preferably, when the materials are thermally developed at 121° C. for 24 seconds after imagewise exposure, 50% or more in number of the developed silvers being contacted to the photosensitive tabular silver halide grains is in contact with at least on either the corner portion or the fringe portion of the said photosensitive tabular silver halide grains. The corner portion means the area including the corner (apex) portion and the neighboring portion within a sphere of influence around the corner. The fringe portion similarly means the area including the fringe (side) portion and the neighboring portion within a sphere of influence around the fringe.

When the corner portion or the fringe portion contains a epitaxial junction, it is included for the corresponding corner portion or fringe portion.

In a similar manner, the ultra-thin slice having a thickness of about 1 μm may also be observed by a scanning electron microscope (SEM).

The developed silvers which are in contact with a tabular silver halide grains after thermal development can be determined by the following procedures;

The number of developed silvers (x) in contact with the corner portions and the neighbors thereof and/or the fringe portions of tabular silver halide grains, and the number of developed silvers (y) in contact with the portions beside the corner portions and the neighbors thereof and the fringe portions are counted. Thereby, the ratio can be derived by dividing the numbers of developed silvers in contact with the silver halide grains by the numbers (x+y) of entire developed silvers, (100x/(x+y)).

It has been revealed that the black and white photothermographic materials which satisfy the above condition can attain high sensitivity, blue-black color tone of a developed silver image and moreover little change in color tone of a developed silver image after processing.

Especially, the black and white photothermographic material which has the above characteristics is used favorably for a recording film for medical diagnosis use.

The photothermographic material of the invention has an image forming layer comprising at least a photosensitive silver halide, a non-photosensitive organic silver salt, a reducing agent and a binder on at least one surface of a support. The image forming layer is preferably disposed on both sides of the support. Further, the image forming layer may have disposed thereon a surface protective layer, or a back layer, a back protective layer or the like may be disposed on the opposite surface of the image forming layer toward the support.

The constitutions and preferable components of these layers will be explained in detail below.

(Photosensitive Silver Halide)

As for the photosensitive silver halide used in the invention, 70% or more of a total projected area of the photosensitive silver halide is occupied by tabular grains having an aspect ratio of 2.5 or more, and the tabular grains have a mean projected area equivalent diameter of 0.5 μm to 8 μm and a mean grain thickness of 0.02 μm to 0.2 μm, and a development initiation point can be formed on at least either of the corner portion and fringe portion of the photosensitive silver halide grain. According to the invention, among the entire development initiation points, a ratio of a number of the sum of development initiation points on corner portions and fringe portions is 50% or more. The ratio of a number of the sum of development initiation points on corner portions and fringe portions is preferably 80% or more, and more preferably 90% or more.

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. The photosensitive silver halide used in the invention preferably has a silver bromide content of 70 mol % or higher, more preferably 75 mol % or higher, and further preferably 80 mol % or higher. Other components are not particularly limited and can be preferably selected from silver iodide, silver chloride, silver chloroiodide, and the like, but it is used with the content of 30 mol % or less. The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. Further, a technique of localizing silver bromide or silver iodide on the surface of a silver chloride grain, a silver bromide grain, or a silver chlorobromide grain can also be preferably used.

2) Grain Size

The tabular photosensitive silver halide grains used in the present invention are those having a mean projected area equivalent diameter of 0.5 μm to 8.0 μm, and preferred are those having a mean projected area equivalent diameter of 0.5 μm to 5.0 μm, and more preferred are those having a mean projected area equivalent diameter of 0.8 μm to 3.0 μm. The term "projected area equivalent diameter" used here means a diameter of a circle having the same area as projected area of a silver halide grain. As for measuring method, the area of a grain is calculated from projected area by observation through electron microscope, and thereafter the projected area equivalent diameter is determined by converting the area to a circle having the area equivalent to the obtained area.

The mean grain thickness of the photosensitive silver halide used in the invention is 0.02 μm to 0.2 μm, preferably 0.03 μm to 0.15 μm, and more preferably 0.04 μm to 0.1 μm.

3) Coating Amount

The coating amount of the photosensitive silver halide is in a range of from 0.5 mol % to 90 mol %, preferably from 5 mol % to 70 mol %, and particularly preferably from 10 mol % to 50 mol %, per 1 mol of the silver contained in non-photosensitive organic silver salt described below and silver halide.

4) Method Of Grain Formation

The method of forming photosensitive silver halide is well known in the relevant art and, for example, methods described in Research Disclosure No. 10729, Jun. 1978, and U.S. Patent (USP) U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

As for the method of forming tabular grains of silver iodide, the method described in JP-A Nos. 59-119350 and 59-119344 are preferably used.

5) Grain Form

70% or more of a total projected area of the photosensitive silver halide according to the invention is occupied by tabular grains having an aspect ratio of 2.5 or more, preferably having an aspect ratio of 5 or more, and more preferably having an aspect ratio of 10 or more. The upper limit of the aspect ratio is possible to be the value as high as it is possible technically. Normally, the practicable aspect ratio is 100 or lower.

A silver halide grain rounded at corners can also be used preferably. While there is no particular restriction on the index of plane (Miller's index) of an crystal surface of the photosensitive silver halide grain, it is preferred that the ratio of {100} face is higher, in which the spectral sensitizing efficiency is higher in a case of adsorption of a spectral sensitizing dye. The ratio is preferably 50% or more, more preferably 65% or more, and further preferably 80% or more. The ratio of the Miller's index {100} face can be determined by the method of utilizing the adsorption dependency of {111} face and {100} face upon adsorption of a sensitizing dye described by T. Tani; in J. Imaging Sci., vol. 29, page 165 (1985).

<Epitaxial Part>

The photosensitive silver halide used in the present invention preferably has at least one epitaxial junction in the corner portion and the fringe portion of tabular silver halide grains. The epitaxial part means the area including the epitaxial junction part and the neighboring part in a sphere of influence around the epitaxial junction.

The "epitaxy" or "epitaxial" is used in the art as the term to indicate that the silver salt has a crystal form having an orientation controlled by tabular host grains.

In order to form the sensitized sites on a tabular host grain, silver salts formed with epitaxial growth can be applicable. By controlling the sites deposited by the epitaxial growth, a selective local sensitization on tabular host grain can be performed. Accordingly, at one or more regular portions, the sensitization sites can be formed. The "regular" means that the sensitization sites have a predictable and orderly relations, preferably mutually, to the major crystal faces of the tabular grains. By controlling the epitaxial deposition to the major crystal faces of the tabular grains, it is possible to control the number and the space between the horizontal direction of the sensitization sites.

Especially, on at least one part of the major crystal faces of tabular host grain, it is preferred to control silver salt epitaxy, and substantially to exclude the epitaxial deposition.

In tabular host grains, an epitaxial deposition of silver salt tend to be formed at an edge portion and/or a corner portion of grains.

When the epitaxial depositions are restricted on a selected portions of tabular grains, the sensitivity is more increased, in comparison with randomly epitaxial growth deposition of silver salts on the major crystal faces of tabular grains. For at least one part of the major crystal faces, no epitaxial deposition of silver salts is formed substantially, and for a selected site, the silver salts is deposited in a limited range. The above range of the deposition can be changed extensively within the scope of this invention.

Generally, the lesser the epitaxial coverage on the major crystal faces, the more the sensitivity increases. Silver salts formed by the epitaxial growth are preferably within less than a half, more preferably 25% or less, of the area of the major crystal faces of tabular grains. In the case where the silver salts are formed by epitaxial growth on the corner portion of tabular silver halide grain, they are preferably restricted within 10% or less, more preferably 5% or less, of the area of the major crystal faces. In some embodiments, it is observed that the epitaxial deposition initiate at the site of the edge surface of tabular grains. Accordingly, depending on the condition, the epitaxy is restricted on a selected area of the edge portion, and the epitaxial deposition on the major crystal faces is effectively excluded.

The silver salts formed by epitaxy can be selected from arbitrary silver salts which are generally capable of epitaxial growth on silver halide grains, and known in the art as useful for photographic use. Especially, the silver salts are preferably selected from those known in the photographic art as effective for shell formation in core-shell type-silver halide grains. Besides useful silver halides known in the photographic chemical use, examples of preferred silver salts, which are known to deposit on silver halide grains, include silver thiocyanate, silver cyanate, silver carbonate, silver ferricyanate, silver arsenate, silver arsenite, and silver chromate. Among them, preferred are silver iodide, silver bromoiodide, silver chloroiodide, silver chlorobromoiodide, silver chloride, silver bromochloride, silver iodochloride, silver bromide, silver chlorobromide, silver iodobromide, and silver iodochlorobromide. Further more preferred are silver chloride, silver bromchloride, silver chloride, silver bromochloride, silver iodochloride, silver bromide, silver chlorobromide, silver iodobromide, and silver iodochlorobromide, each of which has a silver iodide content of 40 mol % or lower. Especially preferred are silver chloride, silver bromchloride, silver iodochloride, silver bromide, silver chlorobromide, silver iodobromide, and silver iodochlorobromide, each of which has a silver iodide content of 20 mol % or less.

According to selected species of silver salts and the desired usage, the silver salts can be effectively deposited in the presence of a modifying agent in combination with tabular silver halide grains.

The silver halide grain used in the present invention preferably has one or more dislocation lines. More preferably the silver halide grain has five or more dislocation lines, and most preferably 10 or more dislocation lines.

It is preferred that 50% or more, more preferably 80% or more, of a total projected area of silver halide grains is occupied by tabular grains having one or more dislocation lines. Especially, 80% or more of the total projected area is preferably occupied by silver halide grains having 10 or more dislocation lines.

Concerning dislocation line of silver halide crystals, the following references indicate that the dislocation line existed in the crystal can be observed by the method using an X-ray diffraction analysis or a transmission electron microscope, and various types of dislocation may be formed in the crystal by stressing the crystal.

(1) C. R. Berry, J. Appl. Phys., 27, 636 (1956)
(2) C. R. Berry, D. C. Skilman, J. Appl. Phys., 35, 2165 (1964)
(3) J. F. Hamilton, Phot. Sci. Eng., 11, 57 (1967)
(4) T. Shiozawa, J. Soc. Photo. Sci. Jap., 34, 16 (1971)
(5) T. Shiozawa, J. Phot. Sci. Jap., 35, 213 (1972).

On the other hand, concerning to the influence on the photographic properties by a dislocation line, the reference; G. C. Famell, R. B. Flint, and J. B. Chanter, J. Phot. Sci., 13, 25 (1965) describes that there are some close relation between the sites where latent image is formed and the defects existed in grains, in regards with the tabular silver bromide grain having a large size and a high aspect ratio.

JP-A Nos. 63-220238 and 1-201649 disclose tabular silver halide grains having dislocations formed intentionally. The tabular grains having formed dislocations exhibit an excellent photographic property such as sensitivity and reciprocity failure compared with tabular grains having no dislocations. Photosensitive materials using the above tabular silver halide grains having dislocations are excellent in sharpness and granularity. However, in these grains, dislocation lines are formed irregularly on the edge portion of the tabular grains, and the numbers of dislocation line are different for individual grains.

6) Heavy Metal

The photosensitive silver halide grain of the invention can contain metals or complexes of metals belonging to groups 3 to 14 of the periodic table. Preferably, the photosensitive silver halide grain can contain metals or complexes of metals belonging to groups 6 to 10 of the periodic table. The metal or the center metal of the metal complex from groups 6 to 10 of the periodic table is preferably ferrum, rhodium, ruthenium, or iridium. The metal complex may be used alone, or two or more kinds of complexes comprising identical or different species of metals may be used together. The content is preferably in a range from $1\times10^{-9}$ mol to $1\times10^{-3}$ mol, per 1 mol of silver. The heavy metals, metal complexes and the addition method thereof are described in JP-A No. 7-225449, in paragraph Nos. 0018 to 0024 of JP-A No.11-65021, and in paragraph Nos. 0227 to 0240 of JP-A No. 11-119374.

In the present invention, a silver halide grain containing a hexacyano metal complex is preferred. The hexacyano metal complex can include $[Fe(CN)_6]^{4-}$, $[Fe(CN)_6]^{3-}$, $[Ru(CN)_6]^{4-}$, $[OS(CN)_6]^{4-}$, $[Co(CN)_6]^{3-}$, $[Rh(CN)_6]^{3-}$, $[Ir(CN)_6]_{3-}$, $[Cr(CN)_6]^{3-}$, $[Re(CN)_6]^{3-}$, and the like.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl)ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, and the like) or gelatin.

Metal atoms that can be contained in the silver halide grain used in the invention (for example, $[Fe(CN)_6]^{4-}$), desalting method of a silver halide emulsion and chemical sensitization method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

In the case where the photosensitive silver halide of the invention has an epitaxial part, it is preferred to dope these heavy metal complexes into the epitaxial part. The preferable kind of metal complex to be doped and the amount of doping are similar to those in the host grain.

7) Gelatin

As the gelatin contained the photosensitive silver halide emulsion used in the invention, various kinds of gelatins can be used. It is necessary to maintain an excellent dispersion state of a photosensitive silver halide emulsion in a coating solution containing an organic silver salt, and gelatin having a low molecular weight of 500 to 60,000 is preferably used. These gelatins having a low molecular weight may be used at grain formation step or at the time of dispersion after desalting treatment and it is preferably used at the time of dispersion after desalting treatment.

8) Chemical Sensitization

The photosensitive silver halide in the present invention can be used without chemical sensitization, but is preferably chemically sensitized by at least one of chalcogen sensitizing method, gold sensitizing method and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chemie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element and active gelatin can be used. Specifically, thiosulfates, thioureas and rhodanines are preferred.

In selenium sensitization, unstable selenium compounds can be used. These unstable selenium compounds are described in JP-B Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

AS typical examples of selenium sensitizer, colloidal metal selenide, selenoureas (e.g., N,N-dimethylselenourea, trifluoromethylcarbonyl-trimethylselenourea and acetyltrimethylselemourea), selenamides (e.g., selenamide and N,N-diethylphenylselenamide), phosphineselenides (e.g., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, diacylselenides can be used. Furthermore, non-unstable selenium compounds such as selenius acid, selenocyanic acid, selenazoles and selenides described in JP-B Nos. 46-4553 and 52-34492 can also be used. Specifically, phosphineselenides, selenoureas and salts of selenocyanic acids are preferred.

In the tellurium sensitization, unstable tellurium compounds are used. Unstable tellurium compounds described in JP-A Nos.4-224595, 4-271341, 4-333043, 5-303157, 6-27573, 6-175258, 6-180478, 6-208186, 6-208184, 6-317867, 7-140579, 7-301879, 7-301880 and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride and ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride and bis(ethoxycarmonyl)telluride), telluroureas (e.g., N,N'-dimethylethylenetellurourea and N,N'-diphenylethylenetellurourea), telluramides, telluroesters are used. Specifically, diacyl(di)tellurides and phosphinetellurides are preferred. Especially, the compounds described in paragraph No. 0030 of JP-A No.11-65021 and compounds represented by formula (II), (III) and (IV) in JP-A No.5-313284 are more preferred.

Specifically, as for the chalcogen sensitization of the invention, selenium sensitization and tellurium sensitization are preferred, and tellurium sensitization is particularly preferred.

In gold sensitization, gold sensitizer described in Chemie et Physique Photographique, written by P. Grafkides, (Paul Momtel, 5th ed., 1987) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belg. Patent No. 691857, and the like can also be used. And another novel metal salts other than gold such as platinum, palladium, iridium and the like, which are described in Chemie et Pysique Photographique, written by P. Grafkides, (Paul Momtel, 5th ed., 1987) and Research Disclosure (vol. 307, Item 307105), can be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating, and it can be applied, after desalting, (1) before spectral sensitization, (2) simultaneously with spectral sensitization, (3) after spectral sensitization and (4) just before coating.

The addition amount of chalcogen sensitizer used in the invention may vary depending on the silver halide grain used, the chemical ripening condition and the like, and it is about $10^{-8}$ mol to $10^{-1}$ mol, and preferably, about $10^{-7}$ mol to $10^{-2}$ mol, per 1 mol of silver halide.

Similarly, the addition amount of the gold sensitizer used in the invention may vary depending on various conditions and it is generally about $10^{-7}$ mol to $10^{-2}$ mol and, more preferably, $10^{-6}$ mol to $5\times10^{-3}$ mol per 1 mol of silver halide. There is no particular restriction on the condition for the chemical sensitization in the invention and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is 3 to 10, preferably, 4 to 9; and temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide or dimethylamine borane is preferred, as well as use of stannous chloride, aminoimino methane sulfonic acid, hydrazine derivatives, borane compounds, silane compounds and polyamine compounds are preferred.

The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally about 10 mol to lo-1 mol and, more preferably, $10^{-6}$ mol to $5\times10^{-2}$ mol, per 1 mol of silver halide.

In the silver halide emulsion used in the invention, a thiosulfonate compound may be added by the method shown in EP-A No. 293917.

The photosensitive silver halide grain in the invention can be chemically unsensitized, but is preferably chemically sensitized by at least one method of gold sensitizing method and chalcogen sensitizing method for the purpose of designing a high-sensitivity photothermographic material.

9) Compound that can be One-Electron-Oxidized to Provide a One-Electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is a compound selected from the following Groups 1 and 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV1 to 36); JP-W No. 2001-500996 (Compound 1 to 74, 80 to 87, and 92 to 122); U.S. Pat. Nos. 5,747,235 and 5,747,236; EP-A No. 786692A1 (Compound INV 1 to 35); EP-A No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

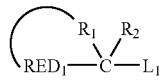

Formula (2)

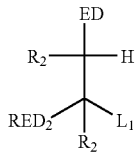

Formula (3)

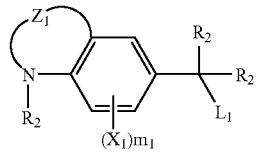

Formula (4)

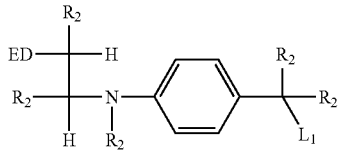

Formula (5)

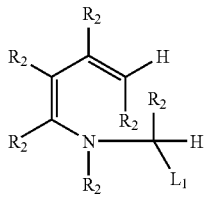

Formula (6)

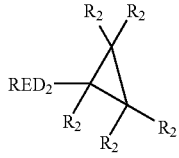

-continued

Formula (7)

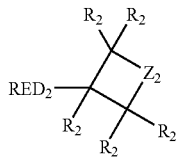

Formula (8)

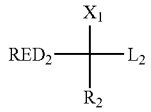

Reaction formula (1)

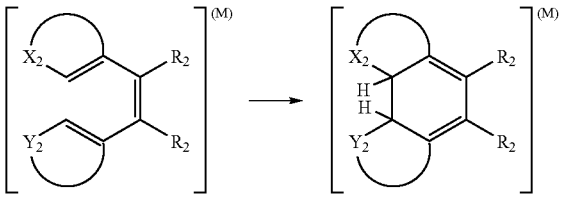

Formula (9)

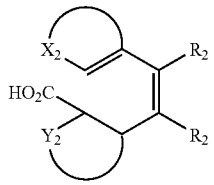

In the formulae, $RED_1$ and $RED_2$ represent a reducible group. $R_1$ represents a nonmetallic atomic group forming a cyclic structure equivalent to a tetrahydro derivative or an octahydro derivative of a 5 or 6 membered aromatic ring (including a hetero aromatic ring) with a carbon atom (C) and $RED_1$. $R_2$ represents a hydrogen atom or a substituent. In the case where plural $R_2$s exist in a same molecule, these may be the same or different. $L_1$ represents a leaving group. ED represents an electron-donating group. $Z_1$ represents an atomic group capable to form a 6 membered ring with a nitrogen atom and two carbon atoms of a benzene ring. $X_1$ represents a substituent, and $m_1$ represents an integer of 0 to 3. $Z_2$ represents one selected from —$CR_{11}R_{12}$—, —$NR_{13}$—, and —O—. $R_{11}$ and $R_{12}$ each independently represent one selected from a hydrogen atom and a substituent. $R_{13}$ represents one selected from a hydrogen atom, an alkyl group, an aryl group, and a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, and a heterocyclic amino group. $L_2$ represents one selected from a carboxy group, a salt thereof, and a hydrogen atom. $X_2$ represents a group to form a 5 membered heterocycle with C═C. M represents one selected from a radical, a radical cation, and a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No.2003-140287), and the compound represented by formula (11) which can undergo the chemical reaction represented by reaction formula (1) The preferable range of these compounds is the same as the preferable range described in the quoted specification.

Formula (10)

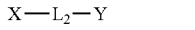

Reaction formula (1)

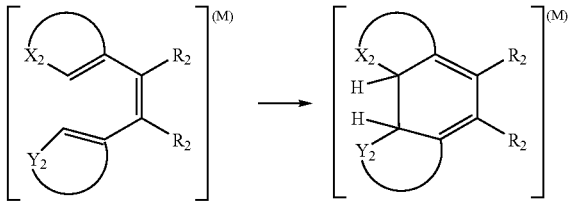

Formula (11)

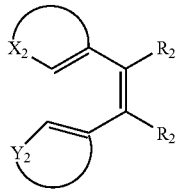

In the formula described above, X represents a reducible group, which can be one-electron-oxidized. Y represents a reactive group containing a carbon-carbon double bond part, a carbon-carbon triple bond part, an aromatic group part or a benzo-condensed nonaromatic heterocyclic part, which can react with one-electron-oxidized product formed by one-electron-oxidation of X to form a new bond. $L_2$ represents a linking group to link X and Y. $R_2$ represents one of a hydrogen atom and a substituent. In the case where plural $R_2$s exist in a same molecule, these may be the same or different.

$X_2$ represents a group to form a 5 membered heterocycle with C═C. $Y_2$ represents a group to form a 5 or 6 membered aryl group or heterocyclic group with C═C. M represents one selected from a radical, a radical cation, and a cation.

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be the same or different from each other.

As preferable adsorptive group, a nitrogen containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group and the like) or a nitrogen containing heterocyclic group having —NH— group as a partial structure of heterocycle capable to form a silver imidate (>NAg) (e.g., a benzotriazole group, a benzimidazole group, an indazole group and the like) are described. A 5-mercaptotetrazole group, a 3-mercapto-1, 2,4-triazole group and a benzotriazole group are particularly preferable and a 3-mercapto-1,2,4-triazole group and a 5-mercaptotetrazole group are most preferable.

As an adsorptive group, the group which has 2 or more mercapto groups as a partial structure in a molecule is also particularly preferable. Herein, a mercapto group (—SH) may become a thione group in the case where it can tautomerize. As preferred examples of adsorptive group having two or more mercapto groups as a partial structure (dimercapto-substituted nitrogen containing heterocyclic group and the like), a 2,4-dimercaptopyrimidine group, a 2,4-dimercaptotriazine group and a 3,5-dimercaptol, 2,4-triazole group are described.

Further, a quaternary salt structure of nitrogen or phosphor is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen containing heterocyclic group including quaternary nitrogen atom are described. As a quaternary salt structure of phosphor, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used and a 5 or 6 membered aromatic heterocyclic group containing a quaternary nitrogen atom is further preferably used. Particularly preferably, a pyrydinio group, a quinolinio group and an isoquinolinio group are used. These nitrogen containing heterocyclic groups including a quaternary nitrogen atom may have any substituent.

As examples of counter anion of quaternary salt, halogen ion, carboxylate ion, sulfonate ion, sulfate ion, perchlorate ion, carbonate ion, nitrate ion, $BF_4^-$, $PF_6^-$, $Ph_4B^-$ and the like are described. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 and 2 having a quaternary salt of nitrogen or phosphor as an adsorptive group is represented by formula (X).

$$(P\text{-}Q_1\text{-})_i\text{-}R(\text{-}Q_2\text{-}S)_j \qquad \text{Formula (X)}$$

In formula (X), P and R each independently represent a quaternary salt structure of nitrogen or phosphor, which is not a partial structure of a spectral sensitizing dye. $Q_1$ and $Q_2$ each independently represent a linking group and typically represent one selected from a single bond, an alkylene group, an arylene group, a heterocyclic group, —O—, —S—, —$NR_N$, —C(=O)—, —$SO_2$—, —SO—, —P(=O)—, and a group which consists of combination thereof. Herein, $R_N$ represents one selected from a hydrogen atom, an alkyl group, an aryl group, and a heterocyclic group. S represents a residue which is obtained by removing one atom from the compound represented by Group 1 or 2. i and j are an integral number of one or more, and are selected in a range of i+j=2 to 6. It is preferred that i is 1, 2 or 3 and j is 1 or 2. It is more preferred that i is 1 or 2 and j is 1. And, it is particularly preferred that i is 1 and j is 1. The compound represented by formula (x) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 and 2 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably added to the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. Each compound is contained in the image forming layer preferably in an amount of $1\times10^{-9}$ mol to $5\times10^{-1}$ mol, more preferably $1\times10^{-8}$ mol to $5\times10^{-2}$ mol, per 1 mol of silver halide.

1

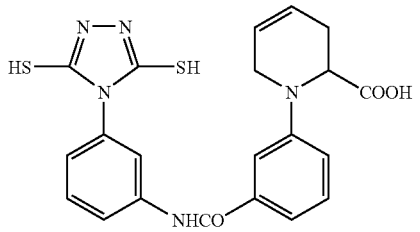

2

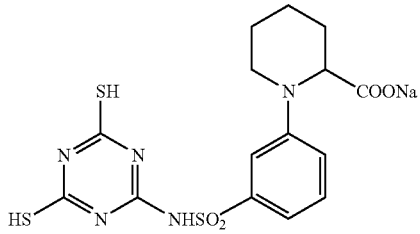

3

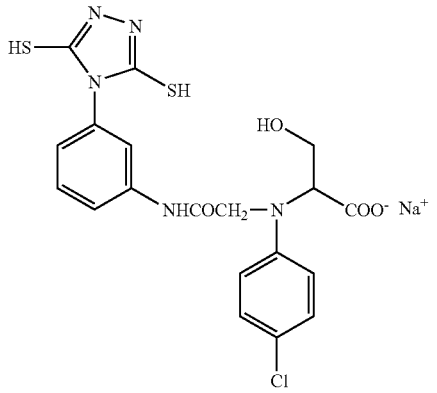

-continued
4
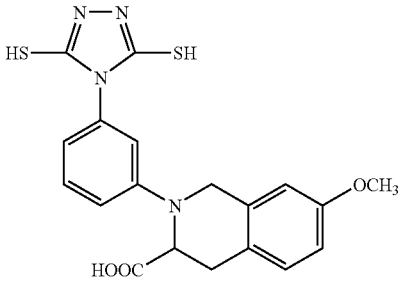
5
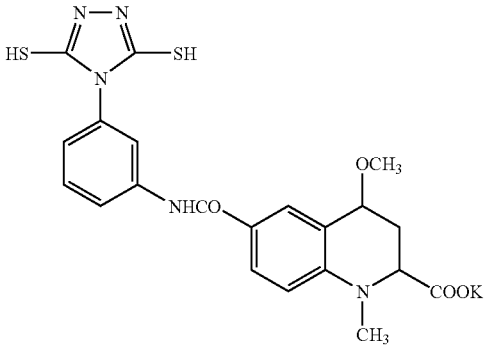
6
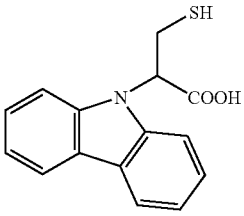
7
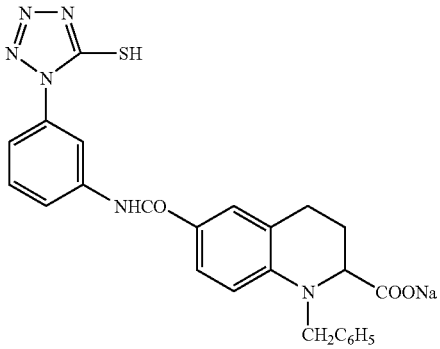
8
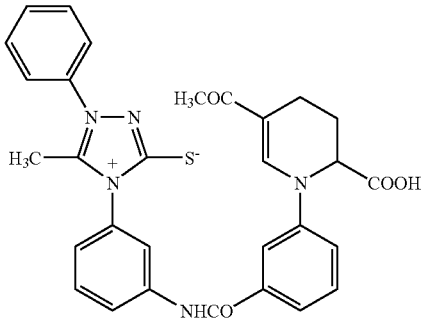
-continued
9
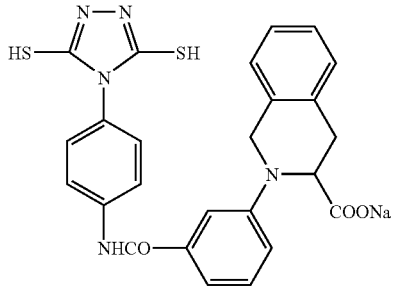
10
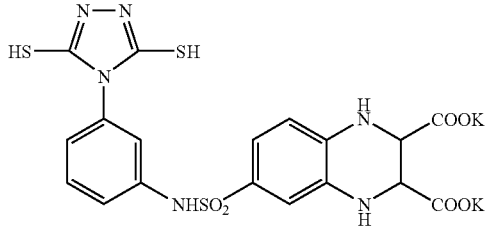
11
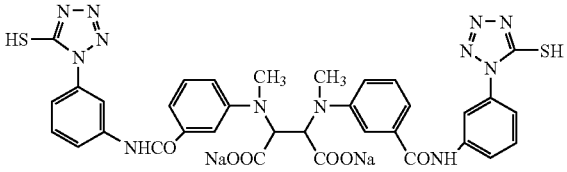
12
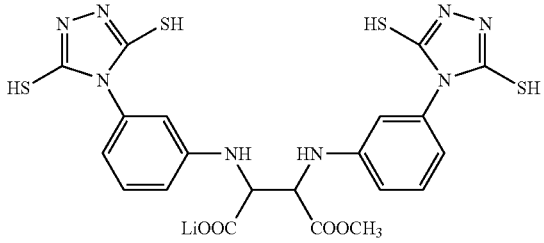
13
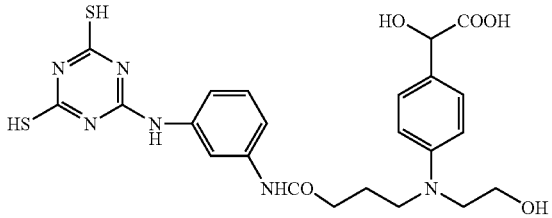
14
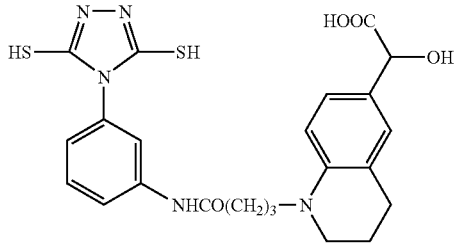

-continued
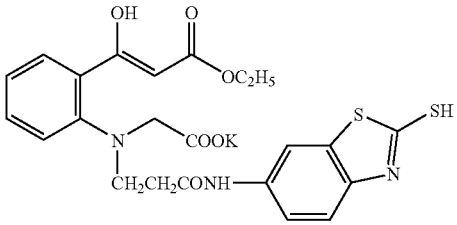
16
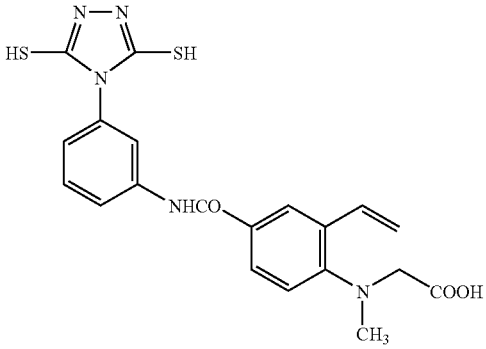
17
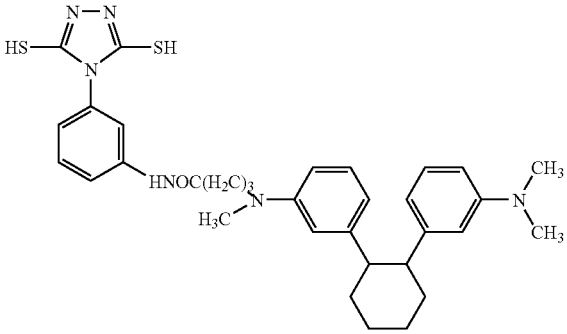
18
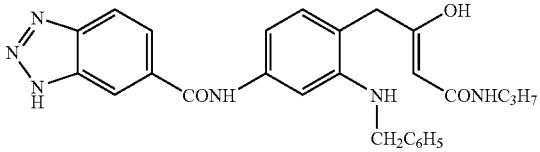
19
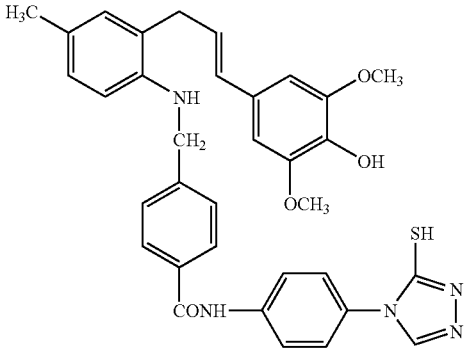
20
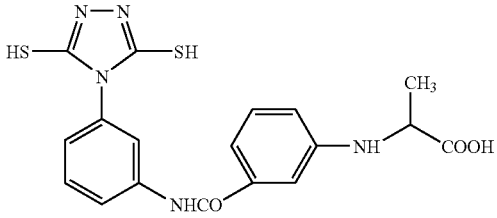
21
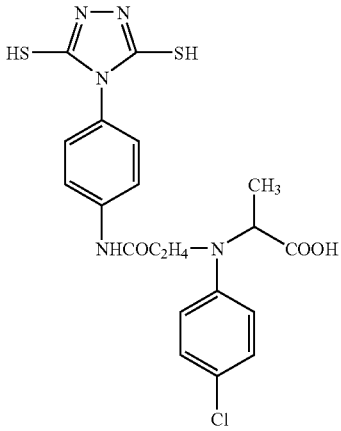
22
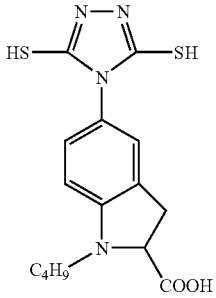
23
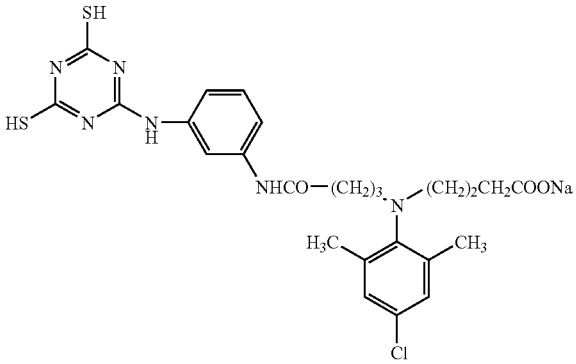

-continued
24
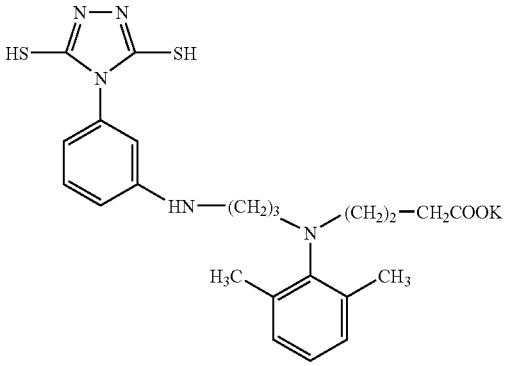
25
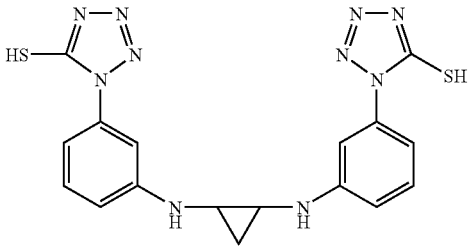
26
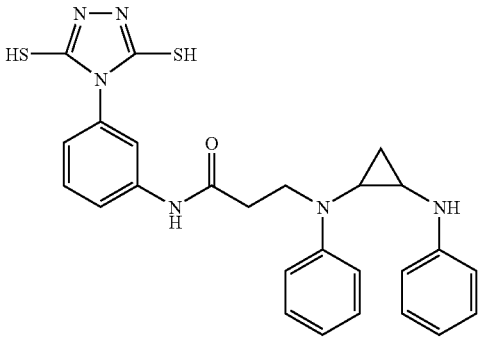
27
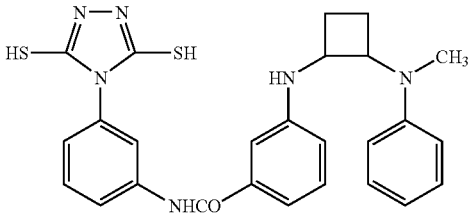
28
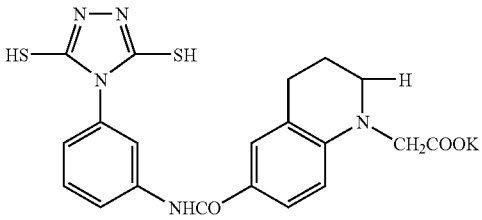
-continued
29
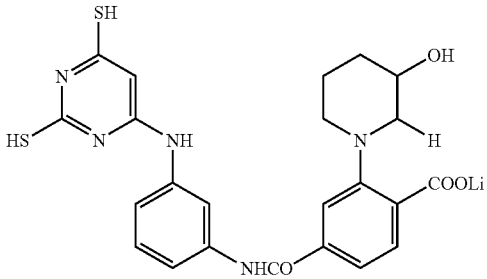
30
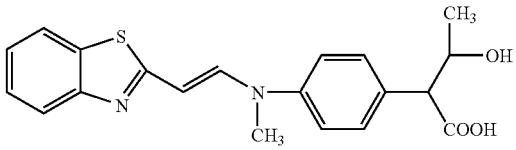
31
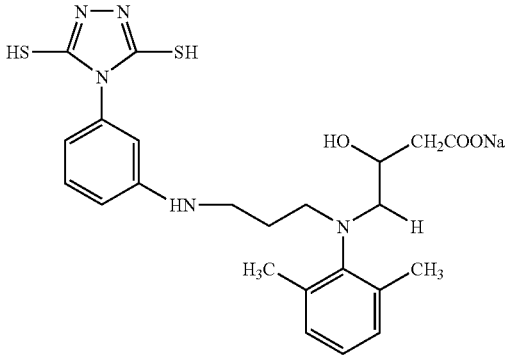
32
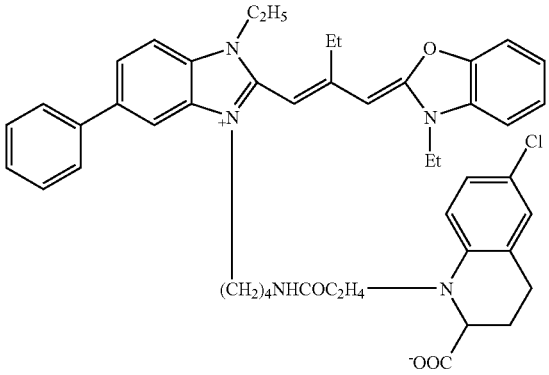
33
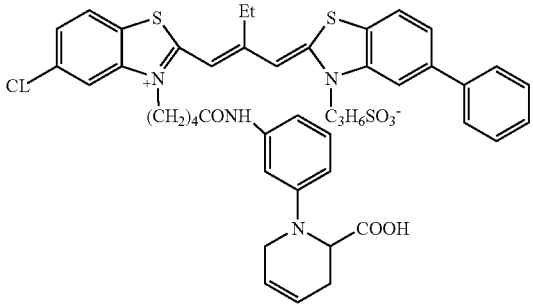

-continued

34

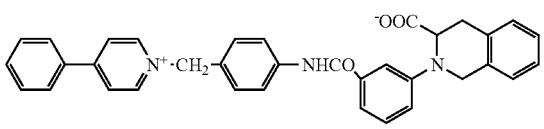

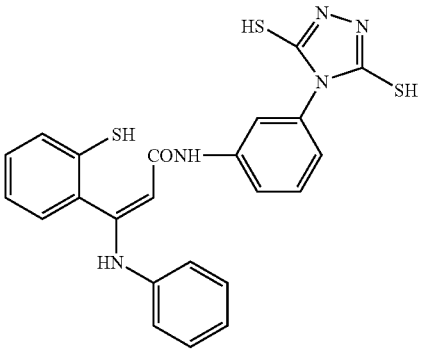

G-1

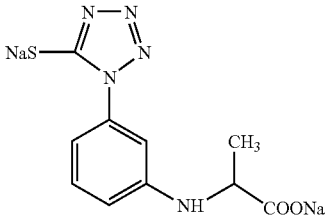

G-3

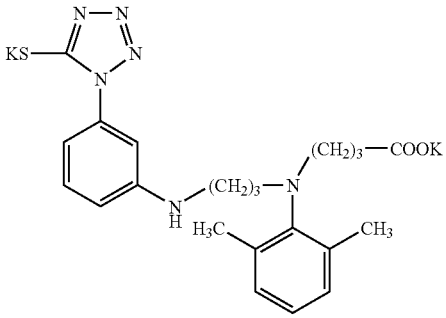

G-2

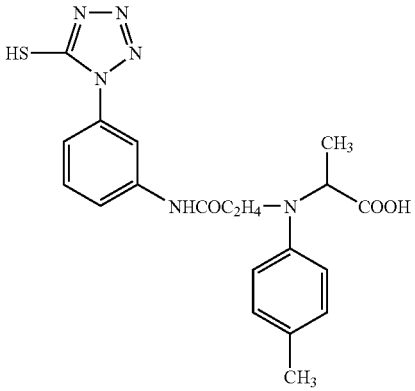

-continued

G-5

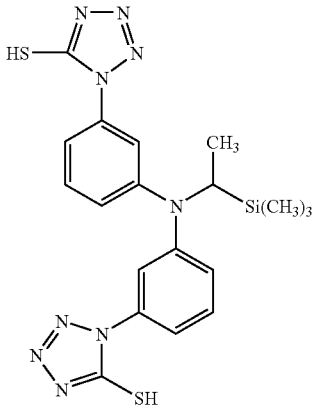

G-4

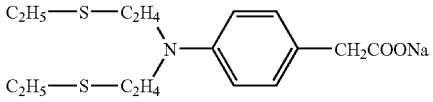

10) Compound Having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

Formula (I) A-(W)n-B

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7 membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group and the like are described. A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^+$, $Na^+$, $K^+$, $Mg^{2+}$, $Ag^+$, $Zn^{2+}$ and the like), an ammonium ion, a heterocyclic group comprising a quaternary nitrogen atom, a phosphonium ion and the like can be described.

Further, the mercapto group as an adsorptive group may become a thione group by a tautomerization.

The thione group as an adsorptive group may also contain a chain or a cyclic thioamide group, a thioureido group, a thiouretane group or a dithiocarbamic acid ester group.

The heterocyclic group containing at least one atom selected from a nitrogen atom, a sulfur atom, a selenium atom and a tellurium atom represents a nitrogen atom containing heterocyclic group having —NH— group, as a partial structure of heterocycle, capable to form a silver iminate (>NAg) or a heterocyclic group, having —S— group, —Se— group, —Te— group or ═N— group as a partial structure of heterocycle, and capable to coordinate to a silver ion by a chelate bonding. As the former examples, a benzotriazole group, a triazole group, an indazole group, a pyrazole group, a tetrazole group, a benzimidazole group, a purine group and the like can be described. As the latter examples, a thiophene group, a thiazole group, a benzoxazole group, a thiadiazole group, an oxadiazole group, a triazine group, a selenoazole group, a benzoselenoazole group, a tellurazole group, a benzotellurazole group and the like can be described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen containing heterocyclic group including a quaternary nitrogen atom. As examples of the heterocyclic group containing a quaternary nitrogen atom, a pyridinio group, a quinolinio group, an isoquinolinio group, an imidazolio group and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No.11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group and the like) or a nitrogen atom containing heterocyclic group having a —NH— group capable to form an imino-silver (>NAg) as a partial structure of heterocycle (e.g., a benzotriazole group, a benzimidazole group, an indazole group and the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward photographic properties. For example, a divalent linking group, which includes a carbon atom, a hydrogen atom, an oxygen atom a nitrogen atom and a sulfur atom, can be used. As typical examples, an alkylene group having 1 to 20 carbon atoms (e.g., a methylene group, an ethylene group, a trimethylene group, a tetramethylene group, a hexamethylene group and the like), an alkenylene group having 2 to 20 carbon atoms, an alkynylene group having 2 to 20 carbon atoms, an arylene group having 6 to 20 carbon atoms (e.g., a phenylene group, a nephthylene group and the like), $—CONR_1—$, $—SO_2NR_2—$, —O—, —S—, $—NR_3—$, $—NR_4CO—$, $—NR_5SO_2—$, $—NR_6CONR_7—$, —COO—, —OCO— and the combination of these linking groups are described. Herein, $R_1$ represents a hydrogen atom, an alkyl group, a heterocyclic group, or an aryl group.

The linking group represented by W may have any substituent.

In formula (I), a reducible group represented by B represents the group capable to reduce a silver ion. As the examples, a formyl group, an amino group, a triple bond group such as an acetylene group, a propargyl group and the like, a mercapto group, hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), aclhydrazines, carbamoylhydrazides and a residue which is obtained by removing one hydrogen atom from 3-pyrazolidones and the like can be described. They may have any substituent.

The oxidation potential of a reducible group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential is preferably in a range of about −0.3 V to about 1.0 V, more preferably about −0.1 V to about 0.8 V, and particularly preferably about 0 V to about 0.7 V.

In formula (I), a reducible group represented by B preferably is a residue which is obtained by removing one hydrogen atom from hydroxylamines, hydroxamic acids, hydroxyureas, hydroxysemicarbazides, reductones, phenols, acylhydrazines, carbamoylhydrazides, or 3-pyrazolidones.

The compound of formula (I) in the present invention may have the ballasted group or polymer chain in it generally used in the non-moving photographic additives as a coupler. And as a polymer, for example, the polymer described in JP-A No. 1-100530 can be described.

The compound of formula (I) in the present invention may be bis or tris type of compound. The molecular weight of the compound represented by formula (I) in the present invention is preferably 100 to 10,000 and more preferably 120 to 1,000 and particularly preferably 150 to 500.

The examples of the compound represented by formula (I) in the present invention are shown below, but the present invention is not limited in these.

(1)

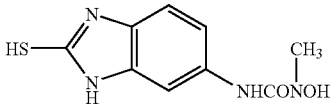

(2)

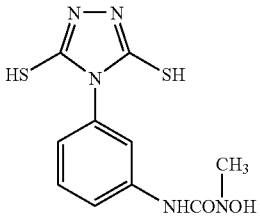

(3)

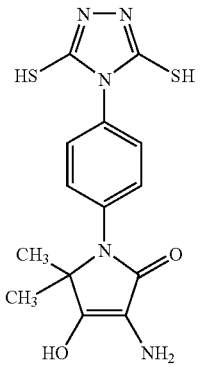

(4)

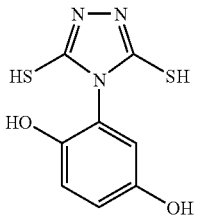

(5)

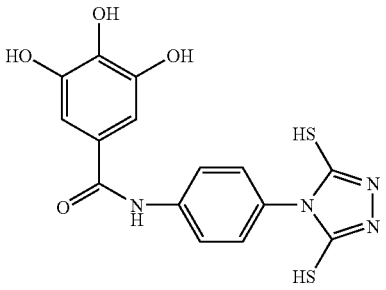

-continued (6)

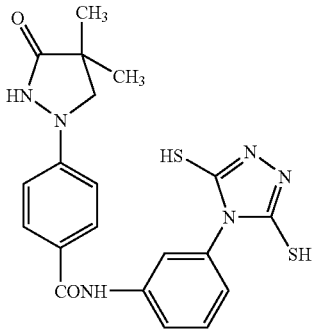

(7)

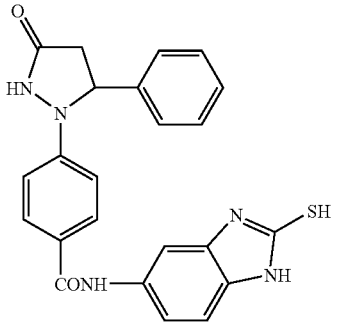

(8)

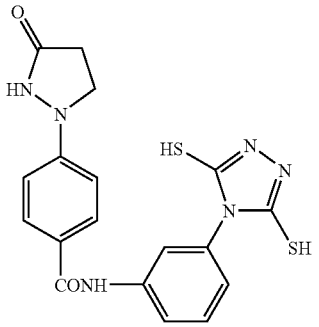

(9)

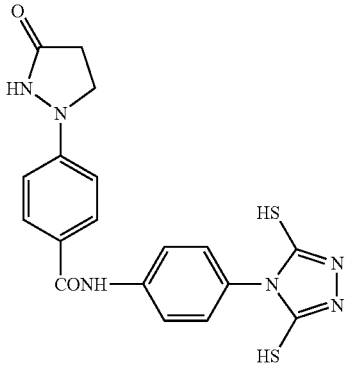

(10)

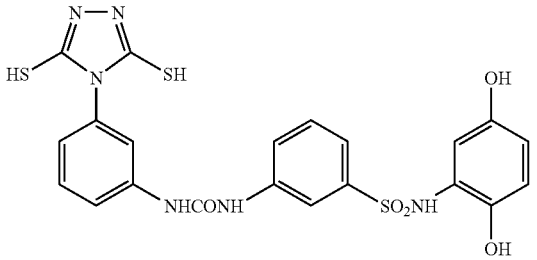

-continued (11)

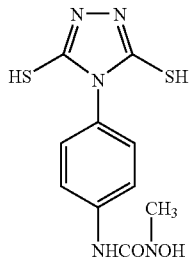

(12)

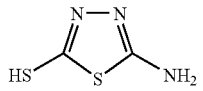

(13)

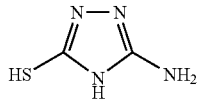

Further, example compounds 1 to 30 and 1"-1 to 1"-77 shown in EP-A No. 1308776A2, pages 73 to 87 are also described as preferable examples of the compound having an adsorptive group and a reducible group according to the invention.

These compounds can be easily synthesized by the known method. The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to a image forming layer and more preferably is to be added at an emulsion preparing process. In the case, wherein these compounds are added at an emulsion preparing process, these compounds may be added at any step in the process. For example, the silver halide grain forming step, the step before starting of desalting step, the desalting step, the step before starting of chemical ripening, the chemical ripening step, the step before preparing a final emulsion and the like are described. Also, the addition can be performed in plural times during the process. It is preferred to be added in an image forming layer, but also to be diffused at a coating step from a protective layer or an intermediate layer adjacent to the image forming layer, wherein these compounds are added in the protective layer or the intermediate layer in combination with their addition to the image forming layer.

The preferred addition amount is largely depend on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can be coexisted. Further, these compounds may be added as an emulsified dispersion by dissolving them in an organic solvent having a high boiling point and also may be added as a solid dispersion.

11) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. Particularly, the photothermographic material of the invention is preferably spectral sensitized to have a spectral sensitive peak in a range of 600 nm to 900 nm, or in a range of 300 nm to 500 nm. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or, two or more kinds of them may be used in combination.

In the invention, the sensitizing dye may be added at any amount according to the properties of sensitivity and fog, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve spectral sensitizing effect.

The super sensitizers usable in the invention can include those compounds described in EP-A No. 587338, U.S. Pat. Nos. 3,877,943 and 4,873,184, JP-A Nos. 5-341432, 11-109547 and 10-111543, and the like.

12) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

13) Mixing Silver Halide and Non-Photosensitive Organic silver Salt

The photosensitive silver halide in the invention is particularly preferably formed under the absence of the non-photosensitive organic silver salt and chemically sensitized. This is because a sufficient sensitivity can not sometimes be attained by the method of forming the silver halide by adding a halogenating agent to the non-photosensitive organic silver salt.

The method of mixing the silver halide and the non-photosensitive organic silver salt can include a method of mixing a separately prepared photosensitive silver halide and a non-photosensitive organic silver salt by a high speed stirrer, ball mill, sand mill, colloid mill, vibration mill, or homogenizer, or a method of mixing a photosensitive silver halide completed for preparation at any timing in the preparation of a non-photosensitive organic silver salt and preparing the non-photosensitive organic silver salt. The effect of the invention can be obtained preferably by any of the methods described above.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Non-Photosensitive Organic Silver Salt)

An organic compound that contains a reducible silver (I) ion is contained in the photothermographic materials of the present invention. Preferably, it is a silver salt or a coordination compound that forms a silver image which is comparatively stable to light, when heated to 50° C. or higher in the presence of an exposed silver halide and a reducing agent.

Among them, silver salts of nitrogen atom-containing heterocyclic compounds are preferred, and particularly preferred are silver salts of imino group-containing compounds. Specific examples of the silver salt include, but are not limited to these examples, silver salts of 1,2,4-triazoles, silver salts of benzotriazole or substituted benzotriazol derivatives (for example, a silver salt of methylbenzotriazole and a silver salt of 5-chlorobenzotriazole), silver salts of 1-H-tetrazoles such as phenylmercaptotetrazole described in U.S. Pat. No. 4,220,709 (de Mauriac), silver salts of imidazoles or imidazole derivatives described in U.S. Pat. No. 4,260,677 (Winslow). Among these kinds of silver salt, more preferred are silver salts of benzotriazole or substituted benzotriazol derivatives and mixtures of two more of the silver salts described herein. Most preferred compound used for the present invention is a silver salt of benzotriazole.

Silver salts of compounds containing mercapto group or thione group can also be used in the present invention. Preferred are silver salts of 5 or 6 membered heterocyclic compounds, wherein at least one atom in the ring is a nitrogen atom and the other atoms are atoms selected from carbon atom, oxygen atom, and sulfur atom. Examples of the heterocyclic compound include, but are not limited to these examples, triazoles, oxazoles, thiazoles, thiazolines, imidazoles, diazoles, pyridines, and triazines.

Representative examples of these compounds containing mercapto group or thione group set forth below include, but the invention is not limited to these examples.

- A silver salt of 3-mercapto-4-phenyl-1,2,4-triazole
- A silver salt of 2-mercapto benzimidazole
- A silver salt of 2-mercapto-5-aminothiazole
- A silver salt of 2-(2-ethylglycolamido) benzothiazole
- A silver salt of 5-carboxylic-1-methyl-2-phenyl-4-thiopyridine
- A silver salt of mercaptotriazine
- A silver salt of 2-mercaptobenzoxazole
- A silver salt described in U.S. Pat. No. 4,123,274 (Knight et al) (for example, a silver salt of a 1,2,4-mercaptothiazole derivatives, or a silver salt of 3-amino-5-benzylthio-1,2,4-thiazole)
- A silver salt of thione compounds (such as a silver salt of 3-(2-carboxyethyl)-4-methyl-4-thiazoline-2-thione described in U.S. Pat. No. 3,785,830 (Sullivan et al))

Examples of useful compound of mercapto and thione derivatives compounds containing no heterocycle include set forth below, but this invention is not limited to these examples.

- Silver salts of thioglycolic acids (such as a silver salt of S-alkylthioglycolic acid, wherein the alkyl group has 12 to 22 carbon atoms)
- Silver salts of dithiocarboxylic acids (such as a silver salt of dithioacetic acid and a silver salt of thioamide)
- Silver salts of organic compounds having a carboxylic acid group are also used preferably.

For example, a silver salt of aliphatic carboxylic acid (for example, fatty acids having 10 to 30 carbon atoms) or a silver salt of aromatic carboxylic acid is used preferably.

Preferred examples of the silver salt of aliphatic carboxylic acid include, silver behenate, silver arachidate, silver stearate, silver oleate, silver laurate, silver caprate, silver myristate, silver palmitate, silver maleate, silver fumarate, silver tartarate, silver furoate, silver linoeate, silver butyrate, silver camphorate, and mixtures thereof. More preferred are silver behenate and mixtures of silver behenate with any other silver salts.

Mixtures of silver salt of carboxylic acid and silver salt of imino group-containing compound may be used in the embodiment of the present invention.

Preferred examples of the silver salts of aromatic carboxylic acid and other carboxylic acids include the following compounds, but the invention is not limited to these examples.

- Silver benzoate, silver salt of substituted benzoates (for example, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate)
- Silver tannate
- Silver phthalate
- Silver terephthalate
- Silver salicyate
- Silver phenylacetate
- Silver pyromellitate In the present invention, silver salts of fatty acid containing thioether group described in U.S. Pat. No. 3,330,663 (Weyde et al.) are also preferably used. Soluble silver carboxylate having a hydrocarbon chain incorporating ether or thioether linkage, or having a sterically hindered substitutent in the alpha-position (on a hydrocarbon group) or ortho-position (on an aromatic group) can also be used. The silver salt can display increased solubility in coating solvents and affording coatings with less light scattering.

Such silver carboxylates are described in U.S. Pat. No. 5,491,059 (Whitcomb). Any of the silver salts described herein can be used in the invention, when necessary.

Silver salts of sulfonates which are described in U.S. Pat. No. 4,504,575 (Lee) can also be used in the embodiment of this invention. Silver salts of sulfosuccinates which are described in EP-A No. 0227141 (Leenders et al.) are also useful.

Moreover, silver salts of acetylenes described, for example, in U.S. Pat. No. 4,761,361 (Ozaki et al.) and U.S. Pat. No. 4,775,613 (Hirai et al.) can be used in the invention.

The methods used for making silver soap emulsions are well known in the art and are disclosed in Research Disclosure, April 1983, Item 22812, Research Disclosure, October 1983, Item 23419, U.S. Pat. No. 3,985,565 (Gabrielsen) and the references cited above.

Non-photosensitive silver sources which are capable of supplying reducible silver ions can also be provided as core-shell silver salts known in general or such as those described in U.S. Pat. No. 6,355,408 (Whitcomb et al.).

These silver salts include a core comprised of one or more silver salts and a shell having one or more different silver salts.

Still another useful non-photosensitive silver source in the present invention is the silver dimer compounds that comprise two silver salts different from each other as described in U.S. Pat. No. 6,472,131 (Whitcomb). Such non-photosensitive silver dimer compounds comprise two different silver salts, provided that when the two different silver salts comprise straight chain, saturated hydrocarbon groups as the silver ligands, those ligands differ by 6 or more carbon atoms.

Those of ordinary skill in the art understand that the non-photosensitive silver source, which is capable of supplying reducible silver ions, can be incorporated in the form of mixtures of any of the silver salts described above.

The non-photosensitive organic silver salt that can be used in the present invention is preferably desalted. The desalting method is not particularly limited, but known filtration methods in the art such as centrifugal filtration, suction filtration, ultrafiltration, and flocculation washing with coagulation may be preferably used. The ultrafiltrating method described in JP-A No. 2000-305214 is also preferably used.

The non-photosensitive organic silver salt is preferably used in the form of a solid dispersion of non-photosensitive organic silver salt. The solid dispersion of non-photosensitive organic silver salt is preferably prepared by reacting the solutions or suspensions of the organic compounds or their alkali metal salts (for example, sodium salt, potassium salt, and lithium salt) with silver nitrate. Furthermore, the methods as described in JP-A Nos. 1-100177, 2001-33907, and 11-104187 are also used for the preparation of the solid dispersion. Such solutions or suspensions containing the organic compounds or their alkali metal salts, and the silver nitrate solution also advantageously include a water-soluble dispersing aid. The kind and addition amount of the dispersing aid are described in JP-A No. 2000-305214, paragraph No. 0052. Preparation of the solid dispersion of organic silver salt used for the present invention is particularly preferably performed by controlling the pH according to the method described in JP-A No. 1-100177.

For obtaining a solid dispersion of non-photosensitive organic sliver salt having a small particle size being free of coagulation, a preferable example include a dispersing method comprising the steps of converting a water dispersion, that contains a non-photosensitive organic silver salt as an image forming medium and contains substantially no photosensitive silver salt, to a high speed flow dispersion, and then releasing the pressure. Such dispersing method is described in JP-A No. 2000-292882, paragraph Nos. 0027 to 0038.

Although the shape and size of the non-photosensitive organic silver salt are not particularly limited, an average particle size of non-photosensitive organic silver salt in the solid dispersion of non-photosensitive silver salt is preferably in a range of from 0.001 μm to 5.0 μm, and more preferably from 0.005 μm to 1.0 μm. The particle size distribution of the non-photosensitive organic silver salt is preferably monodisperse. Specifically, the percentage (a variation coefficient) of the value obtained by dividing the standard deviation of the average volume weight diameter by the average volume weight diameter is preferably 80% or less, more preferably 50% or less, and particularly preferably 30% or less.

The solid dispersion of non-photosensitive organic silver salt described above generally comprises a non-photosensitive organic silver salt and water. The ratio of the non-photosensitive organic silver salt to water is not particularly limited. However, the weight ratio of non-photosensitive organic silver salt in the entire dispersion is preferably in a range of from 5% by weight to 50% by weight, and more preferably from 10% by weight to 30% by weight. The dispersing aid as described above is preferably used in a minimum amount within the range suitable for attaining a minimum particle size, specifically, in an amount of from 0.5% by weight to 30% by weight, and more preferably from 1% by weight to 15% by weight, with respect to the non-photosensitive organic silver salt. In the solid dispersion of non-photosensitive organic silver salt as described above, any metal ions selected from Ca, Mg, and Zn, the aforementioned antifoggant, a stabilizer, or the like may be added.

The photosensitive silver halide grain and the non-photosensitive silver source which is capable of supplying reducible silver ions must be in catalytic proximity (that is, in the distance of reactive association), and these are preferably present in the same layer.

The non-photosensitive silver source which is capable of supplying reducible silver ions is preferably contained in an amount of from 5% by weight to 70% by weight, and more preferably from 10% by weight to 50% by weight, with respect to the total silver amount of the image forming layer.

Stated another way, the amount of the reducible non-photosensitive silver sources is generally contained in an amount of from 0.001 mol/m$^2$ to 0.2 mol/m$^2$ with respect to the photothermographic material, and more preferably from 0.01 mol/m$^2$ to 0.05 mol/m$^2$.

The total amount of silver in the photothermographic material of the present invention is generally from 0.01 mol/m$^2$ to 0.05 mol/m$^2$.

(Nucleator)

The nucleator used in the present invention is explained below.

The nucleator according to the invention is the compound, which can form a compound that can newly induce a development by the reaction with developing product in consequence of an initial development. It was conventionally known to use a nucleator for the ultra-high contrast photosensitive materials suitable for the use for graphic arts. The ultra-high contrast photosensitive materials had an average gradient of ten or more and were unsuitable for conventional photographic materials, and especially unsuitable for the medical use where high diagnostic ability was required. And because the ultra-high contrast photosensitive material had rough graininess and did not have enough sharpness, there was no aptitude in a medical diagnostic use.

The nucleator in the present invention completely differs from the nucleator in the conventional ultra-high contrast photosensitive material as regards the effect. The nucleator in the present invention does not make a gradation hard.

The nucleator in the present invention is the compound can cause development sufficiently, even if the number of photosensitive silver halide grain with respect to non-photosensitive silver salt of organic acid is extremely lessened. Although that mechanism is not clear, when thermal development is performed using the nucleator according to the present invention, it becomes clear that the number of developed silver grain exists larger than the number of photosensitive silver halide grain in the maximum density part, and it is presumed that the nucleator according to the present invention has the action to form the new development point (development nuclei) in the part where a silver halide grain does not exist.

As the nucleator, hydrazine derivative compounds represented by the following formula (H), vinyl compounds represented by the following formula (G), and quaternary onium compounds represented by the following formula (P), cyclic olefine compounds represented by formulae (A), (B) and (C) can be described as preferable examples.

Formula (H)

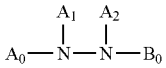

Formula (G)

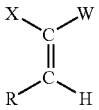

Formula (P)

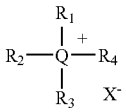

Formula (A)

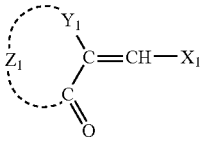

Formula (B)

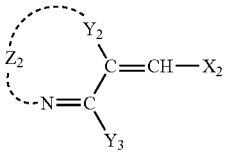

Formula (C)

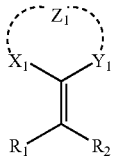

In formula (H), $A_0$ represents one selected from an aliphatic group, an aromatic group, a heterocyclic group, and a $-G_0-D_0$ group, each of which may have a substituent. $B_0$ represents a blocking group. $A_1$ and $A_2$ both represent a hydrogen atom, or one represents a hydrogen atom and the other represents one of an acyl group, a sulfonyl group, and an oxalyl group. Herein, $G_0$ represents one selected from a —CO— group, a —COCO— group, a —CS— group, a —C(=$NG_1D_1$) group, an —SO— group, an —$SO_2$— group, and a —P(O)($G_1D_1$)- group. $G_1$ represents one selected from a mere bonding hand, an —O— group, an —S— group, and an —N($D_1$)- group, and $D_1$ represents one selected from an aliphatic group, an aromatic group, a heterocyclic group, and a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described.

In formula (H), the aliphatic group represented by $A_0$ preferably has 1 to 30 carbon atoms, and particularly preferably is a normal, blanched or cyclic alkyl group having 1 to 20 carbon atoms. For example, a methyl group, an ethyl group, a t-butyl group, an octyl group, a cyclohexyl group, a benzyl group are described. These may be further substituted by a suitable substituent (e.g., an aryl group, an alkoxy group, an aryloxy group, an alkylthio group, an arylthio group, a sulfoxy group, a sulfonamido group, a sulfamoyl group, an acylamino group, an ureido group and the like).

In formula (H), the aromatic group represented by $A_0$ preferably is an aryl group of a single or condensed ring. For example, a benzene ring or a naphthalene ring is described. As a heterocyclic ring represented by $A_0$, the heterocyclic ring of a single or condensed ring containing at least one heteroatom selected from a nitrogen atom, a sulfur atom and an oxygen atom is preferable. For example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring are described. The aryl group, heterocyclic group or $-G_0-D_0$ group, as $A_0$, may have a substituent. As $A_0$, an aryl group or a $-G_0-D_0$ group is particularly preferable.

And, in formula (H), $A_0$ preferably contains at least one of a diffusion-resistant group or an adsorptive group to silver halide. As a diffusion-resistance group, a ballast group usually used as non-moving photographic additive is preferable. As a ballast group, a photochemically inactive alkyl group, alkenyl group, alkynyl group, alkoxy group, phenyl group, phenoxy group, alkylphenoxy group and the like are described and it is preferred that the substituent part has 8 or more carbon atoms in total.

In formula (H), as an adsorption promoting group to silver halide, thiourea, a thiourethane group, a mercapto group, a thioether group, a thione group, a heterocyclic group, a thioamido heterocyclic group, a mercapto heterocyclic group or an adsorptive group described in JP-A No. 64-90439 and the like are described.

In formula (H), $B_0$ represents a blocking group and preferably a $-G_0-D_0$ group. $G_0$ represents one selected from a —CO— group, a —COCO— group, a —CS— group, a —C(=$NG_1D_1$) group, an —SO— group, an —$SO_2$— group, and a —P(O)($G_1D_1$)- group. As preferable $G_0$, a —CO— group and a —COCO— group are described. $G_1$ represents one selected from a mere bonding hand, an —O— group, an —S— group, and an —N($D_1$)- group, and $D_1$ represents one selected from an aliphatic group, an aromatic group, a heterocyclic group, and a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described. $A_1$ and $A_2$ both represent a hydrogen atom, or one of $A_1$ and $A_2$ represents a hydrogen atom and the other represents one selected from an acyl group (an acetyl group, a trifluoroacetyl group, a benzoyl group or the like), a sulfonyl group (a methanesulfonyl group, a toluenesulfonyl group or the like), and an oxalyl group (an ethoxalyl group or the like).

As specific examples of the compound represented by formula (H), the compound H-1 to H-35 of chemical formula Nos. 12 to 18 and the compound H-1-1 to H-4-5 of chemical formula Nos. 20 to 26 in JP-A No. 2002-131864 are described, however specific examples are not limited in these.

The compounds represented by formula (H) can be easily synthesized by known methods. For example, these can be synthesized by referring to U.S. Pat. Nos. 5,464,738 and 5,496,695.

In addition, hydrazine derivatives preferably used are the compound H-1 to H-29 described in U.S. Pat. No. 5,545,505, columns 11 to 20 and the compounds 1 to 12 described in U.S. Pat. No. 5,464,738, columns 9 to 11. These hydrazine derivatives can be synthesized by known methods.

Next, formula (G) is explained. In formula (G), although X and R are displayed in a cis form, a trans form for X and R is also included in formula (G). This is also similar to the structure display of specific compounds.

In formula (G), X represents an electron-attracting group, and W represents one selected from a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, a pyrylium group, and an immonium group.

R represents one selected from a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of hydroxy group or mercapto group (e.g., a sodium salt, a potassium salt, a silver salt and the like), an amino group, an alkylamino group, a cyclic amino group (e.g., a pyrrolidino group and the like), an acylamino group, an oxycarbonylamino group, a heterocyclic group (a 5 or 6 membered nitrogen containing heterocycle, e.g., a benzotriazolyl group, an imidazolyl group, a triazolyl group, a tetrazolyl group and the like), an ureido group, and a sulfonamido group. X and W, and X and R may bind each other to form a cyclic structure. As the ring formed by X and W, for example, pyrazolone, pyrazolidinone, cyclopentanedione, β-ketolactone, β-ketolactam and the like are described.

Explaining formula (G) further, the electron-attracting group represented by X is a substituent which can have a positive value of substituent constant σp. Specifically, a substituted alkyl group (halogen substituted alkyl and the like), a substituted alkenyl group (cyanovinyl and the like), a substituted or unsubstituted alkynyl group (trifluoromethylacetylenyl, cyanoacetylenyl and the like), a substituted aryl group (cyanophenyl and the like), a substituted or unsubstituted heterocyclic group (pyridyl, triazinyl, benzoxazolyl and the like), a halogen atom, a cyano group, an acyl group (acetyl, trifluoroacetyl, formyl and the like), a thioacetyl group (thioacetyl, thioformyl and the like), an oxalyl group (methyloxalyl and the like), an oxyoxalyl group (ethoxalyl and the like), a thiooxalyl group (ethylthiooxalyl and the like), an oxamoyl group (methyloxamoyl and the like), an oxycarbonyl group (ethoxycarbonyl and the like), a carboxyl group, a thiocarbonyl group (ethylthiocarbonyl and the like), a carbamoyl group, a thiocarbamoyl group, a sulfonyl group, a sulfinyl group, an oxysulfonyl group (ethoxysulfonyl and the like), a thiosulfonyl group (ethylthiosulfonyl and the like), a sulfamoyl group, an oxysulfinyl group (methoxy sulfinyl and the like), a thiosulfinyl group (methylthiosulfinyl and the like), a sulfinamoyl group, a phosphoryl group, a nitro group, an imino group, a N-carbonylimino group (N-acetylimino and the like), a N-sulfonylimino group (N-methanesulfonylimino and the like), a dicyanoethylene group, an ammonium group, a sulfonium group, a phosphonium group, a pyrylium group, an immonium group and the like are described, and a heterocyclic one formed by an ammonium group, a sulfonium group, a phosphonium group, an immonium group or the like is also included. The substituent having σp value of 0.30 or more is particularly preferable.

As an alkyl group represented by W, methyl, ethyl, trifluoromethyl and the like are described. As an alkenyl group as W, vinyl, halogen substituted vinyl, cyanovinyl and the like are described. As an aryl group as W, nitrophenyl, cyanophenyl, pentafluorophenyl and the like are described, and as a heterocyclic group as W, pyridyl, pyrimidyl, triazinyl, succinimido, tetrazolyl, triazolyl, imidazolyl, benzimidazolyl and the like are described. As W, the electron-attracting group having a positive σp value is preferable, and that value is more preferably 0.30 or more.

Among the substituents of R described above, a hydroxy group, a mercapto group, an alkoxy group, an alkylthio group, a halogen atom, an organic or inorganic salt of hydroxy group or mercapto group, and a heterocyclic group are preferably described. More preferably a hydroxy group, an alkoxy group, an organic or inorganic salt of hydroxyl group or mercapto group and a heterocyclic group are described, and particularly preferably a hydroxy group and an organic or inorganic salt of hydroxy group or mercapto group are described.

And among the substituents of X and W described above, the group having a thioether bond in the substituent is preferable.

As specific examples of the compound represented by formula (G), compound 1-1 to 92-7 of chemical formula Nos. 27 to 50 described in JP-A No. 2002-131864 are described, however specific examples are not limited in these.

In formula (P), Q represents one of a nitrogen atom and a phosphor atom. $R_1$, $R_2$, $R_3$ and $R_4$ each independently represent one of a hydrogen atom and a substituent, and $X^-$ represents an anion. And $R_1$ to $R_4$ may link each other to form a ring.

As the substituent represented by $R_1$ to $R_4$, an alkyl group (a methyl group, an ethyl group, a propyl group, a butyl group, a hexyl group, a cyclohexyl group and the like), an alkenyl group (an allyl group, a butenyl group and the like), an alkynyl group (a propargyl group, a butynyl group and the like), an aryl group (a phenyl group, a naphthyl group and the like), a heterocyclic group (a piperidinyl group, a piperazinyl group, a morpholinyl group, a pyridyl group, a furyl group, a thienyl group, a tetrahydrofuryl group, a tetrahydrothienyl group, a sulforanyl group and the like), an amino group and the like are described.

As the ring formed by linking $R_1$ to $R_4$ each other, a piperidine ring, a morpholine ring, a piperazine ring, a quinuclidine ring, a pyridine ring, a pyrrole ring, an imidazole ring, a triazole ring, a tetrazole ring and the like are described.

The group represented by $R_1$ to $R_4$ may have a substituent such as a hydroxy group, an alkoxy group, an aryloxy group, a carboxyl group, a sulfo group, an alkyl group, an aryl group and the like. As $R_1$, $R_2$, $R_3$ and $R_4$, a hydrogen atom and an alkyl group are preferable.

As the anion represented by $X^-$, an organic or inorganic anion such as a halogen ion, a sulfate ion, a nitrate ion, an acetate ion, a p-toluenesulfonate ion and the like are described.

As a structure of formula (P), the structure described in paragraph Nos. 0153 to 0163 in JP-A No. 2002-131864 is still more preferable.

As the specific compounds of formula (P), P-1 to P-52 and T-1 to T-18 of chemical formula Nos. 53 to 62 in JP-A No. 2002-131864 can be described, however the specific compound is not limited in these.

The quaternary onium compound described above can be synthesized by referring to known methods. For example, the tetrazolium compound described above can be synthesized by referring to the method described in Chemical Reviews, vol. 55, pages 335 to 483.

Next, the compounds represented by formulae (A) and (B) are explained in detail. In formula (A), $Z_1$ represents a nonmetallic atomic group capable to form a 5 to 7 membered ring structure with —$Y_1$—C(═CH—$X_1$)—C(═O)—.

$Z_1$ preferably is an atomic group selected from a carbon atom, an oxygen atom, a sulfur atom, a nitrogen atom and a hydrogen atom, and several atoms selected from these are bound each other by single bond or double bond to form a 5 to 7 membered ring structure with —$Y_1$—C(═CH—$X_1$)—C(═O)—. $Z_1$ may have a substituent, and $Z_1$ itself may be an aromatic or a non-aromatic carbon ring, or $Z_1$ may be a part of an aromatic or a non-aromatic heterocycle, and in this case, a 5 to 7 membered ring structure formed by $Z_1$ with —$Y_1$—C(═CH—$X_1$)—C(═O)— forms a condensed ring structure.

In formula (B), $Z_2$ represents a nonmetallic atomic group capable to form a 5 to 7 membered ring structure with —$Y_2$—C(═CH—$X_2$)—C($Y_3$)═N—. $Z_2$ preferably is an atomic group selected from a carbon atom, an oxygen atom, a sulfur atom, a nitrogen atom and a hydrogen atom, and several atoms selected from these are linked each other by single bond or double bond to form a 5 to 7 membered ring structure with —$Y_2$—C(═CH—$X_2$)—C($Y_3$)═N—. $Z_2$ may have a substituent, and $Z_2$ itself may be an aromatic or a non-aromatic carbon ring, or $Z_2$ may be a part of an aromatic or a non-aromatic heterocycle and in this case, a 5 to 7 membered ring structure formed by $Z_2$ with —$Y_2$—C(═CH—$X_2$)—C($Y_3$)═N— forms a condensed ring structure.

In the case where $Z_1$ and $Z_2$ have a substituent, examples of substituent are selected from the compounds described below. Namely, as typical substituent, for example, a halogen atom (fluorine atom, chlorine atom, bromine atom or iodine atom), an alkyl group (includes an aralkyl group, a cycloalkyl group and an active methylene group), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxy group or a salt thereof, a sulfonylcarbamoyl group, an acylcarbamoyl groyp, a sulfamoylcarbamoyl group, a carbazoyl group, an oxalyl group, an oxamoyl group, a cyano group, a thiocarbamoyl group, a hydroxy group, an alkoxy group (includes the group in which an ethylene oxy group or a propylene oxy group unit are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, a N-substituted nitrogen containing heterocyclic group, an acylamino group, a sulfonamido group, an ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, a sulfo group or a salt thereof, a sulfamoyl group, an acylsulfamoyl group, a sulfonylsulfamoyl group or a salt thereof, a group containing phosphoric amido or phosphoric ester structure, a silyl group, a stannyl group and the like are described. These substituents may be further substituted by these substituents.

Next, $Y_3$ is explained. In formula (B), $Y_3$ represents one of a hydrogen atom and a substituent, and when $Y_3$ represents a substituent, following group is specifically described as that substituent. Namely, an alkyl group, an aryl group, a heterocyclic group, a cyano group, an acyl group, an alkoxycarbonyl group, an aryloxycarbonyl group, a carbamoyl group, an amino group, an alkylamino group, an arylamino group, a heterocyclic amino group, an acylamino group, a sulfonamido group, an ureido group, a thioureido group, an imido group, an alkoxy group, an aryloxy group, an alkylthio group, an arylthio group, a heterocyclic thio group and the like are described. These substituents may be substituted by any substituents, and specifically, examples of the substituents which $Z_1$ or $Z_2$ may have, are described.

In formulae (A) and (B), $X_1$ and $X_2$ each independently represent one selected from a hydroxy group (or a salt thereof), an alkoxy group (e.g., a methoxy group, an ethoxy group, a propoxy group, an isopropoxy group, an octyloxy group, a dodecyloxy group, a cetyloxy group, a t-buthoxy group and the like), an aryloxy group (e.g., a phenoxy group, a p-t-pentylphenoxy group, a p-t-octylphenoxy group and the like), a heterocyclic oxy group (e.g., a benzotriazolyl-5-oxy group, a pyridinyl-3-oxy group and the like), a mercapto group (or a salt thereof), an alkylthio group (e.g., methylthio group, an ethlythio group, a butylthio group, a dodecylthio group and the like), an arylthio group (e.g., a phenylthio group, a p-dodecylphenylthio group and the like), a heterocyclic thio group (e.g., a 1-phenyltetrazoyl-5-thio group, a 2-methyl-1-phenyltriazolyl-5-thio group, a mercaptothiadiazolylthio group and the like), an amino group, an alkylamino group (e.g., a methylamino group, a propylamino group, an octylamino group, a dimethylamino group and the like), an arylamino group (e.g., an anilino group, a naphthylamino group, an o-methoxyanilino group and the like), a heterocyclic amino group (e.g., a pyridylamino group, a benzotriazole-5-ylamino group and the like), an acylamino group (e.g., an acetamido group, an octanoylamino group, a benzoylamino group and the like), a sulfonamido group (e.g., a methanesulfonamido group, a benzenesulfonamido group a dodecylsulfonamido group and the like), and a heterocyclic group.

Herein, a heterocyclic group is an aromatic or non-aromatic, a saturated or unsaturated, a single ring or condensed ring, or a substituted or unsubstituted heterocyclic group. For example, a N-methylhydantoyl group, a N-phenylhydantoyl group, a succinimido group, a phthalimido group, a N,N'-dimethylurazolyl group, an imidazolyl group, a benzotriazolyl group, an indazolyl group, a morpholino group, a 4,4-dimethyl-2,5-dioxo-oxazolyl group and the like are described.

And herein, a salt represents a salt of an alkali metal (sodium, potassium and lithium) or a salt of an alkali earth metal (magnesium and calcium), a silver salt or a quaternary ammonium salt (a tetraethylammonium salt, a dimethylcetylbenzylammonium salt and the like), a quaternary phosphonium salt and the like. In formulae (A) and (B), $Y_1$ and $Y_2$ represent —C(═O)— or —$SO_2$—.

The preferable range of the compound represented by formulae (A) and (B) is described in JP-A No. 11-231459, paragraph Nos. 0027 to 0043. As specific examples of the compound represented by formulae (A) and (B), compound 1 to 110 of Table 1 to 8 in JP-A No. 11-231459 are described, however the invention is not limited in these.

Next, the compound represented by formula (C) is explained in detail. In formula (C), $X_1$ represents one selected from an oxygen atom, a sulfur atom, and a nitrogen atom. In the case where $X_1$ is a nitrogen atom, the bond of $X_1$ and $Z_1$ may be either a single bond or a double bond, and in the case of a single bond, a nitrogen atom may have a hydrogen atom or any substituent. As this substituent, for example, an alkyl group (includes an aralkyl group, a cycloalkyl group, an active methylene group and the like), an alkenyl group, an alkynyl group, an aryl group, a heterocyclic group, an acyl group, an alkoxycarbonyl group, an aryloxycarbonyl group, a carbamoyl group, an alkylsulfonyl group, an arylsulfonyl group, a heterocyclic sulfonyl group and the like are described.

$Y_1$ represents the group represented by one selected from —C(═O)—, —C(═S)—, —SO—, —$SO_2$—, —C(═$NR_3$)—, and —($R_4$)C═N—. $Z_1$ represents a non-metallic atomic group capable to form a 5 to 7 membered ring containing $X_1$ and $Y_1$. The atomic group to form that ring is an atomic group which consists of 2 to 4 atoms that are other than metal atoms, and these atoms may be combined by single bond or double bond, and these may have a hydrogen atom or any subsituent (e.g., an alkyl group, an aryl group, a heterocyclic group, an alkoxy group, an alkylthio group, an acyl group, an amino group or an alkenyl group). When $Z_1$ forms a 5 to 7 membered ring containing $X_1$ and $Y_1$ the ring is a saturated or unsaturated heterocyclic ring, and may be a single ring or may have a condensed ring. When $Y_1$ is the group represented by C(═$NR_3$), ($R_4$)C═N, the condensed ring of this case may be formed by binding $R_3$ or $R_4$ with the substituent of $Z_1$.

In formula (C), $R_1$, $R_2$, $R_3$ and $R_4$ each independently represent one of a hydrogen atom and a substituent. However, $R_1$ and $R_2$ never bind each other to form a ring structure.

When $R_1$ and $R_2$ represent a monovalent substituent, the following groups are described as a monovalent substituent.

For example, a halogen atom (fluorine atom, chlorine atom, bromine atom or iodine atom), an alkyl group (an aralkyl group, a cycloalkyl group, an active methylene group and the like), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxy group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group and a salt thereof, an alkoxy group (includes the group in which an ethylene oxy group or a propylene oxy group unit are repeated), an aryloxy group, a heterocyclic oxy group, an acyloxy group, an alkoxy carbonyloxy group, an aryloxycarbonyloxy group, a carbamoyloxy group, a sulfonyloxy group, an amino group, an alkylamino group, an arylamino group, an heterocyclic amino group, a N-substituted nitrogen containing heterocyclic group, an acylamino group, a sulfonamido group, an ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group and a salt thereof, an alkylthio group, an arylthio group, an heterocyclic thio group, an alkylsulfonyl group, an arylsulfonyl group, an alkylsulfinyl group, an arylsulfinyl group, a sulfo group and a salt thereof, a sulfamoyl group, an acylsulfamoyl group, a sulfonylsulfamoyl group and a salt thereof, a phosphoryl group, a group containing phosphoric amido or phosphoric ester structure, a silyl group, a stannyl group and the like are described. These substituents may be further substituted by these monovalent substituents.

When $R_3$ and $R_4$ represent a substituent, the same substituent as what $R_1$ and $R_2$ may have except the halogen atom can be described as the substituent. Furthermore, $R_3$ and $R_4$ may further link to $Z_1$ to form a condensed ring.

Next, among the compounds represented by formula (C), preferable compounds are described. In formula (C), $Z_1$ preferably is an atomic group which forms a 5 to 7 membered ring with $X_1$ and $Y_1$, and consists of the atoms selected from 2 to 4 carbon atoms, a nitrogen atom, a sulfur atom and an oxygen atom. A heterocycle, which is formed by $Z_1$ with $X_1$ and $Y_1$, preferably contains 3 to 40 carbon atoms in total, more preferably 3 to 25 carbon atoms in total, and most preferably 3 to 20 carbon atoms in total. $Z_1$ preferably comprises at least one carbon atom.

In formula (C), $Y_1$ is preferably one selected from —C(═O)—, —C(═S)—, —$SO_2$—, and —($R_4$)C═N—, particularly preferably one selected from —C(═O)—, —C(═S)—, and —$SO_2$— and most preferably —C(═O)—.

In formula (C), in the case where $R_1$ and $R_2$ represent a monovalent substituent, the monovalent substituent represented by $R_1$ and $R_2$ preferably is one of the following groups having 0 to 25 carbon atoms in total, namely, those are an alkyl group, an aryl group, a heterocyclic group, an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an imido group, an acylamino group, a hydroxy group, a salt thereof, a mercapto group, a salt thereof, and an electron-attracting group. Herein, an electron-attracting group means the substituent capable to have a positive value of Hammett substituent constant σp, and specifically a cyano group, a sulfamoyl group, an alkylsulfonyl group, an arylsulfonyl group, a sulfonamido group, an imino group, a nitro group, a halogen atom, an acyl group, a formyl group, a phosphoryl group, a carboxy group (or a salt thereof), a sulfo group (or a salt thereof), a saturated or unsaturated heterocyclic group, an alkenyl group, an alkynyl group, an acyloxy group, an acylthio group, a sulfonyloxy group or an aryl group substituted by these electron-attracting group are described. These substituents may have any substituents.

In formula (C), when $R_1$ and $R_2$ represent a monovalent substituent, more preferable are one selected from an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an imido group, an acylamino group, a sulfonamido group, a heterocyclic group, a hydroxy group or a salt thereof, a mercapto group, a salt thereof, and the like. In formula (C), $R_1$ and $R_2$ particularly preferably are one selected from a hydrogen atom, an alkoxy group, an aryloxy group, an alkylthio group, an arylthio group, a heterocyclic group, a hydroxy group, a salt thereof, a mercapto group, a salt thereof, and the like. In formula (C), most preferably, one of $R_1$ and $R_2$ is a hydrogen atom and another is one selected from an alkoxy group, an aryloxy group, an alkylthio group, an arylthio group, a heterocyclic group, a hydroxy group, a salt thereof, a mercapto group, and a salt thereof.

In formula (C), when $R_3$ represents a substituent, $R_3$ is preferably an alkyl group having 1 to 25 carbon atoms in total (including an aralkyl group, a cycloalkyl group, an active methylene group and the like), an alkenyl group, aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, an amino group, or the like. An alkyl group and an aryl group are particularly preferable.

In formula (C), when $R_4$ represents a substituent, $R_4$ is preferably an alkyl group having 1 to 25 carbon atoms in total (including an aralkyl group, a cycloalkyl group, an active methylene group and the like), an aryl group, a heterocyclic group, a heterocyclic group containing a quaternary nitrogen (e.g., a pyridinio group)., an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, or the like. Particularly preferably, an alkyl group, an aryl group, an alkoxy group, an aryloxy group, a heterocyclic oxy group, an alkylthio group, an arylthio group, a heterocyclic thio group and the like are described. When $Y_1$ represents $C(R_4)=N$, the carbon atom in $Y_1$ binds with the carbon atom substituted by $X_1$ or $Y_1$.

Specific compounds represented by formula (C) are represented by A-1 to A-230 of chemical formula Nos. 6 to 18 described in JP-A No. 11-133546, however the invention is not limited in these.

The addition amount of the above nucleator is in the range of $10^{-5}$ mol to 1 mol per 1 mol of organic silver salt, and preferably, in a range of $10^{-4}$ mol to $5\times10^{-1}$ mol.

The nucleator described above may be incorporated into photothermographic material by being added into the coating solution, such as in the form of a solution, an emulsion dispersion, a solid fine particle dispersion, and the like.

As well known emulsion dispersing method, there can be mentioned a method comprising dissolving the nucleator in an oil such as dibutylphthalate, tricresylphosphate, dioctylsebacate, tri(2-ethylhexyl)phosphate and the like and an auxiliary solvent such as ethyl acetate and cyclohexanone, and then adding a surfactant such as sodium dodecylbenzenesulfonate, sodium oleil-N-methyltaurinate, sodium di(2-ethylhexyl)sulfosuccinate and the like; from which an emulsion dispersion is mechanically produced. During the process, for the purpose of controlling viscosity of oil droplet and refractive index, the addition of polymer such as α-methylstyrene oligomer, poly(t-butylacrylamide) or the like is preferable.

As solid particle dispersing method, there can be mentioned a method comprising dispersing the powder of the nucleator in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range of from 1 ppm to 1000 ppm. It is practically acceptable so long as Zr is incorporated in an amount of 0.5 mg or less per 1 g of silver.

Preferably, an antiseptic (for instance, sodium benzoisothiazolinone salt) is added in the water dispersion.

The nucleator is particularly preferably used as solid particle dispersion, and is added in the form of fine particles having average particle size from 0.01 μm to 10 μm, preferably from 0.05 μm to 5 μm and, more preferably from 0.1 μm to 2 μm. In the invention, other solid dispersions are preferably used with this particle size range.

In the photothermographic material which is subjected to a rapid development where time period for development is 20 seconds or less, the compound represented by formulae (H) and (P) is used preferably, and the compound represented by formula (H) is used particularly preferably, among the nucleators described above.

In the photothermographic material where low fog is required, the compound represented by formulae (G), (A), (B), or (C) is used preferably, and the compound represented by formulae (A), or (B) is particularly preferably used. Moreover, in the photothermographic materials having a few change of photographic property against environmental conditions when used on various environmental conditions (temperature and humidity), the compound represented by formula (C) is preferably used.

Although preferred specific compounds among the above-mentioned nucleators are shown below, the invention is not limited in these.

SH-1

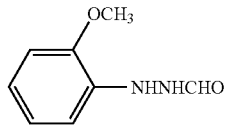

SH-2

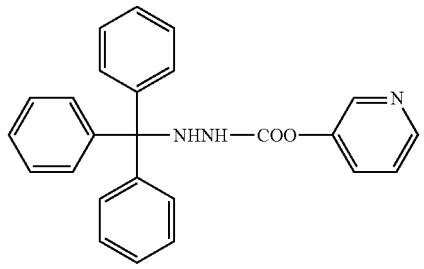

-continued

SH-3

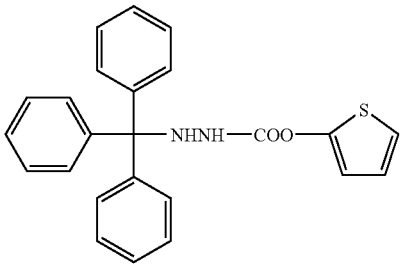

SH-4

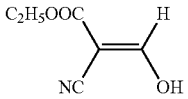

SH-5

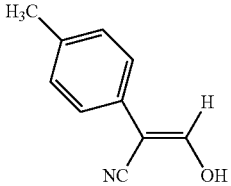

SH-6

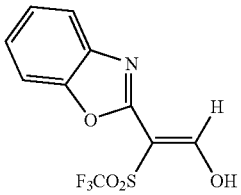

SH-7

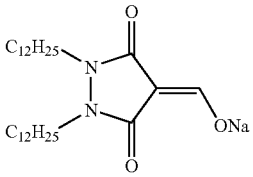

SH-8

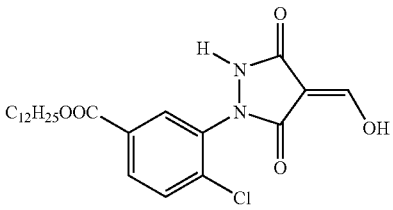

SH-9

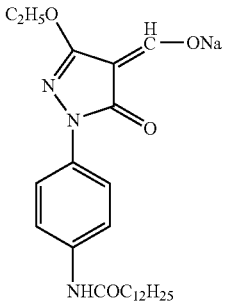

-continued

SH-10

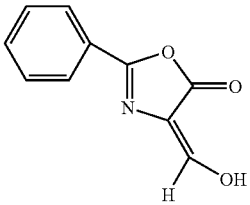

SH-11

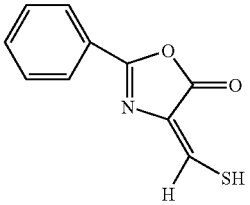

SH-12

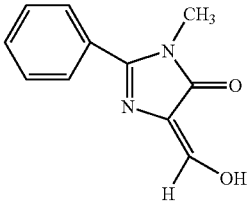

The nucleator of the present invention can be added to the image forming layer or the layer adjacent to the image forming layer, however, preferably to the image forming layer. The addition amount of nucleator is in a range of $10^{-5}$ mol to 1 mol per 1 mol of organic silver salt, and preferably, in a range of $10^{-4}$ mol to $5\times10^{-1}$ mol. The nucleator may be added either only one kind or, two or more kinds in combination.

In the photothermographic material of the present invention, the image forming layer containing photosensitive silver halide may be two or more layers and in the case where there are two or more layers, any image forming layer may contain the nucleator. It is preferred to have at least two image forming layers which one of them contains the nucleator and the other does not contain the nucleator.

(Reducing Agent)

The reducing agent (or reducing agent mixture comprising two or more components) for silver ions can be any material, preferably an organic material, that can reduce silver (I) ion to metallic silver.

The photographic developing agents used for conventional wet processing (such as methyl gallate, hydroquinone, substituted hydroquinone, 3-pyrazolidones, p-aminophenols, p-phenylenediamines, hindered phenols, admioximes, azines, catechols, pyrogallols, ascorbic acid (and derivatives thereof), and leuco dyes), and other materials readily apparent to one skilled in the art, for example, materials described in U.S. Pat. No. 6,020,117 (Bauer et al.) can be used in the present invention.

An "ascorbic acid reducing agent" (referred as a developing agent) indicates broad compounds including ascorbic acid and their derivatives. Ascorbic acid developing agents are described in many references, for example, in U.S. Pat. No. 5,236,816 (Purol et al.) and their cited references.

As for developing agents used for the present invention, ascorbic acid developing agent is preferred. Useful examples of the ascorbic acid developing agent include ascorbic acid and the like, isomer and the derivatives. Examples of such compounds include the following, but the invention is not limited to these examples.

D- or L-ascorbic acids and their glycosylated derivatives (for example, sorboascorbic acid, gamma-lacto ascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, and L-arabosascorbic acid)

A sodium salt of ascorbic acid

A potassium salt of ascorbic acid

An isoascorbic acid (or L-erythroascorbic acid) and a salt thereof (for example, alkali salt, ammonium salt, or the salt known in this technical field)

An endiol type of ascorbic acid

An enaminol type of ascorbic acid

A thio enol type of ascorbic acid (for example, compounds described in U.S. Pat. No. 5,498,511 (Yamashita et al.), EP-A Nos. 0585792 (Passarella et al.), 0573700 (Lingier et al.), and 0588408 (Hieronymus et al.), U.S. Pat. No. 5,278,035 (Knapp), U.S. Pat. No. 5,384,232 (Bishop et al.), and U.S. Pat. No. 5,376,510 (Parker et al.), JP-A No. 7-56286 (Toyoda), U.S. Pat. No. 2,688,549 (James et al.), and Research Disclosure, March 1995, Item 37152).

Among them, preferred are D-, L- or D, L-ascorbic acid (and an alkali salt thereof) or isoascorbic acid (and an alkali salt thereof), the sodium salt is more preferred. Mixtures of these developing agents can also be used when necessary.

Hindered phenols are preferably used individually or in combination with one or more of high-contrast developer and contrast enhancing agent.

The hindered phenols are compounds that has one hydroxy group on one given benzene ring and have at least one additional substituent located on ortho position with respect to the hydroxy group. Hindered phenol developing agents may contain a plurality of hydroxy groups so long as each hydroxy group is located on different benzene rings.

Examples of hidered phenol reducing agents include, for example, binaphthols (that is dihydroxybinaphthols), biphenols (that is dihydroxy-biphenols), bis(hydroxynaphthyl) methanes, bis(hydroxypheyl)methanes, hindered phenols, and hindered naphthols, each of which may be substituted.

Representative examples of binaphthols include the following, but the invention is not limited to these examples.

1,1'-Bi-2-naphthol 1,1'-Bi-4-methyl-2-naphthol 6,6'-Dibromo-bi-2-naphthol and other compounds are described in U.S. Pat. No. 3,094,714 (Workman) and U.S. Pat. No. 5,262,295 (Tanaka et al.).

Representative examples of bisphenols include, but are not limited to these examples.

2,2-Dihydroxy-3,3'-di-t-butyl-5,5-dmethylbiphenyl 2,2'-Dihydroxy-3,3',5,5'-tetra-t-buthyl biphenyl 2,2'-Dihydroxy-3,3'-di-t-butyl-5,5'-dichloro biphenyl 2-(2-Hydroxy-3-t-butyl-5-methyl phenyl)-4-methyl-6-n-hexyl phenol 4,4'-Dihydroxy-3,3',5,5'-tetra-t-butyl biphenyl 4,4'-Dihydroxy-3,3',5,5'-tetramethyl biphenyl Compounds described in U.S. Pat. No. 5,262,295

Representative examples of bis(hydroxy naphthyl) methanes include the following, but the invention is not limited to these examples.

4,4'-methylene bis(2-methyl-1-naphthol)

Compounds described in U.S. Pat. No. 5,262,295

Representative examples of bis(hydroxyphenyl) methanes include the following, but the invention is not limited to these examples.

Bis(2-hydroxy-3-t-butyl-5-methyl phenyl)methane (CAO-5)

1,1'-Bis(2-hydroxy-3,5-dimethylphenyl)-3,5,5-trimethyl hexane (NONOX or PERMANAX WSO)

1,1'-Bis(3,5-di-t-butyl-4-hydroxy phenyl)methane 2,2'-Bis(4-hydroxy-3-methyl phenyl)propane 4,4'-Ethylidene-bis(2-t-butyl-6-methyl phenol)

2,2'-Isobutylidene-bis(4,6-dimethyl phenol) (LOWINOX 221B46)

2,2'-Bis(3,5-dimethyl-4-hydroxy phenyl)propane

Compounds described in U.S. Pat. No. 5,262,295

Representative examples of hindered phenols include the following, but the invention is not limited to these examples.

2,6-Di-t-butyl phenol 2,6-Di-t-butyl-4-methyl phenol 2,4-Di-t-butyl phenol 2,6-Dichloro phenol 2,6-Dimethyl phenol 2-t-Butyl-6-methyl phenol Representative examples of hindered naphthols include the following, but the invention is not limited to these examples.

1-Naphthol, 4-methyl-1-naphthol

4-Methoxy-1-naphthol

4-Chloro-1-naphthol

2-Methyl-1-naphthol

Compounds described in U.S. Pat. No. 5,262,295

More specific, alternative reducing agents that have been disclosed as suitable for the photothermographic material include the following compounds.

Amidoximes (for example, phenyl amidoxime)

2-Thienyl-amidoxime p-Phenoxy phenyl amidoxime

Azines (for example, 4-hydroxy-3,5-dimethoxybenzalde hydrazine)

A combination of aliphatic carboxylic acid aryl hydrazides and ascorbic acid (such as a combination of 2,2'-bis-(hydroxymethyl)-propionyl-β-phenyl hydrazide and ascorbic acid)

A combination of polyhydroxy benzene and one selected from a hydroxylamine, a reductone, and a hydrazine (for example, a combination of hydroquinone and bis(ethoxy ethyl)hydroxylamine)

Piperidino-4-methyl phenylhydrazine

Hydroxamic acids (for example, phenyl hydroxamic acid, p-hydroxylphenyl hydroxamic acid, or o-alanine hydroxamic acid)

A combination of azines and sulfonamido phenols (for example, a combination of phenothiazine and 2,6-dichloro-4-benzene sulfonamido phenol)

α-Cyano phenylacetic acid derivatives (for example, ethyl-α-cyano-2-methylphenyl acetate and ethyl-α-cyanophenyl acetate)

Bis-o-naphthols (for example, 2,2'-dihydroxy-1-binaphthyl, 6,6'-bibromo-2,2'-dihydroxy-1,1'-binaphthyl, or bis(2-hydroxy-1-naphthyl)methane)

A combination of bis-o-naphthol and 1,3-dihydroxy benzene derivatives (for example, 2,4-dihydroxy benzophenone, and 2,4-dihydroxy acetophenone)

5-Pyrazolones (for example, 3-methyl-1-phenyl-5-pyrazolone)

Reductones (for example, dimethyl aminohexose reductone, anhydrodihydro-aminohexose reductone, or anhydrodihydro-piperidone-hexose reductone)

Sulfonamido phenol reducing agents (for example, 2,6-dichloro-4-benzene sulfonamide phenol, or p-benzene sulfonamide phenol)

Indane-1,3-diones (for example, 2-phenylindane-1,3-dione)

Chromans (for example, 2,2-dimethyl-7-t-butyl-6-hydroxy chroman)

1,4-Dihydropyridines (for example, 2,6-dimethoxy-3,5-dicarbethoxy-1,4-dihydropyridine)

Ascorbic acid derivatives (for example, 1-ascorbyl palmitate, or ascorbyl stearate)

Unsaturated aldehydes (for example, ketone)

3-Pyrazolidones.

An additional class of reducing agents that can be used as developing agents are substituted hydrazines including the sulfonyl hydrazines described in U.S. Pat. No. 5,464,738 (Lynch et al.). Still other useful reducing agents are described for example, in U.S. Pat. No. 3,074,809 (Owen), U.S. Pat. No. 3,094,417 (Workman), and U.S. Pat. No. 3,080,254 (Grant Jr). Auxiliary reducing agents may be useful as described in U.S. Pat. No. 5,981,151 (Leenders et al.). All compounds disclosed in the above patents can be applied for the present invention.

The reducing agent preferably may comprises two or more components such as a hindered phenol developing agent and a compounds that can be selected from the various classes of co-reducing agents set forth below. Ternary developing agent mixtures involving the further addition of contrast enhancing agents are also useful.

As for the co-reducing agents, trityl hydrazines and formyl phenyl hydrazines described in U.S. Pat. No. 5,496,695 (Simpson et al.) can be used.

Examples of useful contrast enchancing agents include the following, but the invention is not limited to these examples Hydroxylamines (including hydroxylamine, and alkyl- and aryl-substituted derivatives thereof), alkanolamines and ammonium phthalamate compounds described, for example, in U.S. Pat. No. 5,545,505 (Simpson), hydroxamic acid compounds described, for example, in U.S. Pat. No. 5,545,507 (Simpson et al.), N-acylhydrazine compounds described, for example, in U.S. Pat. No. 5,558,983 (Simpson et al), and hydrogen atom donor compounds described in U.S. Pat. No. 5,637,449 (Harring et al.).

All compounds disclosed in the above patents can be applied for the present invention.

The all combination of reducing agent and non-photosensitive organic silver salt are not always effective evenly. One of the most preferred is a combination of, as non-photosensitive silver source, silver salt of benztraizole and their substituted compounds or the mixture, and as reducing agent, ascorbic acid reducing agent.

The additional preferred combination is a combination of, as non-photosensitive organic silver salt, silver salt of fatty acid having 10 to 30 carbon atoms or the mixture thereof, and as reducing agent, hindered phenol.

The reducing agent (or mixture thereof) described herein is generally incorporated in an amount of from 1% by weight to 10% by weight (dry weight) of the image forming layer. In multilayer construction, if the reducing agent is added to a layer other than an image forming layer, slightly higher proportions may be more desirable, such as from 2% by weight to 15% by weight. The co-developing agent is generally incorporated in an amount of from 0.001% by weight to 1.5% by weight (dry weight) of the general image forming layer.

The reducing agent of the invention can be added to the image forming layer which comprises a non-photosensitive organic silver salt and a photosensitive silver halide and to the layer adjacent to the image forming layer, but is preferably contained in the image forming layer.

In the invention, the reducing agent may be incorporated into photothermographic material by being added into the coating solution in any form, such as in the form of solution, emulsion dispersion, solid fine particle dispersion, and the like.

As well known emulsion dispersing method, there can be mentioned a method comprising dissolving the reducing agent in an oil such as dibutyl phthalate, tricresyl phosphate, glyceryl triacetate, diethyl phthalate or the like, and an auxiliary solvent such as ethyl acetate, cyclohexanone or the like, followed by mechanically forming the emulsified dispersion.

As solid fine particle dispersing method, there can be mentioned a method comprising dispersing the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). Preferably, an antiseptic (for instance, sodium benzoisothiazolinone salt) is added in the water dispersion.

Particularly, the reducing agent is preferably used as a solid particle dispersion, and the reducing agent is added in the form of fine particles having mean particle size from 0.01 μm to 10 μm, and more preferably, from 0.05 μm to 5 μm, and further preferably, from 0.1 μm to 1 μm.

(Development accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include, the same methods as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Preferred specific examples for the development accelerator of the invention are to be described below. The invention is not restricted to them.

A-1

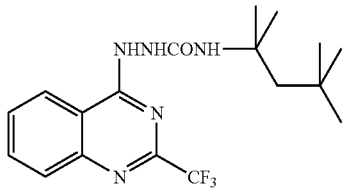

A-2

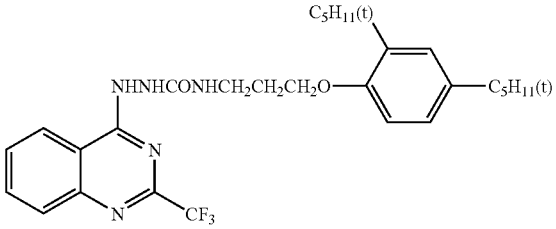

A-3

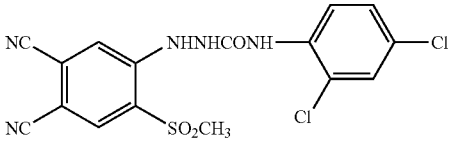

A-4

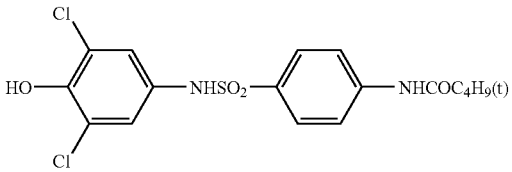

A-5

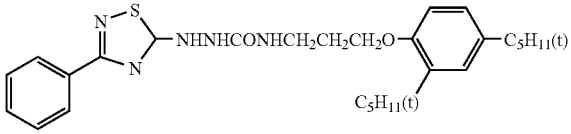

A-6

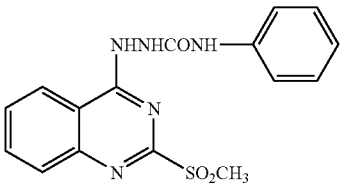

-continued

A-7

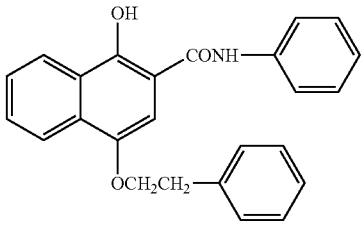

A-8

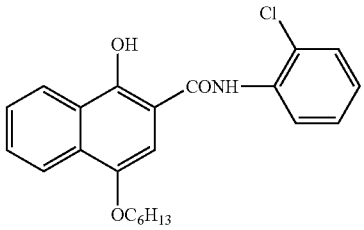

A-9

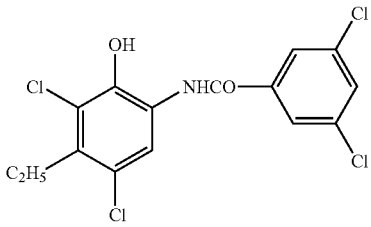

A-10

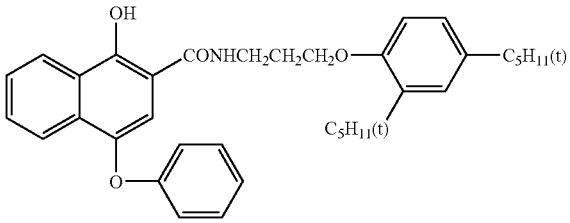

(Hydrogen Bonding Compound)

In the invention, in the case where the reducing agent has an aromatic hydroxy group (—OH) or an amino group, it is preferred to use in combination, a non-reducing compound having a group capable of reacting with these groups of the reducing agent, and that is also capable of forming a hydrogen bond therewith.

As a group forming a hydrogen bond, there can be mentioned a phosphoryl group, a sulfoxide group, a sulfonyl group, a carbonyl group, an amide group, an ester group, an urethane group, an ureido group, a tertiary amino group, a nitrogen-containing aromatic group, and the like. Preferred among them are a phosphoryl group, a sulfoxide group, an amide group (not having >N—H moiety but being blocked in the form of >N—Ra (where, Ra represents a substituent other than H)), an urethane group (not having >N—H moiety but being blocked in the form of >N—Ra (where, Ra represents a substituent other than H)), and an ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

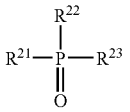

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

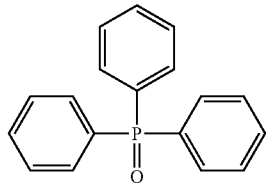

D-2

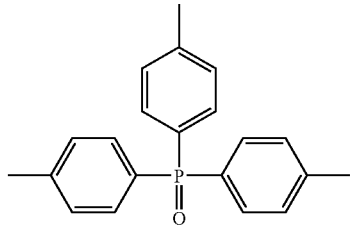

D-3

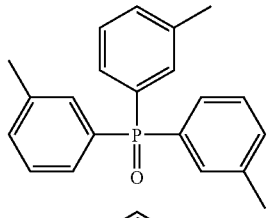

D-4

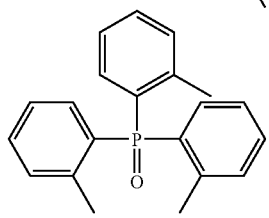

D-5

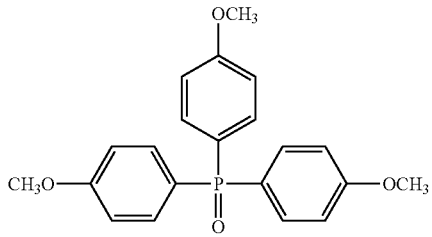

D-6

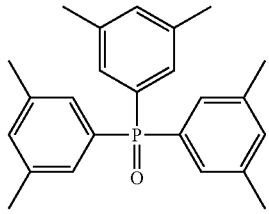

D-7

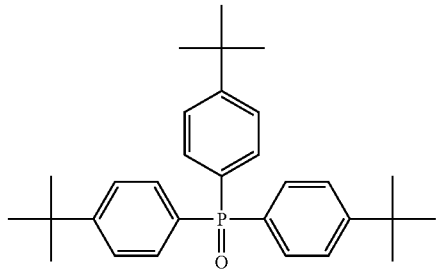

-continued

D-8

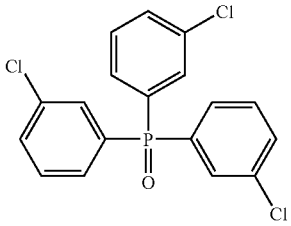

D-9

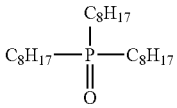

D-10

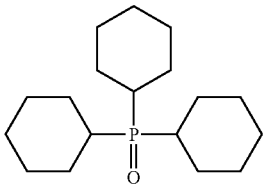

D-11

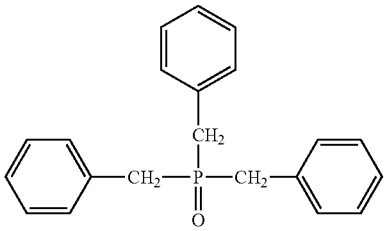

D-12

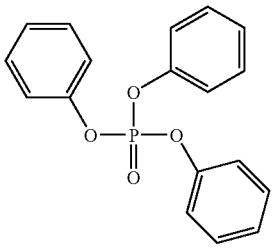

D-13

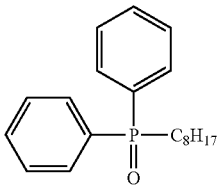

D-14

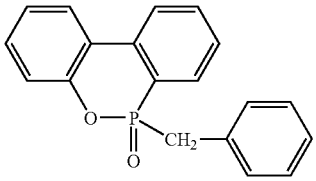

D-15

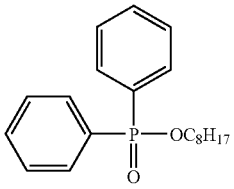

-continued

D-16

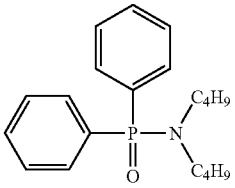

D-17

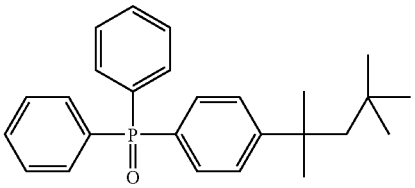

D-18

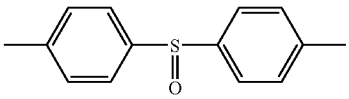

D-19

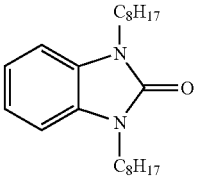

D-20

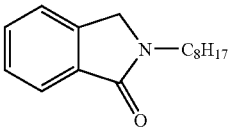

D-21

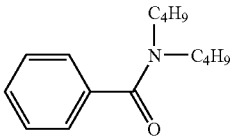

Specific examples of hydrogen bonding compounds other than those enumerated above can be found in those described in JP-A Nos. 2001-281793 and 2002-14438.

The hydrogen bonding compound of the invention can be used in the photothermographic material by being incorporated into the coating solution in the form of solution, emulsion dispersion, or solid fine particle dispersion similar to the case of the reducing agent. In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill and the like.

The hydrogen bonding compound of the invention is preferably used in the range from 1 mol % to 200 mol %, more preferably from 10 mol % to 150 mol %, and further preferably, from 30 mol % to 100 mol %, with respect to the reducing agent.

(Binder)

Photosensitive tabular silver halides, non-photosensitive silver sources which are capable of supplying reducible silver ions, reducing agents, toners and any other additives used for the present invention are held in the binder matrix and existed in the membrane. As for the binders, a hydrophilic polymer and an aqueous composition such as water dispersed latex (where at least 50% by weight, more preferably at least 70% by weight of the solution may consist of water) or polymers soluble in organic solvent, where the organic solvent is a major solvent, are generally used.

Examples of useful hydrophilic binders include, protein and the protein derivatives thereof, gelatin and gelatin-like derivatives (hardened or unhardened), alkali-treated gelatin, acid-treated gelatin, acetyl gelatin, oxidized gelatin, phthalated gelatin and deionized gelatin), cellulosic materials such as hydroxymethyl cellulose and cellulose ester, acrylamide/methacrylamide polymers, acrylic/methacrylic polymer, polyvinyl pyrrolidones, polyvinyl alcohols, polyvinyl lactams, polymer of sulfoalkyl acrylate or methacrylate, hydrolysised polyvinyl acetate, polysaccarides (for example, dextrans and starch ethers), and other synthetic or natural peptizer which is well known for aqueous-base photographic emulsion (for example, Research Disclosure, Item 38957), but the invention is not limited to these example. The cationic starches can be preferably used as a peptizer for the precipitation of tabular grain emulsion as described in U.S. Pat. No. 5,620,840 (Maskasky) and U.S. Pat. No. 5,667,955 (Maskasky).

Especially, examples of useful hydrophilic binders include gelatin, gelatin derivatives, polyvinyl alcohol, and cellulosic materials. Gelatin and derivatives thereof are most preferred and preferably present in at least 75% by weight of total binder when the mixtures of binders are used.

So long as the binder can be selected from hydrophilic polymers in an amount of 50% by weight or more of total binder, "minor" portions of hydrophobic binders may also be present. Examples of typical hydrophobic binders include, but are not limited to these examples, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Oligomers (including terpolymers) are also included in the definition of polymers. The polyvinyl acetals (such as polyvinyl butyral and polyviyl formal) and vinyl copolymers (such as polyvinyl acetate and polyvinyl chloride) are particularly preferred.

Examples of preferred binders are polyvinyl butyral resins that are available as BUTVAR B79 (trade mark, Solutia, Inc.) and PIOLOFORM BS-18, or PIOLOFORM BL-16 (trade mark, Wacker Chemical Company). Water dispersion of hydropobic binders (for example, latex) can also be used. For example, such latex binder is described in EP-A No. 0911691A1 (Ishizaka et al.).

Hardeners for various binders may be present, when necessary. Hydrophilic binders used in the photothermographic material can be hardened partially or completely by a conventional hardening agent. For example, useful hardeners are well known and include vinyl sulfone compounds and aldehydes, described for example in U.S. Pat. No. 6,143,487 (Philip et al.), and other various hardening agents are described in U.S. Pat. No. 6,190,822 (Dickerson et al.) and T. H. James, The THEORY OF THE PHOTOGRAPHIC PROCESS, Fourth Edition, published by Macmillan publishing Co., Inc. (1977), chapter 2, pages 77 to 78.

Where the photothermographic materials require a particular developing time and temperature, the binder should be able to withstand those conditions. Generally, it is preferred that the binder does not decompose or lose its structural integrity at 150° C. for 60 seconds. It is more preferred that it does not decompose or lose its structural integrity at 177° C. for 60 seconds.

The polymer binders of the present invention are used in an amount sufficient to carry the components dispersed therein. The effective range can be approximately determined by one skilled in the art. Preferably, a binder is used in an amount of about 10% by weight to 90% by weight with respet to the total dry weight of the layer in which it is included, and more preferably about 20% by weight to 70% by weight. In the case of double-sided coated photothermographic material, the amounts for both side of the binder may be either same or different.

(Antifoggant)

In order to control the characteristic of the ability of photothermographic material (e.g., gradation, Dmin, sensitivity and fog), it is also preferred to add one or more heteroaromatic ring mercapto compound or heteroaromatic ring disulfide compound represented by the formulae Ar—S-$M^1$ or Ar—S—S—Ar. Herein, $M^1$ represents a hydrogen atom or an alkali metal atom, and Ar represents a hetero aromatic ring or a heteroaromatic condensed ring containing at least one or more among a nitrogen atom, a sulfur atom, an oxygen atom, a selenium atom and a tellurium atom.

As a preferred heteroaromatic ring, benzimidazole, naphthoimidazole, benzothaizole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline or quinazoline and the like are described.

The heteroaromatic ring compound which functions as a super sensitizing agent, is also preferred. For example, the heteroaromatic ring mercapto compound is described in EP-A No. 559228 (Fillip Jr. et al.) as a super sensitizing agent for infrared photothermographic materials.

In the photothermographic material of the present invention, an antifoggant or a stabilizer can be used to prevent the generation of fog and to improve the deterioration in sensitivity at the storage. Mercury (II) salt can be also added to the image forming layer for these purposes. The preferred mercury (II) salts for these purposes are mercury acetate and mercury bromide. Another useful mercury salts are described in U.S. Pat. No. 2,728,663 (Allen).

As suitable antifoggant and stabilizer used by a combination of another method or alone, thiazolium salts described in U.S. Pat. No. 2,131,038 (Staud) and U.S. Pat. No. 2,694,716 (Allen), azaindenes described in U.S. Pat. No. 2,886,437 (Piper), triazaindolidines described in U.S. Pat. No. 2,444,605 (Heimbach), urazoles described in U.S. Pat. No. 3,287,135 (Anderson), sulfocatechols described in U.S. Pat. No. 3,235,652 (Kennard), oximes described in G.B. Patent No. 623448 (Carroll et al.), multivalent metal salts described in U.S. Pat. No. 2,839,405 (Johns), thiuronium salts described in U.S. Pat. No. 3,220,839 (Elts), palladium, platinum and gold salts described in U.S. Pat. No. 2,566,263 (Trirelli) and U.S. Pat. No. 2,597,915 (Damshroder), the compound having a —$SO_2CBr_3$ group described in U.S. Pat. No. 5,594,143 (Kirk et al.) and U.S. Pat. No. 5,374,514

(Cark et al.), 2-(tribromopmethylsulfonyl) quinoline compounds described in U.S. Pat. No. 5,460,938, and the like are described.

The stabilizer precursor, which can release a stabilizer according to the heat during thermal development, can be also used. Such precursor compounds are described in, for example, U.S. Pat. No. 5,158,866 (Simpson et al.), U.S. Pat. No. 5,175,081 (krepski et al.), U.S. Pat. No. 5,298,390 (Sakizadeh et al.) and U.S. Pat. No. 5,300,420 (Kenny et al.).

Further, it was proved that benzotriazoles having a substituted sulfonyl group (e.g., alkylsulfonylbenzotriazoles or arylsulfonylbenzotriazoles) were useful stabilizers (for example, improvement in stability after development) as described in U.S. Pat. No. 6,171,767 (Cong et al.).

Further, another useful antifoggants/stabilizers are described in U.S. Pat. No. 6,083,681 (Lynch et al.) in more detail.

The photothermographic material of the present invention may have a polyhalogen antifoggant containing one or more polyhalogen substituents having a dichloro group, a dibromo group, a trichloro group, a tribromo group, or the like. These antifoggants may be an aliphatic, alycyclic, or aromatic compound including a heterocycle or a carbocycle.

Especially useful of this type of antifoggant is a polyhalogen compound having a $—SO_2(X')_3$ group. Herein, X' represents a halogen atom, which is the same or different.

As another useful antifoggant, the compound represented by the following formula (I) and having the pKa of 8 or less can be described.

$$R^1—SO_2—C(R^2)R^3—(CO)_m\text{-}(L_1)_n\text{-}SG \qquad \text{Formula (I)}$$

wherein, $R^1$ represents an aliphatic group or a cyclic group. $R^2$ and $R^3$ each independently represent one selected from a hydrogen atom and a bromine atom, at least one of them is bromine. $L_1$ represents a divalent aliphatic linking group, m and n each independently represent 0 or 1, and SG represents a soluble group having the pKa of 8 or less.

As preferred embodiment of formula (I):

Both of m and n are 0, SG is one selcted from a carboxyl group (or a salt thereof), a sulfo group (or a salt thereof), a phospho group (or a salt thereof), $(—SO_2N^-COR^4)(M^2)^+$, and $(—N^-SO_2R^4)(M^2)^+$.

m is 1 and n is O, and SG is one selected from a carboxyl group (or a salt thereof), a sulfo group (or a salt thereof), a phospho group (or salt thereof), and $(—N^-SO_2R^4)(M^2)^+$.

Both of m and n are 1, SG is one selected from a carboxyl group (or a salt thereof), a sulfo group (or a salt thereof), a phospho group (or a salt thereof), and $(—SO_2N^-COR^4)(M^2)^+$. Herein, $R^1$ is an aliphatic group or a cyclic group and $(M^2)^+$ is an anion other than a proton.

(Other Additive)

1)Toner

Toner is a compound, which improves color tone of a developed silver image and increases optical density.

In a black and white photothermpgraphic material, especially useful toner is the compound, which attributes to form the image having pure black tone.

Therefore, it is desirable to use a toner or a derivative thereof in the present invention.

Toner is well known in the technology of photothermographic material and described in U.S. Pat. No. 3,080,254 (Grant Jr. et al.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willemsz et al.), U.S. Pat. No. 3,951,660 (Hageman et al.), U.S. Pat. No. 5,599,647 (Defieuw et al.), U.S. Pat. No. 4,220,709 (Demauriack et al.), U.S. Pat. No. 4,451,561 (Hirabayashi et al.), U.S. Pat. No. 4,543,309 (Hirabayashi et al.), U.S. Pat. No. 3,832,186 (Masuda et al.), U.S. Pat. No. 4,201,582 (Haku et al.), and U.S. Pat. No. 3,881,938 (Masuda et al.), and G.B. Patent 1439478 (Agfa).

Special examples are described in the following, however, are not limited in these.

Phthalimide, N-hydroxyphthalimide, cyclic imide (e.g., succinimide), pyrazoline-5-one, quinazoline, 1-phenylurazole, 3-phenyl-2-pyrazoline-5-one, 2,4-thiazolidinedione, naphthalimide (e.g., N-hydroxy-1,8-naphthalimide), cobalt complex (e.g., hexaminocobalt (3+)trifluoroacetate), mercaptan (e.g., mercaptotriazoles including 3-mercapto-1,2,4-triazole, 3-mercapto-4-phenyl-1,2,4-triazole, 4-phenyl-1,2,4-triazolidine-3,5-dithione, 4-allyl-3-amine-5-mercapto-1,2,4-triazole, 4-methyl-5-thioxo-1,2,4-triazolidine-3-one and the like, pyrimides including 2,4-dimercaptopyrimidine, thiadiazoles including 2,5-dimercapto-1,3,4-thiadiazole and 5-methyl-1,3,4-thiadiazolyl-2-thiol, mercaptotetrazoles including 1-phenyl-5-mercaptotetrazole, and 5-acetylamino-1,3,4-thiadiazoline-2-thione, mercaptoimidazoles including 1,3-dihydro-1-phenyl-2H-imidazole-2-thione), N-(aminomethyl)allyldicarboxyimides [e.g., (N,N-dimethylaminomethyl)phthalimide, and N-(dimethylaminomethyl) naphthalene-2,3-dicarboxyimide], blocked pyrazole, isothiuronium derivatives and special photographic bleaching agent [(e.g., N,N'-hexamethylene-bis-(1-carbamoyl-3,5-dimethylpyrazole), 1,8-(3,6-diazaoctane)bis(isothiuronium) trifluoroacetate, and 2-(tribromomethylsulfonyl)benzothiazole)], merocyanine dye {e.g., 3-ethyl-5-[(3-ethyl-2-benzothiazolinylidene)-1-methylethylidene]-2-thio-2,4-o-azolidinedione}, phthalazine and derivatives thereof [e.g., described in U.S. Pat. No. 6,146,822 (Asanuma et al.)], phtahalazinone and derivatives thereof or a metal salt of the derivative [e.g., 4-(1-naphthyl)phthalazinone, 6-chlorophthalazinone, 5,7-dimethoxyphthalazinone and 2,3-dihydro-1,4-phthalazinedione], a combination of phthalazine (or a derivative thereof) and one or more phthalic acid derivatives (e.g., phthalic acid, 4-methylphthalic acid, 4-nitrophthalic acid or tetrachlorophthalic anhydride), quinazolinediones, benzoxazines or naphthoxazine derivatives, rhodium complex which has not only the function of toner but also is the halogen source to form a silver halide in-situ [e.g., 6 chlororhodium (III) ammonium, rhodium bromide, rhodium nitrate and 6 chlororhodium (III) potassium], benzoxazine-2,4-diones (e.g., 1,3-benzoxazine-2,4-dione, 8-methyl-1,3-benzoxazine-2,4-dione, and 6-nitro-1,3-benzoxazine-2,4-dione), pyrimidines and asym-triazines (e.g., 2,4-dihydroxypyrimidine, 2-hydroxy-4-aminopyrimidine, and azauracil) and tetrazapentalene derivatives [e.g., 3,6-dimercapto-1,4-diphenyl-1H, 4H-2,3a, 5,6a-tetrazapentalene and 1,4-di(o-chlorophenyl)-3,6-dimercapto-1H, 4H-2,3a,5,6a-tetrazapentalene].

In the case where silver carboxylate is used as the non-photosensitive silver source which is capable of supplying reducible silver ions and a hindered phenol is used as a reducing agent, phthalazine and derivatives thereof (described in U.S. Pat. No. 6,146,822) are especially useful as a toner. Phthalazine and the derivatives thereof can be used in any layer of any side of a support in a photothermographic material.

In the case where a silver salt of nitrogen-containing heterocyclic compound including an imino group is used as a non-photosensitive silver source which is capable of supplying reducible silver ions, and ascorbic acid, an ascorbic acid complex or an ascorbic acid derivative is used as a reducing agent, the mercapto compound represented by formula (II) is a especially useful toner of the present invention.

Formula (II)

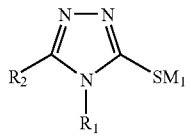

In formula (II), $R_1$ and $R_2$ each independently represent one selected from a hydrogen atom, a substituted or unsubstituted alkyl group having 1 to 7 carbon atoms (e.g., a methyl group, an ethyl group, an isopropyl group, a t-butyl group, a n-hexyl group, a hydroxymethyl group and a benzyl group), a substituted or unsubstituted alkenyl group having 2 to 5 carbon atoms as a hydrocarbon chain (e.g., an ethynyl group, a 1,2-propenyl group, a methallyl group and a 3-butene-1-yl group), a substituted or non-substituted 5 to 7 membered cycloalkyl group (e.g., a cyclopentyl group, a cyclohexyl group and a 2,3-dimethylcyclohexyl group), a substituted or unsubstituted 5 to 6 membered heteroaromatic ring or non-aromatic hetero ring having at least one hetero atom among a nitrogen atom, an oxygen atom and a sulfur atom (e.g., a pyridyl group, a furanyl group, a thiazolyl group and a thienyl group), an amino group or an amide group (e.g., an amino group or an acetamide group) and a substituted or unsubstituted 6 to 10 membered aryl group (e.g., a phenyl group, a toluyl group, a naphthyl group and a 4-ethoxyphenyl group).

Further, $R_1$ and $R_2$ are a substituted or unsubstituted $Y_1$—$(CH_2)_k$—, herein, $Y_1$ is a substituted or unsubstituted aryl group having 6 to 10 carbon atoms defined by $R_1$ and $R_2$ described above or a substituted or unsubstituted, aromatic or non-aromatic heterocyclic group defined by $R_1$ and k is an integer from 1 to 3.

Or, $R_1$ and $R_2$ are a substituted or unsubstituted 5 to 7 membered aromatic or non-aromatic heterocycle by linking each other including a carbon atom, a nitrogen atom, an oxygen atom or a sulfur atom (e.g., a pyridyl group, a diazinyl group, a triazinyl group, a piperidino group, a morpholino group, a pyrrolidino group, a pyrazolidino group and a thiomorpholino group).

And $R_1$ and $R_2$ may be the group having a divalent linking group (e.g., a phenylene group, a methylene group and an ethylene group) which link with two mercaptotriazole groups and further $R_2$ may be a carboxy group and a salt thereof.

$M_1$ is a hydrogen atom or monovalent anion (e.g., an alkali metal anion, an ammonium ion or a pyridinium ion).

The mercaptotriazole of formula (II) is preferred to fulfill the following conditions.

(1) $R_1$ and $R_2$ are not hydrogen atoms simultaneously.

(2) When $R_1$ is a substituted or unsubstituted phenyl group or benzyl group, $R_2$ is not a substituted or unsubstituted phenyl group or benzyl group.

(3) When $R_2$ is a hydrogen atom, $R_1$ is not an allenyl-2, 2-diphenylethyl group having a cyano group or a sulfonic acid group, a α-methylbenzyl group or a phenyl group.

(4) When $R_1$ is a benzyl group or a phenyl group, $R_2$ is not a substituted 1,2-dihydroxyethyl group or 2-hydroxy-2-propyl group.

(5) When $R_1$ is a hydrogen atom, $R_2$ is not a 3-phenylthiopropyl group.

Furthermore, one of preferred embodiment is the following photothermographic material.

(6) The surface pH of the surface having at least one image forming layer is 7 or less.

$R_1$ is preferably one selected from a methyl group, a t-butyl group, a substituted or unsubstituted phenyl group, and a benzyl group. And $R_1$ more preferably is a benzyl group. And $R_1$ is the group having a divalent linking group (e.g., a phenylene group, a methylene group and an ethylene group) which link two mercaptotriazole groups.

$R_2$ is preferably a hydrogen atom, an acetamide group or a hydroxymethyl group. And $R_2$ more preferably is a hydrogen atom. And $R_2$ is the group having a divalent linking group (e.g., a phenylene group, a methylene group and an ethylene group) which link two mercaptotriazole groups.

The surface pH of the surface having at least one image forming layer is 7 or less as like as described above. More preferably it is less than 6. The pH of these layers may be controlled to acidic by adding an ascorbic acid as a developing agent. Or the pH may be controlled by adjusting the pH of a silver salt dispersion before coating by addition of a mineral acid, for example sulfuric acid or nitric acid, or an organic acid, for example citric acid. This pH value can be determined by using surface pH electrode after dropping one drop of $KNO_3$ solution on the sample surface. Such electrode can be obtained from Corning Co., Ltd. (Corning (N.Y.)).

Many of toners described here are heterocyclic compounds. It is known well that a tautomer exists in a heterocyclic compound. Furthermore, a cyclic tautomer and a substituent tautomer are also possible. For example, it is possible that in 1,2,4-mercaptotetrazole as preferable toner, at least 3 tautomers (1H-type, 2H-type and 4H-type) exist.

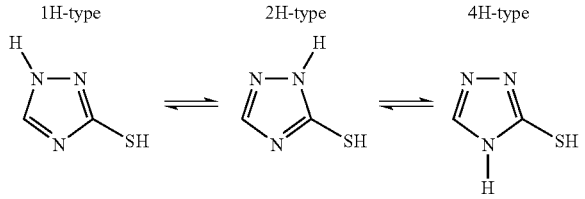

Furthermore, 1,2,4-mercaptotriazole can form thiol-thione substituent tautomer.

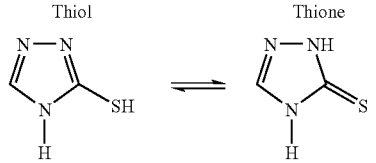

The mutual conversion of these tautomers can be occurred rapidly. And one tautomer may be dominant although each tautomer can not be separated.

In the present invention, 1,2,4-mercaptotriazole is described as a 4H-thiol structure, however it is used on the assumption that such tautomers exist.

In the case where silver salt of benzotriazole is used as a non-photosensitive silver source which is capable of supplying reducible silver ions and ascorbic acid is used as a reducing agent, the mercaptotriazole compound represented by formula (II) is especially useful. A black image having high image density can be obtained by using the compound represented by formula (II).

Representative examples T-1 to T-59 of the compound represented by formula (II), which are preferably used in the present invention, are shown below.

T-1

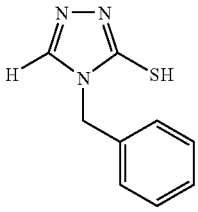

T-2

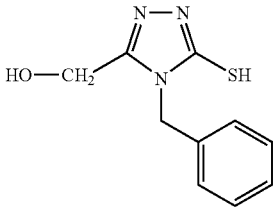

T-3

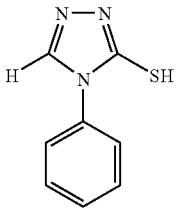

T-4

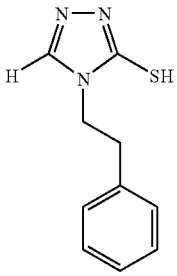

T-5

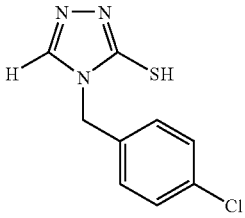

-continued

T-6

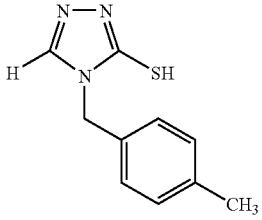

T-7

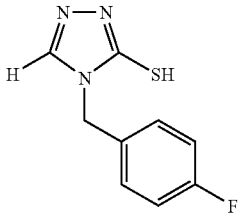

T-8

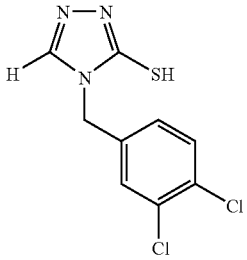

T-9

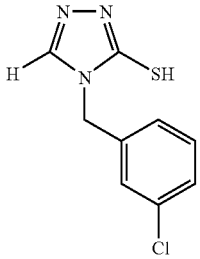

T-10

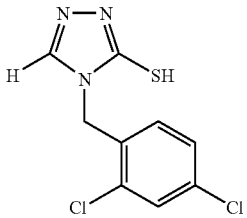

T-11

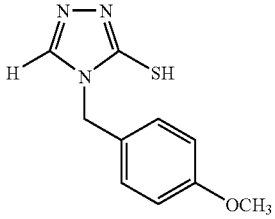

-continued
T-12
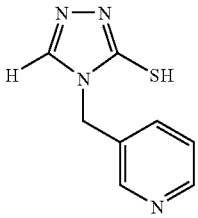
T-13
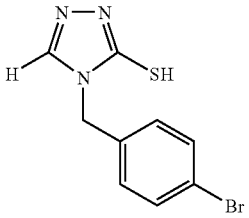
T-14
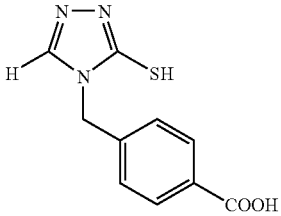
T-15
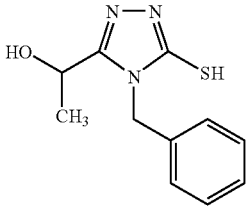
T-16
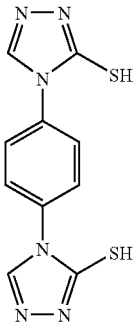
T-17
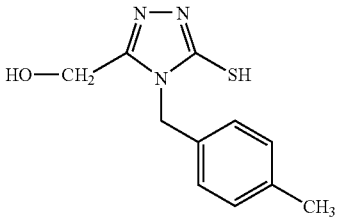
-continued
T-18
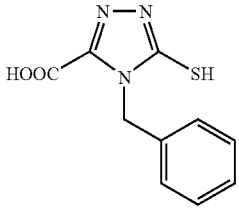
T-19
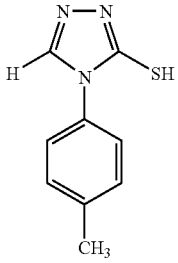
T-20
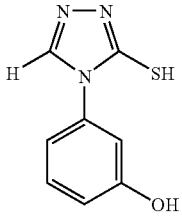
T-21
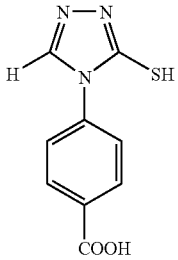
T-22
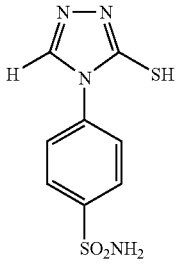
T-23
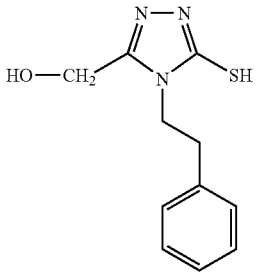

-continued
T-24
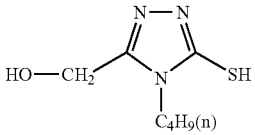
T-25
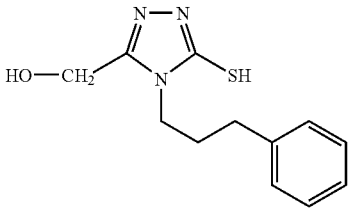
T-26
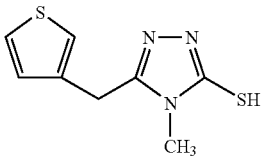
T-27
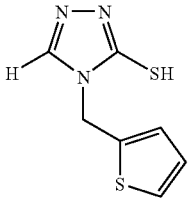
T-28
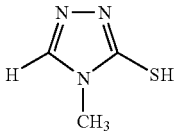
T-29
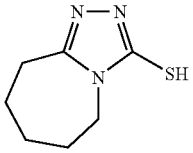
T-30
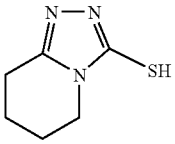
T-31
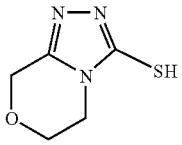
-continued
T-32
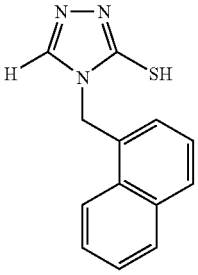
T-33
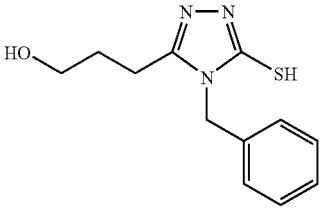
T-34
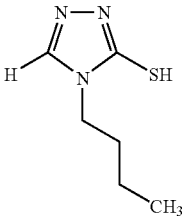
T-35
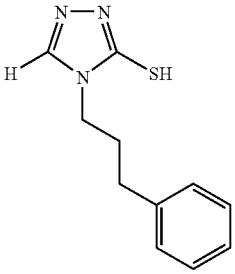
T-36
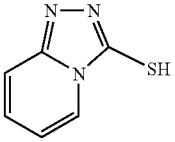
T-37
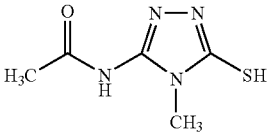
T-38
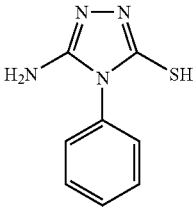

-continued
T-39
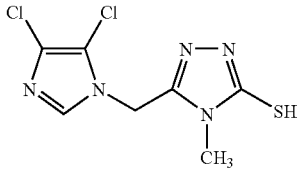
T-40
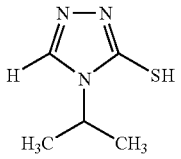
T-41
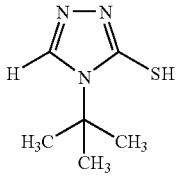
T-42
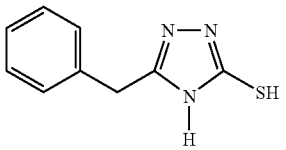
T-43
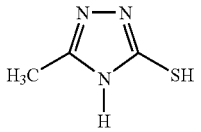
T-44
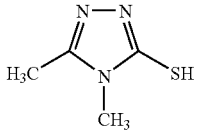
T-45
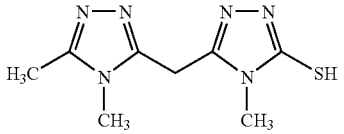
T-46
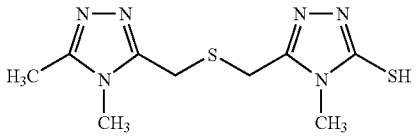
T-47
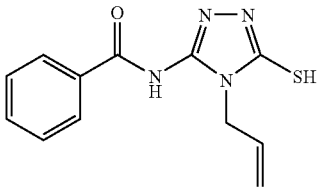
-continued
T-48
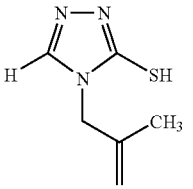
T-49
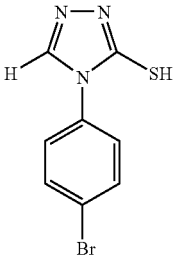
T-50
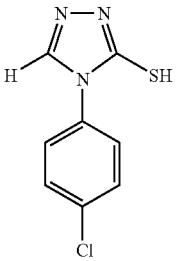
T-51
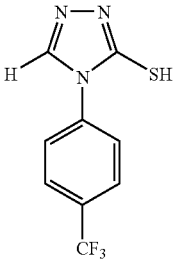
T-52
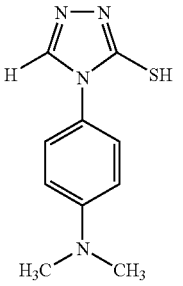
T-53
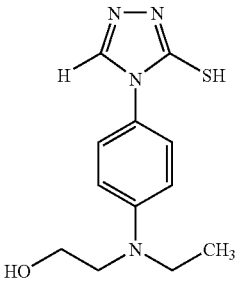

-continued

T-54

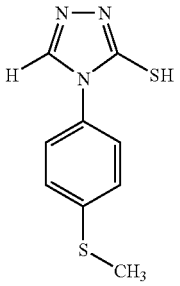

T-55

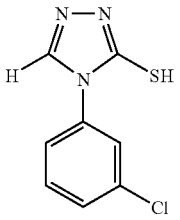

T-56

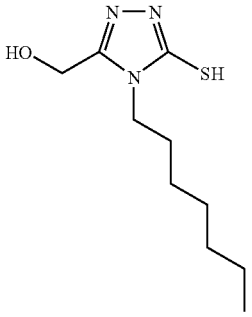

T-57

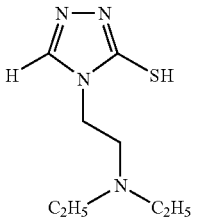

T-58

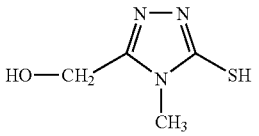

T-59

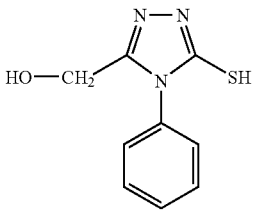

In the present invention, compound Nos. T-1, T-2, T-3, T-11, T-12, T-16, T-37, T-41 and T-44 are more preferred, and compound Nos. T-1, T-2 and T-3 are especially preferred.

The mercaptotriazole toner can be easily prepared by the well-known synthetic method. For example, compound No. T-1 can be prepared according to the description in U.S. Pat. No. 4,628,059 (Finkelstein et al.). The synthetic methods of various mercaptotriazoles are described in U.S. Pat. No. 3,769,411 (Greenfield et al.), U.S. Pat. No. 4,183,925 (Baxter et al.), U.S. Pat. No. 6,074,813 (Asanuma et al.), DE Patent No. 1670604 (Korosi) and Chemical Abstract 1968, 69,52114j. Some mercaptotriazoles are commercially available.

As well known in the art, two or more of the mercaptotriazole compounds represented by formula (II) may be used if needed and plural toners can exist in a same layer or different layer of photothermographic material.

Furthermore, conventional toner can be additionally included with one or more mercaptotriazoles described above. Those compounds are well-known compounds in the technology of photothermographic material as described in U.S. Pat. No. 3,080,254 (Grant Jr. et al.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willemsz et al.), U.S. Pat. No. 3,951,660 (Hageman et al.), U.S. Pat. No. 5,599,647 (Defieuw et al.) and G.B. Patent No. 1439478 (Agfa).

As preferred examples of mercaptotriazole and additional toner, 3-mercapto-4-benzyl-1,2,4-triazole and phthalazine are described.

Generally, the addition amount of one ore more toners preferably is in the range from about 0.01% by weight to 10% by weight with respect to the total dry weight of the layer containing those toners, and more preferably about from 0.1% by weight to 10% by weight.

The toner may be contained in a layer adjacent to the image forming layer as well as the image forming layer, for example in a surface protective layer or a lower carrier layer. If an image forming layer exists in the both sides of a support, a toner can also be contained in both sides of a support.

2) Plasticizer and Lubricant

In the invention, well known plasticizer and lubricant can be used to improve physical properties of film. Particularly, to improve handling facility during manufacturing process or scratch resistance during thermal development, it is preferred to use a lubricant such as a liquid paraffin, a long chain fatty acid, an amide of fatty acid, an ester of fatty acid and the like. Paticularly preferred are a liquid paraffin obtained by removing components having low boiling point and a fatty acid ester having a branch structure and a molecular weight of 1000 or more.

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

3) Dyes and Pigments

From the viewpoint of improving image tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) may be used in the image forming layer of the invention. Detailed description can be found in WO No. 98/36322, JP-A Nos. 10-268465 and 11-338098, and the like.

4) Nucleation Accelerator

In the case where a nucleator is used in the invention, a nucleation accelerator can be used in combination. Concerning a nucleation accelerator, description can be found in paragraph No. 0102 of JP-A No. 11-65021, and in paragraph Nos. 0194 to 0195 of JP-A No. 11-223898.

As a nucleation accelerator, it is preferred to use an acid resulting from hydration of diphosphorus pentaoxide, or its salt. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or a salt thereof (i.e., the coating amount per 1 $m^2$ of the photothermographic material) may be set as desired depending on sensitivity and fog, but preferred is in an amount of 0.1 $mg/m^2$ to 500 $mg/m^2$, and more preferably, 0.5 $mg/m^2$ to 100 $mg/m^2$.

2. Layer Constitution and Other Constituents

The black and white photothermographic material of the present invention may be either "single-sided type" having an image forming layer on one side of the support, or "double-sided type" having image forming layers on both sides of the support.

(Double-Sided Type Photothermographic Material)

The black and white photothermographic material of the present invention is preferably applied for an image forming method to record radiation images using a fluorescent intensifying screen.

For the image forming method, the photothermographic material can be preferably employed as described below: where the photothermographic material is exposed with a monochromatic light having the same wavelength as the main emission peak wavelength of the fluorescent intensifying screen and having a half band width of 15±5 nm, and after a thermal developing process, an exposure value required for a density of fog+0.5 for an image obtained by removing the image forming layer that is disposed on the opposite side of an exposure face is 0.005 Lux·sec to 0.07 Lux·sec.

The image forming method using the black and white photothermographic materials described above comprises the steps of:

(a) providing an assembly for forming an image by placing the black and white photothermographic material between a pair of fluorescent intensifying screens, (b) putting an analyte between the assembly and an X-ray source, (c) applying imagewise exposure to the analyte using X-rays having an energy level in a range of 25 kVp to 125 kvp, (d) taking the black and white photothermographic material out of the assembly, and (e) thermally developing the thus taken out black and white photothermographic material in a temperature range of 90° C. to 180° C.

The photothermographic material used for the assembly in the present invention is subjected to X-ray exposure through a step wedge tablet and thermal development. On the photographic characteristic curve having an optical density (D) and an exposure amount (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0.

For the X-ray radiography employed in the practice of the present invention, the use of photothermographic material having the aforesaid photographic characteristic curve would give the radiation images with excellent photographic properties that exhibit an extended bottom portion and high gamma value at middle density area. According to this photogaraphic property, the photographic properties mentioned has the advantage of that the depiction in low density portion on the mediastinal region and the heart shadow region having little X-ray transmittance becomes excellent, and that the density becomes pleasing to the eye, and that the contrast in the images on the lung field region having much X-ray transmittance becomes excellent.

The photothermographic material having the preferred photographic characteristic curve mentioned above can be easily prepared, for example, by the method where each of the image forming layer of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high contrast for the lower layer.

In the case of preparing the image forming layer comprising two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power.

Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in the range from 1:20 to 1:50 based on silver amount.

The techniques such as an emulsion sensitizing method, kinds of additives and constituents employed in the production of the photothermographic material of the present invention are not particularly limited. For example, various kinds of techniques described in JP-A Nos. 2-68539, 2-103037 and 2-115837 can be applied.

As the techniques for crossover cut (in the case of double-sided coated photosensitive material) and anti-halation (in the case of single-sided coated photosensitive material), dyes or combined use of dye and mordant described in JP-A. No. 2-68539, (from page 13, left lower column, line 1 to page 14, left lower column, line 9) can be employed.

Next the fluorescent intensifying screen employed in the practice of the present invention is explained below. The radiographic intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below. Tungstate fluorescent substances ($CaWO_4$, $MgWO_4$, $CaWO_4$:Pb and the like), terbium activated rare earth sulfoxide fluorescent substances [$Y_2O_2S$:Tb, $Gd_2O_2S$:Tb, $La_2O_2S$:Tb, $(Y,Gd)_2O_2S$:Tb, $(Y,Gd)O_2S$:Tb, Tm and the like], terbium activated rare earth phosphate fluorescent substances ($YPO_4$:Tb, $GdPO_4$: Tb, $LaPO_4$:Tb and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb and the like), thulium activated rare earth oxyhalogen fluorescent substances (LaOBr:Tm, LaOCl:Tm and the like), barium sulfate fluorescent substances [$BaSO_4$:Pb, $BaSO_4$:$Eu^{2+}$, (Ba, Sr)$SO_4$:$Eu^{2+}$ and the like], divalent europium activated alkali earth metal phosphate fluorescent substances [$(Ba_2PO_4)^2$:$Eu^{2+}$, $(Ba_2PO_4)_2$:$Eu^{2+}$, and the like], divalent europium activated alkali earth metal fluorinated halogenide fluorescent substances [BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, (Ba,Mg)$F_2$.BaCl.KCl:$Eu^{2+}$, and the like], iodide fluorescent substances (CsI:Na, CsI:Tl, NaI, KI:Tl and the like), sulfide fluorescent substances [ZnS:Ag(Zn,Cd)S:Ag, (Zn,Cd)S:Cu, (Zn,Cd)S:Cu, Al and the like], hafnium phosphate fluorescent substances ($HfP_2O_7$:Cu and the like).

However, the fluorescent substance used in the present invention is not particularly limited to these specific examples, so long as to emit light in visible or near ultraviolet region by exposure to X-ray.

In the fluorescent intensifying screen used in the present invention, the fluorescent substances are preferably packed in the grain size graded structure. Especially, fluorescent substance particles having a large particle size is preferably coated at the side of the surface protective layer and fluorescent substance particles having a small particle size is preferably coated at the side of the the support. Hereto, the small particle size of fluorescent substance is preferably in the range from 0.5 μm to 2.0 μm and the large size is preferably in the range from 10 μm to 30 μm.

(Single-Sided Type Photothermographic Material)

The single-sided type photothermographic material of the present invention is favorably applied for an X-ray photosensitive material used for mammography.

To use the single-sided type photothermographic material for that purpose, it is very important to design the contrast of the obtained image in the suitable range.

The method to draw the photographic characteristic curve of the photothermographic material of the present invention is explained below. As for mammography, molybdenum target tube, which emits a low pressure X-ray, is usually employed as beam source. However, as far as the intensifying screen comprising substantially the fluorescent substance comprising $Gd_2O_2S$:Tb is used, the photographic characteristic curve obtained by changing the X-ray exposure value by the method of distance using the X-ray beam emitted by tungsten target tube as the beam source, may give substantially the same result obtained above.

Specifically for the measurement employed in the present invention, X-ray emitted from tungsten target tube operated by three-phase electric power supply at 50 KVp and penetrated through an aluminum plate having a thickness of 3 mm is used. The commercially availabe UM-Fine screen and the photosensitive material to be measured are made contact and installed in ECMA cassette produced by Fuji Photo Film Co., Ltd. After arranging so that the top plate of cassette, the photothermographic material and the screen may be set, from X-ray tube, in turn, X-ray irradiation is performed. By changing the X-ray exposure value by the method of distance, the assembly is subjected to exposure with a step wedge tablet having a width of 0.15 in terms of log E.

The exposed photothermographic material is thermally developed under the determined condition. Thereafter, density is measured, and then the photographic characteristic curve is obtained where the logarithm of radiation exposure value is plotted on abscissa axis, and the optical density is plotted on ordinate axis. The contrast is determined from the gradient (tan θ, when the angle to the abscissa axis is θ) of the straight line connecting the points at a density of fog+0.25 and a density of fog+2.0.

Next, the measuring method of the sensitivity of the photosensitive material is explained. As for the light source, a monochromatic light having the same wavelength as a main emission peak wavelength of the fluorescent intensifying screen is employed. As a means of obtaining such a required monochromic light, a method using the filter system where interference filters are combined can be used. According to the aforesaid method, usually the monochromic light having a required exposure value and a half band width of 15±5 nm can be obtained easily, although it depends also on the combination of interference filters used.

The monochromic light whose intensity is correctly measured by an illuminometer in advance is employed as the light source. Thereby the photothermographic material is subjected to exposure with a step wedge tablet through a neutral filter for one second, where the photothermographic material and the light source are one meter apart. The density is measured after a thermal developing process, the sensitivity can be obtained by determining the exposure value required to give a density of fog+0.5 and can be expressed by Lux·second.

Preferred sensitivity of the photothermographic material used for mammography according to the invention is 0.01 Lux·sec to 0.07 Lux·sec. Preferred contrast for the photothermographic material used for mammography according to the present invention is from 3.0 to 5.0.

The fluorescent intensifying screen for mammography used in the invention is explained in detail below. The fluorescent intensifying screen used for photographic assembly of mammography used in the present invention is required to have high image sharpness in comparison with the conventional chest diagnosis. Generally, the image sharpness of commercially available fluorescent intensifying screen used for mammography is usually enhanced by coloring the fluorescent substance layer. However, the light emitted by X-ray beam absorbed in the inner side of the fluorescent substance to the X-ray irradiation plane cannot effectively be taken out from the colored screen. For the fluorescent intensifying screen according to the present invention, it is required to provide the intensifying screen coated with the amount of fluorescent substances enough to absorb X-ray and having high image sharpness without coloring the fluorescent substance layer substantially.

In order to attain the object of the aforesaid screen, the particle size of fluorescent substances preferably may be below a fixed size. The measurement of the particle size is performed by Coulter counter or observation through electron microscope. As for the preferred particle size of the fluorescent substance, the mean equivalent spherical diameter of the fluorescent substance particles is preferably in the range from 1 μm to 5 μm, and more preferably from 1 μm to 4 μm. Although the above condition is not important to the conventional intensifying screen for mammography whose fluorescent substance layer is colored, it is very important to the present invention.

Moreover, in order to raise the sharpness of the screen mentioned above, the use of fewer binders is preferred in regard to the weight ratio of binder to fluorescent substance in the fluorescent substance layer. The weight ratio of binder/fluorescent substance is preferably from 1/50 to 1/20, and more preferably from 1/50 to 1/25.

As for the binder, known substances described in JP-A No. 6-75097, from line 45 on right column at page 4 to line 10 on left column at page 5, can be employed. The thermoplastic elastomer having a softening temperature or a melting temperature of 30° C. to 150° C. can be preferably used alone or in combination with the other binder polymer. Especially for the screen of the present invention, which contains very small amount of binder to enhance the image sharpness, the proper selection of the binder used is very important to resist to the defect, because of the poor durability of the screen. It is desirable to choose entirely flexible binders as the solution for the defect. And also plasticizers and the like are preferably added in the fluorescent substance layer. As specific examples as the thermoplastic elastomer, polystyrenes, polyolefines, polyurethanes, polyesters, polyamides, polybutadienes, ethylene vinyl acetates, natural rubbers, fluorinated rubbers, polyisoprenes, ethylene chlorides, styrene-butadiene rubbers, silicone rubbers, and the like can be described. Among them, polyurethanes are particularly preferred. Moreover, the selection of the binder for the undercoat of the fluorescent substance layer is very important. Acrylate type binders are preferably employed.

To the allowable limit in respect to the anti-scratch and anti-stain properties of the screen, the thickness of the surface protective layer is preferably thin. The preferred thickness of the surface protective layer is in the range of from 2 μm to 7 μm.

As the materials for the surface protective layer of the screen, films such as PET (especially, stretched type), PEN, nylon and the like can be preferably stuck thereon. The surface protective layer of the screen is preferably formed by coating the fluorinated resins dissolved in a suitable solvent from the standpoint of preventing stain. The preferred embodiments of the fluorinated resins are described in detail in JP-A No. 6-75097, line 4 on left column at page 6 to line 43 on right column at the same page. As for specific examples of the resin suited for solvent coating type to form the surface protective layer, polyurethane resins, polyacrylate resins, cellulose derivatives, polymethyl methacrylates, polyester resins, epoxy resins and the like can be mentioned beside of the fluorinated resins described above.

Moreover, it is important that filling factor of the fluorescent substances is sufficiently high to obtain a screen with high image sharpness and high sensitivity. Specifically, the volume filling factor of the fluorescent substance is preferably from 60% to 80%, and more preferably from 65% to 80%. In order to keep the volume filling factor of fine particles of the fluorescent substances high as in the present invention, the compression processes of fluorescent substance layer described in JP-A No. 6-75097, line 29 on right column at page 4- to line 1 on left column at page 6, are preferably applied.

The fluorescent substance used in the present invention preferably comprises substantially $Gd_2O_2S$:Tb. The term "substantially" described here means that main component of the fluorescent substance is $Gd_2O_2S$:Tb, and several % of any other additives to improve the property of the screen, and silica and the like to decorate the surface can preferably be included. And also, in place of Gd, Y, La, and Lu can be possibly mixed inside the ratio of several ten %.

Generally, fluorescent substance having a heavy density is preferred to absorb X-ray effectively. As such fluorescent substance that shows a desirable X-ray absorption ability in beam source used for mammography, $YTaO_4$ and the one adding various kinds of activator as the emission center thereto, $CaWO_4$, BaFBr:Eu and the like are mentioned besides $Gd_2O_2S$:Tb.

(Combined Use with Ultraviolet Fluorescent Intensifying Screen)

As for the image forming method using photothermographic material according to the present invention, it is preferred that the image forming method is perfomed in combination with a fluorescent substance having a main emittion peak at 400 nm or lower. And more preferably, the image forming method is performed in combination with a fluorescent substance having a main emittion peak at 380 nm or lower. Either single-sided coated photosensitive material or double-sided coated photosensitive material can be applied for the assembly. As the screen having a main emittion peak at 400 nm or lower, the screens described in JP-A No. 6-11804 and WO No. 93/01521 and the like are used, but the present invention is not limited to these. As the techniques of crossover cut (for double-sided coated photosensitive material) and anti-halation (for single-sided coated photosensitive material) of ultraviolet light, the technique described in JP-A No. 8-76307 can be applied. As ultraviolet absorbing dyes, the dye described in JP-A No. 2001-144030 is particularly preferred.

(Layer Constitution and Constituents)

The photothermographic material according to the invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021, and in JP-A No. 2001-348546.

Preferred as the binder for the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.).

The coating amount of polyvinyl alcohol (per 1 $m^2$ of support) in the protective layer (per one layer) is preferably in the range from 0.3 $g/m^2$ to 4.0 $g/m^2$, and more preferably, from 0.3 $g/m^2$ to 2.0 $g/m^2$.

The coating amount of the whole binder (including water-soluble polymer and latex polymer) in the surface protective layer (per one layer) is preferably 0.3 $g/m^2$ to 5.0 $g/m^2$, more preferably, 0.3 $g/m^2$ to 2.0 $g/m^2$ per 1 $m^2$ of a support.

2) Antihalation Layer

The photothermographic material of the present invention may comprise an antihalation layer provided to the side farther from the light source with respect to the image forming layer. Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for decoloring by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the bleaching dye is determined depending on the usage of the dye. In general, it is used at an amount as such that the optical density (absorbance) exceeds 0.1 when measured at the desired wavelength. The optical density is preferably in the range from 0.2 to 2. The addition amount of dyes to obtain optical density in the above range is generally from about 0.001 $g/m^2$ to 1 $g/m^2$.

By decoloring the dye in such a manner, the optical density after thermal development can be lowered to 0.1 or lower. Two or more kinds of bleaching dyes may be used in combination in a photothermographic material. Similarly, two or more kinds of base precursors may be used in combination.

In the case of thermal decolorization by the combined use of a bleaching dye and a base precursor, it is advantageous from the viewpoint of thermal decolorization efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm may be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like. Such coloring matters are generally added in the range from 0.1 $mg/m^2$ to 1 $g/m^2$, preferably to the back layer which is provided to the surface side opposite to the image forming layer.

4) Matting Agent

A matting agent may be preferably added to the surface protective layer and to the back layer in order to improve transportability. Description on the matting agent can be found in paragraphs Nos. 0126 to 0127 of JP-A No.11-65021.

The amount of adding the matting agents is preferably in the range from 1 $mg/m^2$ to 400 $mg/m^2$, and more preferably, from 5 $mg/m^2$ to 300 $mg/m^2$, with respect to the coating amount per 1 $m^2$ of the photothermographic material.

The mattness on the image forming layer surface is not restricted as far as star-dust trouble occurs, but the mattness of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matting degree of the back layer in the invention is preferably in a range of 1200 seconds or less and 10 seconds or more; more preferably, 800 seconds or less and 20 seconds or more; most preferably, 500 seconds or less and 40 seconds or more when expressed by Beck smoothness.

In the present invention, a matting agent is preferably contained in an outermost layer, in a layer which can be function as an outermost layer, or in a layer nearer to outer surface, and also preferably is contained in a layer which can function as so-called protective layer.

5) Polymer Latex

A polymer latex can be incorporated in the surface protective layer or the back layer of the present invention.

As such polymer latex, descriptions can be found in "Gousei Jushi Emulsion (Synthetic resin emulsion)" (Taira Okuda and Hiroshi Inagaki, Eds., published by Koubunshi Kankoukai (1978)), "Gousei Latex no Ouyou (Application of synthetic latex)" (Takaaki Sugimura, Yasuo Kataoka, Souichi Suzuki, and Keiji Kasahara, Eds., published by Koubunshi Kankoukai (1993)), and "Gousei Latex no Kagaku (Chemistry of synthetic latex)" (Souichi Muroi, published by Koubunshi Kankoukai (1970)). More specifically, there can be mentioned a latex of methyl methacrylate (33.5% by weight)/ethyl acrylate(50% by weight)/methacrylic acid (16.5% by weight) copolymer, a latex of methyl methacrylate(47.5% by weight)/butadiene(47.5% by weight)/itaconic acid(5% by weight) copolymer, a latex of ethyl acrylate/methacrylic acid copolymer, a latex of methyl methacrylate(58.9% by weight)/2-ethylhexyl methacrylate (25.4% by weight)/styrene (8.6% by weight)/2-hydroethyl methacrylate(5.1% by weight)/acrylic acid(2.0% by weight) copolymer, a latex of methyl methacrylate(64.0% by weight)/styrene(9.0% by weight)/butyl acrylate(20.0% by weight)/2-hydroxyethyl methacrylate(5.0% by weight)/acrylic acid(2.0% by weight) copolymer, and the like.

The polymer latex is preferably contained in an amount of 10% by weight to 90% by weight, particularly preferably, of 20% by weight to 80% by weight of the total weight of binder (including water-soluble polymer and polymer latex) in the surface protective layer or the back layer.

6) Surface pH

The surface pH of the photothermographic material according to the invention preferably yields a pH of 7.0 or lower, more preferably, 6.6 or lower, before thermal developing process. Although there is no particular restriction concerning the lower limit, the lower limit of pH value is about 3, and the most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Kouji Takahashi) "Liquid Mixing Technology" (Nikkan Kougyou Shinbunsha, 1989), and the like.

8) Surfactant

As the surfactant applicable in the invention, there can be mentioned those disclosed in paragraph No. 0132 of JP-A No. 11-65021.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably.

9) Antistatic Agent

The photothermographic material of the invention may contain an electrically conductive layer including various kinds of metal oxides or electrically conductive polymers known to the public. The antistatic layer may serve as an undercoat layer described above, or a back surface protective layer, and the like, but can also be placed specially. As to the antistatic layer, technologies described in paragraph No. 0135 of JP-A No. 11-65021, JP-A Nos. 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898 can be applied.

10) Support

As the transparent support, favorably used is polyester, particularly, polyethylene terephthalate, which is subjected to heat treatment in the temperature range from 130° C. to 185° C. in order to relax the internal strain caused by biaxial stretching and remaining inside the film, and to remove strain ascribed to heat shrinkage generated during thermal development.

As the support of the photothermographic material used in combination with the ultraviolet light emission screen, PEN is preferably used, but the present invention is not limited thereto. As the PEN, polyethylene-2,6-naphthalate is preferred.

The "polyethylene-2,6-naphthalate" herein means that the structure repeating units essentially may consist of ethylene-2,6-naphthalene dicarboxylate groups and also may include un-copolymerized polyethylene-2,6-naphthalene dicarboxylate, and the copolymer comprising 10% or less, and preferably 5% or less, of the structure repeating units denatured with the other components and mixtures or constituents of other polymer.

Polyethylene-2,6-naphthalate can be synthesized by reacting a naphthalene-2,6-dicarboxylic acid or functional derivatives thereof, and an ethylene glycol or functional derivatives thereof in the presence of a suitable catalyst at proper reaction condition. The polyethylene-2,6-naphthalate of the present invention may be copolymerized or blended polysters, where one or more kinds of suitable third component (denaturing agent) is added before the completion of polymerization of the polyethylene-2,6-aphthalate. As the suitable third component, compounds containing a divalent ester forming functional group, for example, dicarboxylic acids such as oxalic acid, adipic acid, phthalic acid, isophthalic acid, terephthalic acid, naphthalene-2,7-dicarboxylic acid, succinic acid, diphenylether dicarboxylic acid and the like, or lower alkylesters thereof, oxycarboxylic acids such as p-oxybenzoic acid, p-oxyethoxybenzoic acid, or lower alkylesters thereof, and divalent alcohols such as propylene glycol, trimethylene glycol and the like are described.

Polyethylene-2,6-naphthalate and the denatured polymers thereof may include, for example, the polymer where the terminal hydroxy group and/or the carboxylic group is blocked by mono-functional compounds such as benzoic acid, benzoyl benzoic acid, benzyloxy benzoic acid, methoxy polyalkylene glycol and the like, or the polymer denatured with a very small amount of compounds having tri-functional or tetra-functional ester forming group such as glycerine and penta-erthritol in the extent to form linear chain copolymers substantially.

In the case of a photothermographic material for medical use, the transparent support may be colored with a blue dye (for instance, dye-1 described in Examples of JP-A No. 8-240877), or may be uncolored.

Exemplified embodiments of the support are described in paragraph No. 0134 of JP-A No. 11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684.

11) Other Additives

Furthermore, antioxidant, stabilizing agent, plasticizer, UV absorbent, or a film forming promoting agent may be added to the photothermographic material. A solvent described in paragraph No. 0133 of JP-A No. 11-65021 may be added. Each of the additives is added to either of the image forming layer (photosensitive layer) or the non-photosensitive layer. Reference can be made to WO No. 98/36322, EP No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the layer containing non-photosensitive organic silver salt in the invention is preferably a so-called thixotropic fluid. For the details of this technology, reference can be made to JP-A No. 11-52509.

Viscosity of the coating solution for the layer containing non-photosensitive organic silver salt in the invention at a shear velocity of 0.1 $S^{-1}$ is preferably from 400 mPa·s to 100,000 mPa·s, and more preferably, from 500 mPa·s to 20,000 mPa·s.

At a shear velocity of 1000 $S^{-1}$, the viscosity is preferably from 1 mPa·s to 200 mPa·s, and more preferably, from 5 mPa·s to 80 mPa·s.

13) Wrapping Material

In order to suppress fluctuation from occurring on the photographic property during a preservation of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}\ m^{-1-2}\ day^{-1}$ or lower at 25° C., more preferably, 10 $mL \cdot atm^{-1}\ m^{-2}\ day^{-1}$ or lower, and further preferably, 1.0 $mL \cdot atm^{-1}\ m^{-2}\ day^{-1}$ or lower. Preferably, vapor transmittance is 10 $g \cdot atm^{-1}\ m^{-2}\ day^{-1}$ or lower, more preferably, 5 g $atm^{-1}\ m^{-2}\ day^{-1}$ or lower, and further preferably, 1 $g \cdot atm^{-1}\ m^{-2}\ day^{-1}$ or lower. As specific examples of a wrapping material having low oxygen transmittance and/or vapor transmittance, reference can be made to, for instance, the wrapping material described in JP-A Nos.8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-20699, 2001-275471, 2001-275461, 2000-313204, 2001-292844, 2000-324888, 2001-293864 and 2001-348546.

3. Image Forming Method 3-1. Exposure

The black and white photothermographic material of the invention is preferably subjected to imagewise exposure by X-ray exposure using a fluorescent intensifying screen as described above. As another embodiment, the photothermographic material of the invention may be subjected to imagewise exposure by scanning exposure using a laser beam as an exposure light source. As laser beam source, preferably used are gas laser ($Ar^+$, He—Ne, He—Cd), YAG laser, pigment laser and laser diode. Laser diode and second harmonics generator element can also be used. Preferred laser is determined corresponding to the peak absorption wavelength of spectral sensitizer and the like, but preferred is He—Ne laser of red through infrared emission, red laser diode, or $Ar^+$, He—Ne, He—Cd laser of blue through green emission, blue laser diode. Meanwhile, modules having SHG (Second H ermonic Generator) chip and laser diode which are integrated, or blue laser diode have been espcially developed recently, and thus laser output devices for short wavelength region have attracted the attention. Blue laser diode has been expected as a light source with increasing demand hereafter because image recording with high definition is possible, and increased recording density, as well as stable output with longer operating life are enabled. The peak wavelength of laser beam is 350 nm to 500 nm, preferably 400 nm to 500 nm, of blue, or 600 nm to 900 nm, preferably 620 nm to 850 nm, of red to infrared.

Laser beam which oscillates in a longitudinal multiple modulation by a method such as high frequency superposition is also preferably employed.

3-2. Thermal Development

Although any method may be used for the development of the photothermographic material of the invention, the thermal development process is usually performed by elevating the temperature of the photothermographic material exposed imagewise. The temperature for the development is preferably in the range from 80° C. to 250° C., and more preferably, from 100° C. to 140° C.

Time period for development is preferably in the range from 1 second to 60 seconds, more preferably from 5 seconds to 30 seconds, and particularly preferably from 5 seconds to 20 seconds.

In the process for thermal development, plate type heater processes are preferred. Preferable process for thermal development by a plate type heater may be a process described in JP-A NO. 11-133572, which discloses a thermal developing device in which a visible image is obtained by bringing a photothermographic material with a formed latent image into contact with a heating means at a thermal developing portion, wherein the heating means comprises a plate heater, and plurality of pressing rollers are oppositely provided along one surface of the plate heater, the thermal developing device is characterized in that thermal development is performed by passing the photothermographic material between the pressing rollers and the plate heater. It is preferred that the plate heater is divided into 2 to 6 parts, with the leading end having the lower temperature by 1° C. to 10° C.

Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

3-3. System

Examples of a medical laser imager equipped with a light exposing portion and a thermal developing portion include Fuji Medical Dry Laser Imager FM-DP L and DRYPIX 7000. Concerning FM-DP L, description is found in Fuji Medical Review, No. 8, pages 39 to 55, and these techniques can be applied.

In addition, the present photothermographic material can be also applied as a photothermographic material for the laser imager used in "AD network" which was proposed by Fuji Film Medical Co., Ltd. as a network system accommodated to DICOM standard.

4. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

1. Preparation of PET Support and Undercoating 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 KV·A·minute·m$^{-2}$ was executed, judging from the readings of current and voltage on that occasion. The frequency upon this treatment was 9.6 kHz, and the gap clearance between the electrode and dielectric roll was 1.6 mm.

1-3. Undercoating

1)Preparations of Coating Solution for Undercoat Layer

| Formula (1) (for first layer) | |
|---|---|
| Styrene-butadiene copolymer latex (solid content of 40% by weight, styrene/butadiene weight ratio = 68/32) | 158 g |
| 2,4-Dichloro-6-hydroxy-S-triazine sodium salt (8% by weight aqueous solution) | 20 g |
| Sodium laurylbenzenesulfonate (1% by weight aqueous solution) | 10 mL |
| distilled water | 854 mL |

-continued

| Formula (2) (for second layer) | |
|---|---|
| Gelatin | 89.2 g |
| METOLOSE TC-5 manufactured by Shin-Etsu Chemical Co., Ltd. (2% by weight aqueous solution) | 8.6 g |
| MP-1000 manufactured by Soken Chemical Co., Ltd. | 0.01 g |
| Sodium dodecylbenzenesulfonate (1% by weight aqueous solution) | 10 mL |
| NaOH (1% by weight) | 6 mL |
| Proxel (manufactured by Imperial Chemical Industries PLC) | 1 mL |
| distilled water | 805 mL |

2) Undercoating

Both surfaces of the biaxially tentered polyethylene terephthalate support having the thickness of 175 μm were subjected to the corona discharge treatment as described above. Thereafter, the aforementioned formula (1) of the coating solution for the undercoat was coated with a wire bar so that the amount of wet coating became 5.7 mL/m$^2$, and dried at 180° C. for 5 minutes. Then, the aforementioned formula (2) of the coating solution for the undercoat was coated with a wire bar so that the amount of wet coating became 7.7 mL/m$^2$, and dried at 180° C. for 5 minutes. Thus, an undercoated support was produced.

2. Crossover Cut Layer, Image Forming Layer, Intermediate Layer, and Surface Protective Layer 2-1. Preparations of Coating Materials 1) Preparation of Dispersion Solution of Solid Fine Particles of Base Precursor 2.5 kg of base precursor-1, 300 g of a surfactant (trade name: DEMOL N, manufactured by Kao Corporation) 800 g of diphenyl sulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process for dispersion includs feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor becomes 25% by weight, and filtrated (with a polypropylene filter having a mean fine pore diameter of 3 μm) for eliminating dust to put into practical use.

2) Preparation of Dispersion Solution of Solid Fine Particle of Orthochromatic Thermal Bleaching Dye Orthochromatic thermal bleaching dye-1 (λmax=566 nm) described in JP-A No. 11-231457 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed solution was subjected to dispersion with 0.5 mm zirconia beads using a horizontal sand mill (UVM-2: manufactured by AIMEX Co., Ltd.).

The dispersion was dispersed until the ratio of the optical density at 650 nm and the optical density at 750 nm for the spectral absorption of the dispersion ($D_{650}/D_{750}$) becomes 5.0 or higher upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

3) Preparation of Silver Halide Emulsion

<Preparation of Tabular Silver Bromide Emulsion A (Comparative)>

Grain Formation 1178 mL of an aqueous solution prepared by dissolving 0.8 g of potassium bromide and 3.2 g of acid-treated gelatin having an average molecular weight of 20,000 was stirred while maintaining the temperature at 35° C. An aqueous solution containing 1.6 g of silver nitrate, an aqueous solution containing 1.16 g of potassium bromide, and an aqueous solution containing 1.1 g of acid-treated gelatin having an average molecular weight of 20,000 were added to the mixture over a period of 45 seconds by the method of triple jet addition. The concentration of the silver nitrate solution was 0.3 mol/L. Thereafter, the temperature of the mixture was increased to 76° C. over a period of 20 minutes. Then, 26 g of succinated gelatin having an average molecular weight of 100,000 was added. An aqueous solution containing 209 g of silver nitrate and the aqueous potassium bromide solution were added by double jet method in an accelerated flow rate over a period of 75 minutes while keeping the pAg at 8.0.

The entire amount of potassium hexachloroiridate (III) was added to give a concentration of $2\times10^{-5}$ mol per 1 mol of silver at 30 minutes after starting the addition of the aqueous silver nitrate solution and the aqueous potassium bromide solution. After adding gelatin having an average molecular weight of 100,000 thereto, the mixture was desalted according to the conventional method. Thereafter, the resulting mixture was dispersed by adding gelatin having an average molecular weight of 100,000. The pH and pAg of the emulsion was then adjusted to 5.8 and 8.0 at 40° C., respectively. Thus prepared emulsion contained 1 mol of silver and 40 g of gelatin per 1 kg of emulsion.

Chemical Sensitization

The emulsion prepared above was stirred and subjected to chemical sensitization while keeping the temperature at 56° C. Thiosulfonic acid compound-1 set forth below was added in an amount of $10^{-4}$ mol per 1 mol of silver halide, and then silver iodide grain having a diameter of 0.03 μm was added thereto in an amount of 0.15 mol %, based on the total silver amount. Three minutes later, thiourea dioxide was added in an amount of $1\times10^{-6}$ mol per 1 mol of silver and was subjected to reduction sensitization while keeping the temperature for 22 minutes.

Thereafter, 4-hydroxy-6-methyl-1,3,3a,7-tetrazaindene was added in an amount of $3\times10^{-4}$ mol equivalent per 1 mol of silver halide, and then sensitizing dye-1, -2, and -3 set forth below were added in an amount of $1\times10^{-3}$ mol per 1 mol of silver, $1\times10^{-3}$ mol per 1 mol of silver and $1\times10^{-4}$ mol per 1 mol of silver respectively (that is, $1\times10^{-4}$ mol equivalent per 1 mol of silver halide). Furthermore, calcium chloride was added thereto.

Sequentially, sodium thiosulfate and selenium compound-1 were added in an amount of $6\times10^{-6}$ mol equivalent, $4\times10^{-6}$ mol equivalent per 1 mol of silver halide, respectively. After the addition, chloroauric acid was added in an amount of $2\times10^{-3}$ mol equivalent per 1 mol of silver halide. Further, nucleic acid (RNA-F, trade name, available from Sanyo-Kokusaku Pulp Co., Ltd.) was added thereto in an amount of 67 mg equivalent per 1 mol of silver halide. 40 minutes later, water-soluble mercapto compound-1 was added in an amount of $1\times10^{-4}$ mol equivalent per 1 mol of silver halide, and the mixture was then cooled to 35° C. Thereby, chemical sensitization of the emulsion A was finished.

Shape of Obtained Grains

Observation of thus-prepared tabular silver bromide grains using an electron microscope revealed that the tabular grains had a mean projected area equivalent diameter of 1.019 μm, a mean equivalent spherical diameter of 0.430 μm, a mean grain thickness of 0.051 μm, a mean aspect ratio of 20, and a variation coefficient of a projected area equivalent diameter distribution of 23%. Concerning 200 grains taken from the emulsion, observation of a dislocation line (the initiation site, the density and the distribution) was performed by a high-pressure electron microscope (accelerated voltage: 400 kV). The individual grains were observed from the five directions of an inclined angle of the sample as −10°, −15°, 0°, +5°, and +10°. No dislocation line was seen for grains of 90% or more of the total projected area.

<Preparation of Tabular Silver Iodide Emulsion B (Comparative)>

Grain Formation 1178 mL of an aqueous solution prepared by dissolving 0.8 g of potassium bromide and 3.2 g of acid-treated gelatin having an average molecular weight of 20,000 was stirred while maintaining the temperature at 35° C. An aqueous solution containing 1.6 g of silver nitrate, an aqueous solution containing 1.16 g of potassium bromide and an aqueous solution containing 1.1 g of acid-treated gelatin having an average molecular weight of 20,000 were added to the mixture over a period of 45 seconds by the method of triple jet addition. The concentration of the silver nitrate solution was 0.3 mol/L. Thereafter, the temperature of the mixture was increased to 76° C. over a period of 20 minutes. And then an aqueous solution containing 26 g of succinated gelatin having an average molecular weight of 100,000 was added thereto. An aqueous solution containing 209 g of silver nitrate and the aqueous potassium bromide solution were added by double jet method at an accelerated flow rate over a period of 75 minutes while keeping the pAg at 8.0. When the grain growth reached to an equivalent to 30 mol % to 90 mol % with respect to total silver amount, silver iodide fine grain having a diameter of 0.03 μm was concurrently added to make the iodide content to a concentration of 6 mol %. Furthermore, the entire amount of potassium hexachloroiridate (III) was added thereto to give a concentration of $2\times10^{-5}$ mol % per 1 mol of silver at 30 minutes after starting the addition of the aqueous silver nitrate solution and the aqueous potassium bromide solution. After the addition of gelatin having an average molecular weight of 100,000, the mixture was desalted according to the conventional method. Thereafter, the resulting mixture was dispersed by adding gelatin having an average molecular weight of 100,000. The pH and pAg of the resulting emulsion was then adjusted to 5.8 and 8.0 at 40° C., respectively. Thus prepared emulsion had 1 mol of silver and 40 g of gelatin per 1 kg of emulsion.

Chemical Sensitization

The resulting emulsion was subjected to chemical sensitization in a similar manner as in the preparation of emulsion A while optimizing the photographic property by adjusting the addition amount of the chemical sensitizing agent.

Shape of Obtained Grains

The tabular silver halide grains prepared above were tabular silver iodobromide grains having an average iodide content of 3.75 mol % where the grains having an iodide content of 6 mol % accounted for 30% to 90% of the total silver amount. The shape of thus-prepared grains was observed by an electron microscope. The grains had a mean projected area equivalent diameter of 1.004 μm, a mean equivalent spherical diameter of 0.420 μm, a mean grain thickness of 0.049 μm, a mean aspect ratio of 21 and a variation coefficient of a projected area equivalent diameter distribution of 21%. Concerning 200 grains taken from the emulsion, a dislocation line (the initiation site, the density, and the distribution) was observed by a high-pressure electron microscope (accelerated voltage: 400 kV). The individual grains were observed by five directions of the inclined angle of the sample as −10°, −15°, 0°, +5°, and +10°. No dislocation line was seen for grains of 90% or more of the total projected area.

<Preparation of Tabular Silver Iodobromide Emulsion C (Comparative)>

Grain Formation 1178 mL of an aqueous solution prepared by dissolving 0.8 g of potassium bromide and 3.2 g of acid-treated gelatin having an average molecular weight of 20,000 was stirred while maintaining the temperature at 24° C. An aqueous solution containing 1.6 g of silver nitrate, an aqueous solution containing 1.16 g of potassium bromide, and an aqueous solution containing 1.1 g of acid-treated gelatin having an average molecular weight of 20,000 were added to the mixture over a period of 45 seconds by the method of triple jet addition. The concentration of the silver nitrate solution was 0.1 mol/L. Thereafter, the temperature of the mixture was increased to 76° C. over a period of 20 minutes. And then an aqueous solution containing 26 g of succinated gelatin having an average molecular weight of 100,000 was added thereto. An aqueous solution containing 209 g of silver nitrate and the aqueous potassium bromide solution were added by double jet method at an accelerated flow rate over a period of 75 minutes while keeping the pAg at 8.0. For the stage where the grain growth reached to an equivalent to 75 mol % with respect to total silver amount, silver iodide fine grain having a diameter of 0.03 μm was concurrently added to make the iodide content to a concentration of 1.5 mol %. For the sequential stage where the grain growth reached to an equivalent to 75% mol to 87% mol with respect to total silver amount, silver iodide fine grain having a diameter of 0.03 μm was concurrently added to make the iodide content to a concentration of 6 mol %. For the final grain growth stage, silver iodide fine grain was not added in order to form pure silver bromide grain. The entire amount of potassium hexachloroiridate (III) was added thereto to give a concentration of $2\times10^{-5}$ mol % per 1 mol of silver at 30 minutes after starting the addition of the aqueous silver nitrate solution and the aqueous potassium bromide solution. After addition of gelatin having an average molecular weight of 100,000, the mixture was desalted according to the conventional method. Thereafter, the mixture was dispersed by adding gelatin having an average molecular weight of 100,000. The pH and pAg of the resulting emulsion was then adjusted to 5.8 and 8.0 at 40° C., respectively. Thus prepared emulsion contained 1 mol of silver and 40 g of gelatin per 1 kg of emulsion.

Chemical Sensitization

The resulting emulsion was subjected to chemical sensitization in a similar manner to that in the preparation of emulsion A while optimizing the photographic property by adjusting the addition amount of the chemical sensitizing agent.

Shape of Obtained Grains

The tabular silver halide grains prepared above were tabular silver iodobromide grains having an average iodide content of 1.83 mol %. The shape of the prepared grains was observed by an electron microscope. The grains had a mean projected area equivalent diameter of 1.016 μm, a mean equivalent spherical diameter of 0.440 μm, a mean grain thickness of 0.055 μm, a mean aspect ratio of 18.5 and a variation coefficient of a projected area equivalent diameter distribution of 23%. Concerning 200 grains taken from the emulsion, a dislocation line (the initiation site, the density, and the distribution) was observed using a high-pressure electron microscope (accelerated voltage: 400 kV). The individual grains were observed by five directions of the inclined angle of the sample as −10°, −15°, 0°, +5°, and +10°. No dislocation line was seen for grains of 90% or more of the total projected area.

<Preparation of Epitaxial Tabular Grain Emulsion D>

Preparation of Seed Emulsion D-1

1164 mL of an aqueous solution prepared by dissolving 0.017 g of potassium bromide and 0.4 g of acid-treated gelatin having an average molecular weight of 20,000 was stirred while maintaining the temperature at 25° C. An aqueous solution containing 1.6 g of silver nitrate, the aqueous potassium bromide solution, and an aqueous solution containing 2.1 g of acid-treated gelatin having an average molecular weight of 20,000 were added to the mixture over a period of 30 seconds by the method of triple jet addition. The concentration of the silver nitrate solution was 0.2 mol/L. At this time, the silver potential was kept at 15 mV with respect to saturated calomel electrode. The potential was changed to −60 mV by adding the aqueous potassium bromide solution and the temperature of the mixture was then increased to 75° C. Thereafter, 21 g of succinated gelatin having an average molecular weight of 100,000 was added. An aqueous solution containing 209 g of silver nitrate and the aqueous potassium bromide solution were added by double jet method at an accelerated flow rate for a period of 61 minutes, while keeping the silver potential at −40 mV with respect to saturated calomel electrode. After desalting process, succinated gelatin having an average molecular weight of 100,000 was added thereto and the pH and pAg of the mixture was then adjusted to 5.8 and 8.8 at 40° C., respectively, to prepare the seed emulsion. Thus prepared seed emulsion contained 1 mol of silver and 80 g of gelatin per 1 kg of emulsion. The obtained tabular grains had a mean equivalent circular diameter of 0.41 μm, a variation coefficient of an equivalent circular diameter distribution of 22%, a mean grain thickness of 0.030 μm and a mean aspect ratio of 13.7.

Preparation of Tabular Host Grain Emulsion D-2

1200 mL of an aqueous solution prepared by dissolving 134 g of the seed emulsion D-1 prepared above, 1.9 g of potassium bromide and 22 g of succinated gelatin having an average molecular weight of 100,000 was stirred while maintaining the temperature at 65° C. Separately, prior to the addition, an aqueous solution containing 137.5 g of silver nitrate, the aqueous potassium bromide solution, and an aqueous solution containing acid-treated gelatin having an average molecular weight of 20,000 were mixed well over a period of 25 minutes in a separate chamber installed with a magnetic coupling induced stirring devise described in JP-A No. 10-43570. At this time, the silver potential was kept at −40 mV with respect to saturated calomel electrode. Thereafter, an aqueous solution containing 30.0 g of silver nitrate, the aqueous potassium bromide solution and silver iodide ultrafine grain emulsion prepared in advance were added by the method of triple jet addition at a constant flow rate for a period of 30 minutes. Where the addition amount of the silver iodide ultrafine grain emulsion was adjusted to be a silver iodide content of 15 mol %. The silver iodide ultrafine grain emulsion having a mean equivalent circular diameter of 0.03 μm, and a variation coefficient of an equivalent circular diameter distribution of 17%, and dispersed in the presence of trimellited gelatin was used for the preparation of the emulsion. On the way, potassium hexachloroiridate (III) and sodium benzene thiosulfonate were added, while keeping the silver potential at −20 mV with respect to saturated calomel electrode.

An aqueous solution containing 36.4 g of silver nitrate, the aqueous potassium bromide solution, and silver iodide ultrafine grain emulsion prepared in advance were added at a constant flow rate for a period of 40 minutes. Where the addition amount of the silver iodide ultrafine grain emulsion was adjusted to be a silver iodide content of 15 mol %, at this time, the silver potential was kept at +80 mV with respect to saturated calomel electrode. After conventional washing, high molecular weight gelatin having an average molecular weight of 150,000 was added further thereto and the pH and pBr of the mixture was then adjusted to 5.8 and 4.0 at 40° C., respectively, to prepare Emulsion D-2. Observation of thus-prepared emulsion D-2 by an electron microscope revealed that the grains had a mean projected area equivalent diameter of 1.010 μm, a mean equivalent spherical diameter of 0.430 μm, a mean grain thickness of 0.052 μm, a mean aspect ratio of 19.4 and a variation coefficient of a projected area equivalent diameter distribution of 22%.

More than 90% of total projected area was occupied by hexagonal tabular grains where the ratio of longest edge length to shortest edge length was 1.4 or less. The ratio of (111) face of the side faces was 68%. Concerning 200 grains taken from of the emulsion, observation of a dislocation line (the initiation site, the density, and the distribution) was performed using a high-pressure electron microscope (accelerated voltage 400 kV). The individual grains were observed from five directions of the inclined angle of the sample as −10°, −15°, 0°, +5°, and +10°. No dislocation line was seen for the grains of 90% or more of the total projected area.

Preparation of Epitaxial Emulsion D

The above described silver iodide ultrafine grain emulsion was added to the tabular host grain Emulsion D-2 melted at 40° C. in an amount of $3\times10^{-3}$ mol per 1 mol of silver. Sensitizing dye I, II, and III were added in a molar ratio of 6:3:1 to make the saturated coverage ratio of 70%. The sensitizing dyes were used as a fine solid dispersion prepared using the method described in JP-A No. 11-52507, where the solid dispersion was prepared by the following steps of dissolving 0.8 part by weight of sodium nitrate and 3.2 part by weight of sodium sulfate in 43 part by weight of ion-exchange water, adding 13 part by weight of the sensitizing dye thereto, and dispersing the mixture using a dissolver blade at a speed of 2,000 rpm at 60° C. over 20 minutes. And then potassium hexacyanoruthenate (II) was added in an amount of $1\times10^{-6}$ mol (hereinafter, to per 1 mol of silver of the tabular host grains), and an aqueous potassium bromide solution was added in an amount of $1.5\times10^{-2}$ mol.

Thereafter, $3.0\times10^{-2}$ mol of 0.1 mol/L aqueous silver nitrate solution and $2.7\times10^{-2}$ mol of an aqueous sodium chloride solution were added at a constant flow rate by double jet method over a period of 2 minutes. The silver potential after the addition was +85 mV with respect to saturated calomel electrode. After sodium benzenethiosulfonate was added in an amount of $5\times10^{-5}$ mol, the silver potential was adjusted to +20 mV with respect to saturated calomel electrode by adding the aqueous potassium bromide solution. The temperature of the resulting emulsion was increased to 50° C. and subjected to chemical sensitization by addition of potassium thiocyanate, chloroauric acid, sodium thiosulfate and N,N-dimethyl selenourea to attain their optimum level. The chemical sensitization was terminated by adding water-soluble mercapto compound-1 in an amount of $5\times10^{-4}$ mol.

The obtained emulsion was observed by replica method through an electron microscope. The emulsion where all six corners of the hexagonal tabular grains had epitaxial junctions accounted for 95% or more. The obtained emulsion had an average silver iodide content of 4.5 mol %, and an average silver chloride content of 1.2 mol %.

<Preparation of Tabular Silver Iodobromide Emulsion E having Dislocation Line>

Preparation of Seed Emulsion E-1

1164 mL of an aqueous solution prepared by dissolving 0.019 g of potassium bromide and 0.4 g of acid-treated gelatin having an average molecular weight of 20,000 was stirred while maintaining the temperature at 23° C. An aqueous solution containing 1.6 g of silver nitrate, the aqueous potassium bromide solution, and an aqueous solution containing 2.1 g of acid-treated gelatin having an average molecular weight of 20,000 were added to the mixture over a period of 30 seconds by the method of triple jet addition. The concentration of the silver nitrate solution was 0.2 mol/L. At this time, the silver potential was kept at 15 mV with respect to saturated calomel electrode. Thereafter, the potential was changed to −60 mV by adding the aqueous potassium bromide solution, and the temperature of the mixture was increased to 75° C. 21 g of succinated gelatin having an average molecular weight of 100,000 was added thereto. An aqueous solution containing 206.3 g of silver nitrate and the aqueous potassium bromide solution were added by double jet method at an accelerated flow rate for a period of 61 minutes.

At this time, the silver potential was kept at −40 mV with respect to saturated calomel electrode. After desalting process, succinated gelatin having an average molecular weight of 100,000 was further added thereto and the pH and pAg of the mixture was adjusted to 5.8 and 8.8 at 40° C., respectively, to prepare a seed emulsion. Thus-prepared seed emulsion contained 1 mol of silver, and 80 g of gelatin per 1 kg of emulsion. The obtained tabular grain had a mean equivalent circular diameter of 0.466 μm, a variation coefficient of an equivalent circular diameter distribution of 22%, a mean grain thickness of 0.028 μm, and a mean aspect ratio of 16.7.

Preparation of Tabular Silver Iodobromide Emulsion E having Dislocation Line 1200 mL of an aqueous solution prepared by dissolving 134 g of the seed emulsion E-1 prepared above, 1.9 g of potassium bromide and 38 g of gelatin was stirred while maintaining the temperature at 78° C. After addition of 2 mg of thiourea dioxide, an aqueous solution containing 130.3 g of silver nitrate and an aqueous solution containing 4 mol % of potassium iodide with respect to potassium bromide were added to the mixture by double jet method at an accelerated flow rate over a period of 60 minutes. At this time, the silver potential was kept at −50 mV with respect to saturated calomel electrode. After the silver potential was adjusted to 0 mV with respect to saturated calomel electrode, sodium ethyl thiosulfonate was added in an amount of 44 mg and then the temperature was cooled at 45° C. An aqueous solution containing 7.1 g of silver nitrate and an aqueous solution containing 5.3 g of potassium iodide were added by double jet method over a period of 5 minutes. Thereafter, an aqueous solution containing 7.1 g of silver nitrate and an aqueous solution containing 5.3 g of potassium bromide were added by double jet method over a period of 30 minutes. After desalting process, 90 g of gelatin was added thereto and the pH and pAg of the mixture was adjusted to 5.8 and 8.8 at 40° C., respectively.

Chemical Sensitization

The resulting emulsion was subjected to chemical sensitization in a similar manner to that in the preparation of emulsion D while optimizing the photographic property by adjusting the addition amount of the chemical sensitizing agent.

Shape of Obtained Grains

The shape of the obtained tabular silver halide grain was observed by an electron microscope. The grains had a mean projected area equivalent diameter of 1.051 μm, a mean equivalent spherical diameter of 0.450 μm, a mean grain thickness of 0.055 μm, a mean aspect ratio of 19.1, and a variation coefficient of a projected area equivalent diameter distribution of 22%. Concerning 200 grains taken from the emulsion, a dislocation line (the initiation site, the density, and the distribution) was observed by a high-pressure electron microscope (accelerated voltage: 400 kV). The individual grains was observed from five directions of the inclined angle of the sample as −10°, 15°, 0°, +5°and +10°. The ratio (% in number) of tabular grains having substantially dislocation lines on the fringe portion accounted for 80% of the total grains.

<Preparation of Tabular Silver Iodobromide Emulsion F having Dislocation Line>

Process 1

1193 mL of an aqueous solution containing 1 g of acid-treated gelatin and 0.9 g of potassium bromide was stirred while keeping the temperature at 27° C., and 37.5 mL of 0.23 mol/L aqueous silver nitrate solution and 37.5 mL of 0.23 mol/L aqueous potassium bromide solution were concurrently added thereto by double jet method over a period of 2 seconds. After adjusting the pAg at 9.88, the temperature was increased to 75° C. over a period of 40 minutes and then the mixture was subjected to ripening for 35 minutes. Thereafter, 35 g of gelatin (trimellited gelatin) and 8 mL of 5.1 mol/L aqueous sodium chloride solution were added, and then 116 mL of 1.5 mol/L aqueous silver nitrate solution and 1.8 mol/L aqueous potassium bromide solution were concurrently added at an accelerated flow rate (the final flow rate at the end was three times that at the beginning) for 11.5 minutes while keeping the pAg at 8.44.

Sequentially, silver bromide ultrafine grain (silver amount equivalent to 116 mL of 1.5 mol/L aqueous silver nitrate solution) prepared in a separate vessel, and 1 mol/L aqueous potassium bromide solution were added at an accelerated flow rate while keeping the pAg at 8.44. Furthermore, 96 mL of 1.5 mol/L aqueous silver nitrate solution and 80 mL of 1.8 mol/L aqueous potassium bromide solution were concurrently added thereto over a period of 3 minutes.

Process 2

Thereafter, the temperature of the mixture was cooled at 40° C., an aqueous solution containing 19 g of iodide ion-releasing compound-1 was added thereto, and then 77 mL of 0.8 mol/L aqueous sodium bisulfate solution was added over a period of 1 minute at a constant flow rate. The pH of the mixture was raised to 9 and held to form the iodide ion. Two minutes later, the temperature was increased to 55° C. over 5 minutes and then the pH was lowered to 5.5. Thereafter, sodium benzene thiosulfonate and $K_2IrCl_6$ were added in an amount of $3.8\times10^{-6}$ mol/mol of silver, and $4\times10^{-8}$ mol/mol of silver, respectively, based on the total silver amount of each grain. And then, 269 mL of 1.5 mol/L aqueous silver nitrate solution and 1.8 mol/L aqueous potassium bromide solution containing $K_4[Fe(CN)_6]$ in an amount of $2\times10^{-5}$ mol/mol of silver, base on the total silver amount of grain were concurrently added thereto at a constant flow rate while keeping the pAg at 8.59 over a period of 20 minutes.

Chemical Sensitization

The resulting emulsion was subjected to chemical sensitization in a similar manner to that in the preparation of emulsion D while optimizing the photographic property by adjusting the addition amount of the chemical sensitizing agent.

Shape of Obtained Grains

The grains in the emulsion prepared above had a mean equivalent circular diameter of 1.026 μm and more than 98% of the total projected area of total grains was occupied by tabular grains. Hexagonal tabular grains having a neighboring edge ratio (the longest edge length/the shortest edge length) from 1.5 to 1.0 accounted for 80% or more of the total grain projected area. The obtained grains had a mean grain thickness of 0.054 μm, a mean aspect ratio of 19.0, and a variation coefficient of an equivalent circular diameter distribution of 17%. The shape of the grains was determined by replica micrograph through a transmission electron microscope.

Concerning 200 grains taken from the emulsion, a dislocation line (the initiation site, the density, and the distribution) was observed by a high-pressure electron microscope (accelerated voltage 400 kV). The individual grains were observed from five directions of the inclined angle of the sample as −10°, −15°, 0°, +5°, and +10°. The ratio (% in number) of tabular grains having substantially dislocation lines on the fringe portion accounted for 85% of the total grains. A variation coefficient of silver iodide content distribution of grains was 26%.

<Preparation of Tabular Silver Iodobromide Emulsion G having Dislocation Line>

Preparation of Seed Emulsion G-1

The tabular silver bromide emulsion having a mean equivalent spherical diameter of 0.23 μm and an aspect ratio of 12.5, and containing 1 mol of silver and 63 g of gelatin per 1 kg of emulsion were prepared for the seed emulsion.

Preparation of Silver Iodide Fine Grain Emulsion

The silver iodide fine grain emulsion having a mean equivalent spherical diameter of 0.037 μm, and containing 0.55 mol of silver and 41 g of gelatin per 1 kg of emulsion was prepared.

Grain Growth Process 1

1250 mL of an aqueous solution prepared by dissolving 1.7 g of potassium bromide and 46 g of trimellited gelatin whose trimellited ratio was 97%, was stirred while keeping the temperature at 75° C. 240 g of seed emulsion G-1 prepared above was added and then 0.3 g of modified silicone oil (17602, available from Nippon Unicar Co., Ltd.) was added thereto. Aqueous solution containing 7 g of silver nitrate and the aqueous potassium bromide solution were added at an accelerated flow rate by double jet method over a period of 6 minutes while keeping the pH and pAg at 5.5 and 8.5, respectively.

Grain Growth Process 2

An aqueous solution containing 151.2 g of silver nitrate and the aqueous potassium bromide solution were added over a period of 70 minutes by double jet method at an accelerated flow rate where the final flow rate of the silver nitrate was 1.6 times the initial flow rate. At this time, the silver iodide ultrafine grain emulsion with 0.037 μm prepared above was concurrently added at an accelerated flow rate so as to be in an amount of 8.5 mol %, based on the added silver. Therein, the addition amount of potassium bromide was adjusted to keep the pAg at 8.8.

Addition Process 3 for Less Soluble Silver Halide Emulsion

After the pAg of the host grain prepared above was adjusted at 9.3 in the aqueous potassium bromide solution, 38 g of the above silver iodide ultrafine grain emulsion of 0.037 μm was rapidly poured thereto within 20 seconds.

Formation Process 4 for Outermost Grain Layer

Furthermore, an aqueous solution containing 66.4 g of silver nitrate was added thereto over a period of 18 minutes. At this time, potassium bromide solution was added to keep the pAg at 8.7.

Chemical Sensitization

The resulting emulsion was subjected to chemical sensitization in a similar manner to that in the preparation of emulsion D while optimizing the photographic property by adjusting the addition amount of the chemical sensitizing agent.

Shape of Obtained Grains

The obtained grains were tabular silver iodobromide grains having an average iodide content of 8.4 mol %. The shape of the grains was observed by an electron microscope. The obtained grains had a mean projected area equivalent diameter of 0.939 μm, a mean equivalent spherical diameter of 0.420 μm, a mean thickness of 0.056 μm, a mean aspect ratio of 16.8, and a variation coefficient of a projected area equivalent diameter distribution of 21%. Concerning 200 grains taken from the emulsion, a dislocation line (the initiation site, the density, and the distribution) was observed using a high-pressure electron microscope (accelerated voltage: 400 kV). The individual grains was observed from five directions of the inclined angle of the sample as −10°, −15°, 0°, +5°, and +10°. The ratio (% in number) of tabular grains having substantially dislocation lines on the fringe portion accounted for 75% of the total grains. The observation by an electron microscope at low temperature revealed that 75% or more of the total projected area was occupied by grains having dislocation lines on the fringe portion.

The evaluation results of the shape of the silver halide emulsion grains are shown in the following Table 1.

TABLE 1

| Emulsion No. | Mean Equivalent Spherical Diameter (μm) | Mean Projected Area Equivalent Diameter (μm) | Mean Thickness (μm) | Mean Aspect Ratio | Halogen Composition (mol %) Br | I | Cl | Dislocation Line | Epitaxial Junction | Note |
|---|---|---|---|---|---|---|---|---|---|---|
| A | 0.43 | 1.019 | 0.051 | 20.0 | 100 | 0 | 0 | — | — | Comparative Emulsion |
| B | 0.42 | 1.004 | 0.049 | 21.0 | 96.25 | 3.75 | 0 | — | — | Comparative Emulsion |
| C | 0.44 | 1.016 | 0.055 | 18.5 | 98.17 | 1.83 | 0 | — | — | Comparative Emulsion |
| D | 0.43 | 1.010 | 0.052 | 19.4 | 94.3 | 4.5 | 1.2 | — | exists | Emulsion of the Invention |
| E | 0.45 | 1.051 | 0.055 | 19.1 | 95.3 | 4.7 | 0 | exists | — | Emulsion of the Invention |
| F | 0.44 | 1.026 | 0.054 | 19.0 | 92.8 | 7.2 | 0 | exists | — | Emulsion of the Invention |
| G | 0.42 | 0.939 | 0.056 | 16.8 | 93.0 | 7 | 0 | exists | — | Emulsion of the Invention |

<Preparations of Emulsion A to G for Coating Solution>

Each of the silver halide emulsion A to G described above were dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the mixed emulsion for a coating solution.

4) Preparation of Dispersion of Non-Photosensitive Organic Silver Salt

A solution prepared by dissolving 85 g of lime processed gelatin, 25 g of phthalated gelatin in 2 liters of ion-exchange water in a reaction vessel and stirred well (solution A), a solution containing 185 g of benzotriazole and 1405 mL of ion-exchange water (solution B), and 980 g of 2.5 mol/L sodium hydroxide solution were prepared. The solution of the reaction vessel was adjusted to keep the pAg and pH at 7.25 and 8.0, respectively, if required, by adding solution B and 2.5 mol/L sodium hydroxide solution. And the temperature of the mixture was kept at 36° C.

Solution C containing 228.5 g of silver nitrate and 1222 mL of ion-exchange water was added into the reaction vessel at an accelerated flow rate (flow rate: $16(1+0.002t^2)$ mL/min, wherein t represents time expressed in minute). And then solution B was concurrently added to keep the pAg at 7.25. When the addition of solution C was finished, the process was stopped. And then, solution D containing 80 g of phthalated gelatin and 700 mL of ion-exchange water was added thereto at 40° C., while stirring the resulting reaction solution mixture, the pH of the mixture was adjusted at 2.5 by adding 2 mol/L sulfuric acid to aggregate silver salt emulsion. The aggregates were washed well twice times by 5 liters of ion-exchange water. Thereafter the pH and pAg were adjusted to 6.0 and 7.0, respectively, by adding 2.5 mol/L sodium hydroxide solution and solution B to redisperse the aggregates. The obtained silver salt dispersion contained fine crystals of silver salt of benzotriazole.

<Shape of Particles>

The shape of the obtained fine particles of silver salt of benzotriazole was evaluated by an electron microscope. The particles were flaky shaped crystals having a mean equivalent projected area diameter of 0.05 μm, a long axis length of 0.2 μm, a short axis length of 0.05 μm, a grain thickness of 0.05 μm, and a variation coefficient of an equivalent projected area diameter distribution of 21%.

5) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

6) Preparations of Dispersions of Development Accelerator-1

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the development accelerator to be 20% by weight. Accordingly, development accelerator-1 dispersion was obtained.

Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed in a similar manner to the development accelerator-1, and thus dispersions of 20% by weight and 15% by weight were respectively obtained.

7) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

8) Preparation of Toner Dispersion

The dispersions of compound Nos. T-59 and T-3 used for toner dispersions were prepared as follows.

4 g of triazole compound No. T-59 (5-hydroxymethyl-4-benzyl-1,2-4-triazole-3-thiol), 10% by weight of polyvinyl pyrrolidone solution and 18 mL of ion-exchange water were thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. 15 g of 30% by weight lime processed gelatin was added to the above dispersion and the mixture was heated to 50° C. to obtain fine particle dispersion of mercaptotriazole compound No. T-59.

Dispersion of triazole compound No. T-3 (4-benzyl-1,2,4-triazole-3-thiol) was prepared in a similar manner.

9) Preparation of Nucleator Dispersion 2.5 g of polyvinyl alcohol (manufactured by Kuraray Co., Ltd., PVA-217) and 87.5 g of water were added to 10 g of nucleator Compound No. SH-7, and thoroughly admixed to give a slurry. This slurry was allowed to stand for 3 hours. Zirconia beads having a mean particle diameter of 0.5 mm were provided in an amount of 240 g, and charged in a vessel with the slurry. Dispersion was performed with a dispersing machine (1/4G sand grinder mill: manufactured by AIMEX Co., Ltd.) for 10 hours to obtain a solid fine particle dispersion of nucleator. Particles of the nucleator included in the resulting nucleator dispersion had a mean particle diameter of 0.5 μm, and 80% by weight of the particles had a particle diameter of 0.1 μm to 1.0 μm.

10) Preparations of Various Solutions

<<Preparation of Reducing Agent Solution>>

A 10% by weight aqueous solution of ascorbic acid was prepared.

<<Preparations of Aqueous Solution of Mercapto Compound>>

Mercapto compound-1 (1-(3-sulfophenyl)-5-mercaptotetrazole sodium salt) in an amount of 7 g was dissolved in 993 g of water to give a 0.7% by weight aqueous solution.

Mercapto compound-2 (1-(3-methylureidophenyl)-5-mercaptotetrazole) in an amount of 20 g was dissolved in 980 g of water to give a 2.0% by weight aqueous solution.

<<Preparations of Thermal Solvent Solution>>

A 5% by weight aquous solution of 1,3-dimethylurea and a 10% by weight aquous solution of succinimide were prepared.

3-2. Preparations of Coating Solution

1) Preparation of Coating Solution for Crossover Cut Layer 17 g of polyvinyl alcohol PVA-205 (manufactured by Kuraray Co., Ltd.), 9.6 g of polyacrylamide, 70 g of the dispersion solution of the solid fine particles of the base precursor, 56 g of the dispersion solution of the solid fine particles of the orthochromatic thermal bleaching dye, 0.03 g of benzoisothiazolinone, 2.2 g of sodium polystyrene-sulfonate, and 844 mL of water were admixed to give a coating solution for the crossover cut layer.

The coating solution for crossover cut layer was fed to the coating station by controlling the flow speed so that the coating solution for the crossover layer gave the coating amount of solid content of orthochromatic thermal bleaching dye of 0.04 g/m$^2$.

2) Preparation of Coating Solution for Image Forming Layer

To the dispersion of the non-photosensitive organic silver salt obtained as described above in an amount of 1000 g were serially added the aqueous solution of gelatin, the pigment-1 dispersion, the hydrogen bonding compound-1 dispersion, the development accelerator-1 dispersion, the development accelerator-2 dispersion, the color-tone-adjusting agent-1 dispersion, the reducing agent solution, the toner dispersion, the mercapto compound aqueous solutions, the thermal solvent solution, and the nucleator dispersion. The emulsion for coating solution A to G was added thereto in an amount of 0.26 mol per 1 mol of non-photosensitive organic silver salt, followed by thorough mixing just prior to the coating, which was fed directly to a coating die.

3) Preparation of Coating Solution for Intermediate Layer

To 772 g of a 10% by weight aqueous solution of polyvinyl alcohol PVA-205 (manufactured by Kuraray Co., Ltd.), 5.3 g of pigment-1 dispersion, and 226 g of a 27.5% by weight solution of methyl methacrylate/styrene/butyl acrylate/hydroxyethyl methacrylate/acrylic acid copolymer (weight ratio of the copolymerization of 64/9/20/5/2) latex, were added 2 mL of a 5% by weight aqueous solution of aerosol OT (manufactured by American Cyanamid Co.), 10.5 mL of a 20% by weight aqueous solution of ammonium secondary phthalate and water to give total amount of 880 g. The mixture was adjusted with sodium hydroxide to give the pH of 7.5. Accordingly, the coating solution for the intermediate layer was prepared, and was fed to a coating die to provide 10 mL/m$^2$.

4) Preparation of Coating Solution for First Layer of Surface Protective Layers

In water was dissolved 64 g of inert gelatin, and thereto were added 80 g of a 27.5% by weight solution of methyl methacrylate/styrene/butyl acrylate/hydroxyethyl methacrylate/acrylic acid copolymer (weight ratio of the copolymerization of 64/9/20/5/2) latex, 23 mL of a 10% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT, 0.5 g of phenoxyethyl alcohol, and 0.1 g of benzoisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

5) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 3.2 mL of a 5% by weight solution of a fluorocarbon surfactant (F-1), 32 mL of a 2% by weight aqueous solution of another fluorocarbon surfactant (F-2), 23 mL of a 5% by weight aqueous solution of aerosol OT, 4 g of polymethyl methacrylate fine particles (mean particle diameter of 0.7 μm), 21 g of polymethyl methacrylate fine particles (mean particle diameter of 4.5 μm), 1.6 g of 4-methyl phthalic acid, 4.8 g of phthalic acid, 44 mL of 0.5 mol/L sulfuric acid, and 10 mg of benzoisothiazolinone. Water was added to give total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

3-3. Coating

Simultaneous overlaying coating by a slide bead coating method was subjected in order of the crossover cut layer, image forming layer, intermediate layer, first layer of the surface protective layers and second layer of the surface protective layers, starting from the undercoated face, and thus sample of photothermographic material-1 to −7 were produced. In this method, the temperature of the coating solution was adjusted to 31° C. for the image forming layer and intermediate layer, to 36° C. for the first layer of the surface protective layers, and to 37° C. for the second layer of the surface protective layers. Reverse surface toward the support was coated similarly to obtain a double-sided photothermographic material.

The amount of coated silver was 0.821 g/m$^2$ per one side, with respect to the sum of non-photosensitive organic silver salt and silver halide. And, the amount of coated silver was 1.72 g/m$^2$ with respect to the sum of coated silver contained in image forming layers on both sides.

The coating amount of each compound (g/m$^2$) for the image forming layer per one side is as follows.

| | |
|---|---|
| Non-photosensitive organic silver salt (on the basis of Ag content) | 0.686 |
| Gelatin | 3.5 |
| Pigment (C.I. Pigment Blue 60) | 0.036 |
| Triazole compound No. T-59 | 0.04 |
| Triazole compound No. T-3 | 0.04 |
| Ascorbic acid | 1.1 |
| Nucleator | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Thermal solvent: 1,3-dimethlyurea | 0.24 |
| Thermal solvent: succinimide | 0.08 |
| Silver halide (on the basis of Ag content) | 0.175 |

Chemical structures of the compounds used in Examples of the invention are shown below.

Base precursor-1

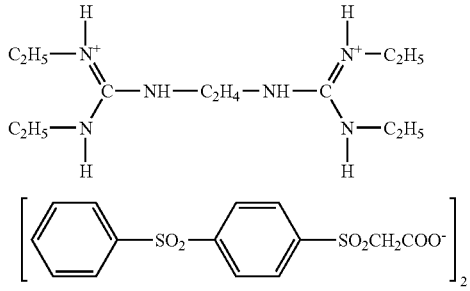

Orthochromatic thermal bleaching dye-1

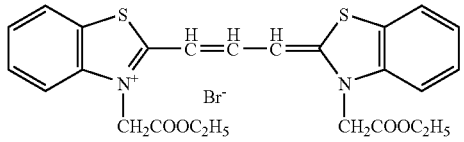

Compound 1 that can be one-electron-oxidized to provide a one-electron oxidation product which releases one or more electrons

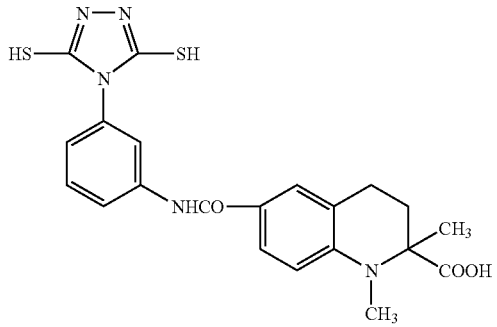

Compound 2 that can be one-electron-oxidized to provide a one-electron oxidation product which releases one or more electrons

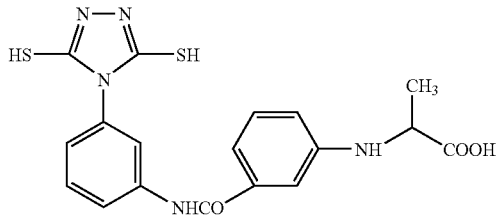

Compound 3 that can be one-electron-oxidized to provide a one-electron oxidation product which releases one or more electrons

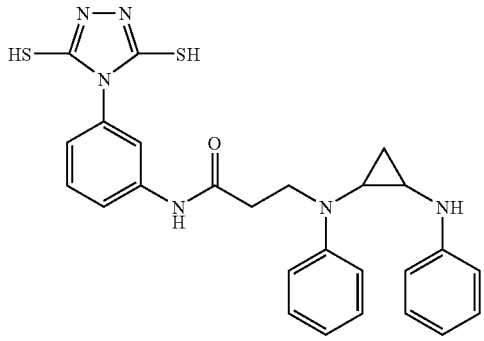

Compound 1 having adsorptive group and reducible group

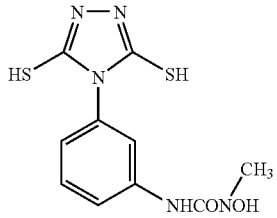

Compound 2 having adsorptive group and reducible group

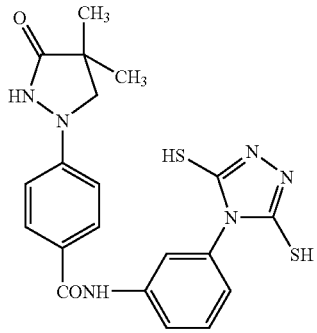

Thiosulfonate compound-1

$C_2H_5SO_2SNa$

Selenium compound-1

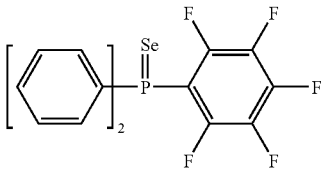

-continued
Water-soluble mercapto compound-1
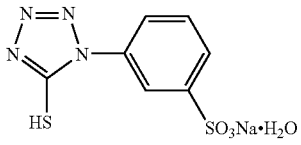
Sensitizing dye-1
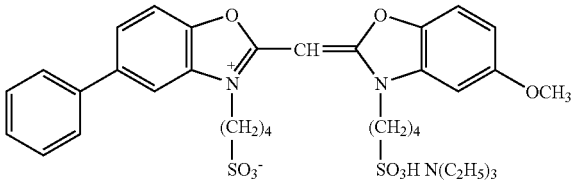
Sensitizing dye-2
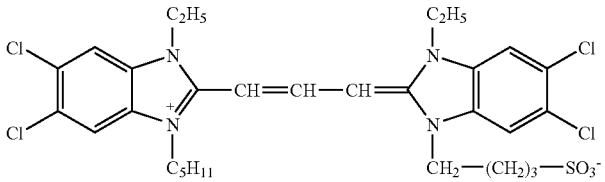
Sensitizing dye-3
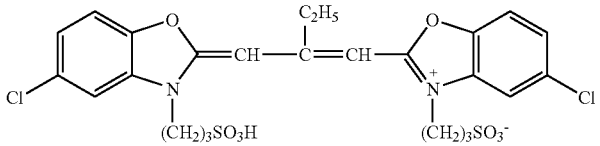
Sensitizing dye I
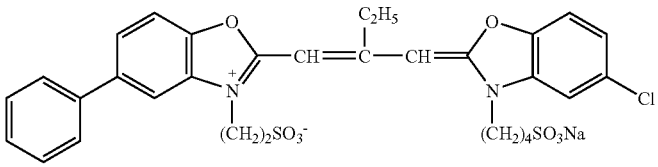
Sensitizing dye II
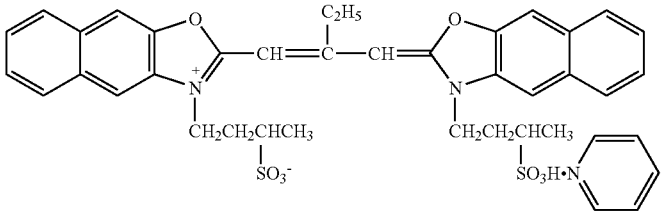
Sensitizing dye III
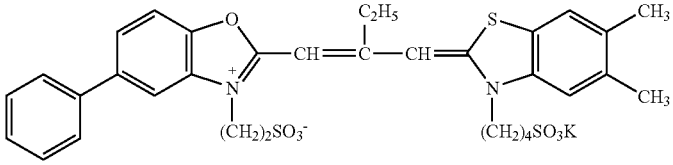
Iodide ion-releasing agent-1
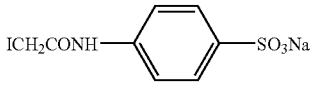

-continued
Hydrogen bonding compound-1
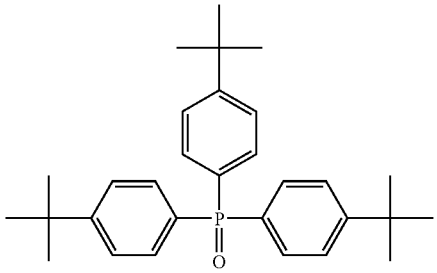
Mercapto compound-1
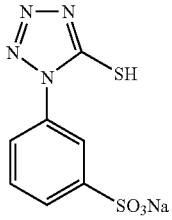
Mercapto compound-2
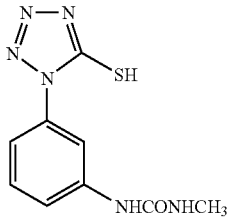
Development accelerator-1
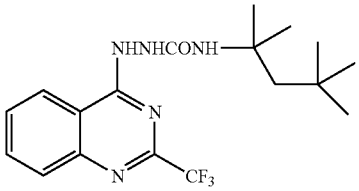
Development accelerator-2
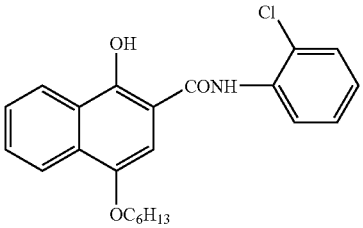
Color-tone-adjusting agent-1
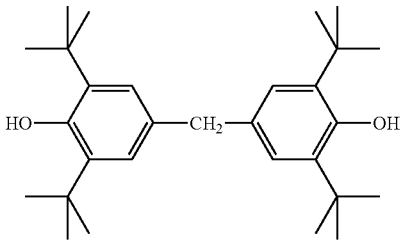

-continued (F-1)

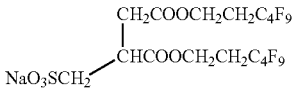

(F-2)

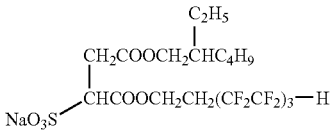

Conditions for coating and drying were as follows.

The support was decharged by ionic wind. Coating was performed at the speed of 160 m/min.

Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Thus prepared photothermographic material had a matt degree of 250 seconds as Beck's smoothness. In addition, measurement of the pH of the film surface gave the result of 6.0.

4. Evaluation of Photographic Properties 4-1. Preparation

The resulting sample was cut into a half-cut size, and was wrapped with the following packaging material under an environment of 25° C. and 50% RH, and stored for 2 weeks at an ambient temperature.

(Packaging Material)

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}\ m^{-2}\ day^{-1}$, vapor permeability at 25° C.: 0.10 $g \cdot atm^{-1}\ m^{-2}\ day^{-1}$.

4-2. Condition of Evaluation

Two sets of X-ray Orthochomatic Screen HG-M (using as fluorescent substance a terbium activated gadolinium oxysulfide fluorescent substance, emission peak wavelength of 545 nm) produced by Fuji Photo Film Co., Ltd. were used as a fluorescent screen, and the assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost equivalent to human body was used as the light source. By the method of distance, varying the exposure value of X-ray, the sample was subjected to exposure with a step wedge tablet having a width of 0.15 in terms of log E. After exposure, the exposed sample was subjected to thermal development with the condition mentioned below, and then the obtained image was evaluated by a densitometer.

The thermal developing portion of Fuji Medical Dry Laser Imager FM-DP L was modified so that it can heat from both sides, and by another modification the transportation rollers in the thermal developing portion were changed to the heating drum so that the sheet of film could be conveyed. The temperature of four panel heaters were set to 112° C.-118° C.-120° C.-120° C., and the temperature of the heating drum was set to 120° C. The total time period for thermal development was set to be 24 seconds.

<Photographic Property>

Fog: expressed by a density of unexposed part.

Sensitivity: expressed by a relative value when the sensitivity of Sample 1 is taken as 100.

Average gradient:expressed by a gradient of a straight line connecting the points at fog+optical density of 0.2 and fog+optical density of 2.5 on the photographic characteristic curve (tan θ, when an angle between the abscissa and the straight line is θ).

<Observation of Development Initiation Point>

Ultrathin slices were prepared by cutting the maximum density part of each image forming layer using a diamond knife to a direction parallel to the support surface. Thereafter, the ultrathin slices were placed on a mesh and observed by a transmission electron microscope. The numbers of developed silvers in contact with the corner portions and the fringe portions of tabular silver halide grains, (x1) and (x2) respectively, and the number of developed silver (y)

in contact with the portions other than these portions are counted. Thereby, the ratio of the numbers of developed silvers in contact with the silver halide grains to the numbers of entire developed silvers (x1+x2+y) was derived.

Initial color tone of a developed silver image: the photothermographic material was imagewise exposed by X-ray using a chest phantom where the time period for exposure was adjusted so as to make the lung field at a desired density suitable for diagnosis (D=1.8). The color tone of a developed silver image of all over the images in the chest phantom was evaluated by visual observation and rated as a ranking of ○, Δ, and X.

○: same color tone as obtained in a conventional wet processed silver halide materials and favor for medical diagnosis inspection.

Δ: slightly different color tone in comparison with a conventional wet processing silver halide materials and allowable level, but need for some training.

X: unfavorable image color tone for the use in medical diagnosis.

Evaluation of image storability (storability of color tone of a developed silver image): the photothermographic material was imagewise exposed by X-ray using a chest phantom where the time period for exposure was adjusted so as to make the lung field at a desired density suitable for diagnosis (D=1.8). The processed image sample was exposed to a fluorescent lamp of 6,000 Lux for 5 days under the environmental condition of 40° C. and 50% RH, and then compared with a new image sample exposed and processed in the same condition. The color tone of a developed silver image of all over the images in the chest phantom was evaluated by visual observation and rated as a ranking of ◎, ○, Δ, and X, in the order to a degree of change in color tone.

◎: a little change in color tone was observed

Δ: apparent change in color tone was observed

X: remarkable change in color tone was observed The results are shown in Table 2.

From the results, the photothermographic materials of the present invention exhibit high sensitivity, excellent gradation suitable for medical diagnosis and favorable color tone of a developed silver image. Moreover, the materials show an excellent result in the image storability and exhibit little change in color tone.

Example 2

1. Back Layer

1) Preparation of Coating Solution for Antihalation Layer

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L sodium hydroxide aqueous solution, 40 g of the dispersion solution of the solid fine particles of the orthochromatic thermal bleaching dye which is the same as Example 1, 90 g of the dispersion solution of the solid fine particles of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the antihalation layer.

2) Preparation of Coating Solution for Back Surface Protective Layer

A vessel was kept at 40° C., and thereto were added 40 g of gelatin, 35 mg of benzoisothiazolinone and 840 mL of water to allow gelatin to be dissolved. Additionally, 5.8 mL of a 1 mol/L sodium hydroxide aqueous solution, 5 g of a 10% by weight emulsion of liquid paraffin, 5 g of a 10% by weight emulsion of tri(isostearic acid)-trimethylol-propane, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (weight ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

TABLE 2

| Sample No. | Emulsion No. | Development Initiation Point: Corner Portion(%) | Development Initiation Point: Fringe Portion(%) | Fog | Sensitivity | Gradation | Color Tone of: Developed Silver Image | Color Tone of: Image Storability | Note |
|---|---|---|---|---|---|---|---|---|---|
| 1 | A | 10 | 13 | 0.25 | 100 | 2.5 | Δ | X | Comparative |
| 2 | B | 11 | 16 | 0.26 | 95 | 2.4 | Δ | X | Comparative |
| 3 | C | 15 | 25 | 0.27 | 115 | 2.2 | Δ | Δ | Comparative |
| 4 | D | 90 | 5 | 0.20 | 252 | 3.2 | ○ | ◎ | Invention |
| 5 | E | 30 | 52 | 0.21 | 212 | 3.1 | ○ | ○ | Invention |
| 6 | F | 25 | 72 | 0.21 | 265 | 3.3 | ○ | ◎ | Invention |
| 7 | G | 28 | 58 | 0.23 | 235 | 3.0 | ○ | ○ | Invention |

3) Coating of Back Layer

The back surface side of the undercoated support which is the same as Example 1 was subjected to simultaneous double coating so that the coating solution for the antihalation layer gave the coating amount of gelatin of 0.52 g/m$^2$, and so that the coating solution for the back surface protective layer gave the coating amount of gelatin of 1.7 g/m$^2$, followed by drying to produce a back layer.

2. Image Forming Layer, Intermediate Layer, First Layer of Surface Protective Layers, and Second Layer of Surface Protective Layers Preparation of coating solutions of image forming layer, intermediate layer, first layer of surface protective layers, and second layer of surface protective layers were conducted similar to those in Example 1. Reverse surface of the back surface was subjected to simultaneous overlaying coating in order of this. The amount of coated silver in the image forming layer was 0.92 g/m$^2$ with respect to the sum of non-photosensitive organic silver salt and silver halide.

3. Evaluation

Thus obtained orthochromatic sensitized single-sided photothermographic material-11 to −17 were evaluated as follows.

The commercially available mammography apparatus DRX-B1356EC produced by Toshiba Corp. was used as for X-ray source. The X-ray emitted from the molydenum target tube operated by three-phase electric power at 26 kVp, which penetrated Be of 1 mm, Mo of 0.03 mm and an acrylic filter of 2 cm, was used. By the method of distance, the exposure value of X-ray was changed. The photothermographic material was subjected to exposure for one second with a step wedge tablet having a width of 0.15 in terms of log E.

After exposure, the photothermographic material was subjected to thermal development in a similar manner to Example 1.

To evaluate image tone and storability of the image tone, evaluation was performed similar to Example 1 using a phantom for mammmography. The results are shown in Table 3.

Similar to Example 1, the photothermographic materials (Sample Nos. 14 to 17) of the present invention exhibit a high sensitivity, excellent gradation suitable for medical diagnosis and favorable color tone of a developed silver image. Moreover, the materials are excellent in image storability and exhibit little change in color tone.

TABLE 3

| Sample No. | Emulsion No. | Development Initiation Point: Corner Portion(%) | Development Initiation Point: Fringe Portion(%) | Fog | Sensitivity | Gradation | Color Tone of Developed Silver Image | Color Tone of Image Storability | Note |
|---|---|---|---|---|---|---|---|---|---|
| 11 | A | 9 | 14 | 0.28 | 100 | 2.6 | Δ | X | Comparative |
| 12 | B | 12 | 15 | 0.29 | 96 | 2.6 | Δ | X | Comparative |
| 13 | C | 17 | 23 | 0.30 | 114 | 2.4 | Δ | Δ | Comparative |
| 14 | D | 92 | 4 | 0.21 | 255 | 4.1 | ○ | ◎ | Invention |
| 15 | E | 32 | 51 | 0.22 | 210 | 4.0 | ○ | ○ | Invention |
| 16 | F | 22 | 73 | 0.22 | 270 | 4.1 | ○ | ◎ | Invention |
| 17 | G | 27 | 53 | 0.24 | 240 | 4.1 | ○ | ○ | Invention |

As for a fluorescent intensifying screen, the fluorescent intensifying screen UM MAMMO FINE for mammography (using as fluorescent substance, a terbium activated gadolinium oxysulfide fluorescent substance, emission peak wavelength of 545 nm) produced by Fuji Photo Film Co., Ltd. was used. The photothermographic material and the intensifying screen were loaded in ECMA cassette produced by Fuji Photo Film Co., Ltd. so as the image forming layer of the photothermographic material came in contact with the surface protective layer of the screen. The X-ray exposure was performed after arranging so that the top plate of cassette, the photothermographic material and the screen might be set, from X-ray tube, in turn.

Example 3

Preparations of Sample Nos. 21 to 30 were conducted in a similar manner to the process in the preparation of Sample No. 4 in Example 1 except that changing the kind and the addition amount of the nucleator as shown in Table 4.

Evaluation was performed similar to Example 1 and the results are shown in Table 4.

As a result, similar to Example 1, the photothermographic materials (Sample Nos. 21 to 30) of the present invention exhibit a high sensitivity, excellent gradation suitable for medical diagnosis and favorable image tone. Moreover, the materials are excellent in image storability and exhibit little change in color tone.

TABLE 4

| Sample No. | Nucleator: No. | Nucleator: Addition Amount (g/m$^2$) | Development Initiation Point: Corner Portion(%) | Development Initiation Point: Fringe Portion(%) | Fog | Sensitivity | Gradation | Color Tone of Developed Silver Image | Color Tone of Image Storability | Note |
|---|---|---|---|---|---|---|---|---|---|---|
| 21 | SH-1 | 0.019 | 92 | 4 | 0.21 | 245 | 3.1 | ○ | ◎ | Invention |
| 22 | SH-2 | 0.028 | 91 | 4 | 0.23 | 230 | 2.9 | ○ | ◎ | Invention |

TABLE 4-continued

| Sample No. | Nucleator No. | Nucleator Addition Amount (g/m²) | Development Initiation Point Corner Portion(%) | Development Initiation Point Fringe Portion(%) | Fog | Sensitivity | Gradation | Color Tone of Developed Silver Image | Image Storability | Note |
|---|---|---|---|---|---|---|---|---|---|---|
| 23 | SH-3 | 0.028 | 91 | 5 | 0.22 | 252 | 3.0 | ○ | ◎ | Invention |
| 24 | SH-4 | 0.022 | 90 | 4 | 0.21 | 242 | 3.2 | ○ | ◎ | Invention |
| 25 | SH-5 | 0.022 | 88 | 3 | 0.21 | 232 | 3.1 | ○ | ◎ | Invention |
| 26 | SH-6 | 0.025 | 90 | 4 | 0.21 | 255 | 3.3 | ○ | ◎ | Invention |
| 27 | SH-8 | 0.025 | 91 | 5 | 0.23 | 235 | 3.1 | ○ | ◎ | Invention |
| 28 | SH-9 | 0.025 | 92 | 4 | 0.23 | 235 | 3.0 | ○ | ◎ | Invention |
| 29 | SH-10 | 0.022 | 89 | 3 | 0.23 | 235 | 3.3 | ○ | ◎ | Invention |
| 30 | SH-12 | 0.022 | 90 | 3 | 0.23 | 235 | 3.0 | ○ | ◎ | Invention |

Example 4

Gelatin used for the hydrophilic binder of the image forming layer in Example 1 was changed to SBR latex which is an aqueous dispersion of latex. The SBR latex was prepared according to the following manner.

<Preparation of SBR Latex Solution>

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C.

Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na_+$ ion: $NH_4^+$ ion =1:5.3, and thus, the pH of the mixture was adjusted to 8.4.

Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.) and pH of 8.4.

Preparation of photothermographic material was conducted in a similar manner to Example 1 except that using the SBR latex described above for a binder of the image forming layer. This material was evaluated similar to Example 1, and as a result, similar to Example 1, the photothermographic material of the present invention exhibits a high sensitivity, excellent gradation suitable for medical diagnosis and shows a favorable color tone of a developed silver image. Moreover, the materials are excellent in image storability and exhibit little change in color tone.

What is claimed is:

1. A black and white photothermographic material comprising, on at least one surface of a support, an image forming layer containing at least a photosensitive silver halide, a non-photosensitive organic silver salt, a reducing agent for silver ions, and a binder, wherein:

1) 70% or more of a total projected area of the photosensitive silver halide is occupied by tabular grains having an aspect ratio of 2.5 or more, a mean projected area equivalent diameter of 0.5 μm to 8 μm, and a mean grain thickness of 0.02 μm to 0.2 μm, and 2) a ratio of a number of sites forming a development initiation point on a corner portion or a fringe portion of the photosensitive silver halide grain to all development initiation points is 50% or more.

2. The black and white photothermographic material according to claim 1, wherein a silver bromide content of the photosensitive silver halide is 70 mol % or higher.

3. The black and white photothermographic material according to claim 1, having at least one dislocation line per one grain on the fringe portion.

4. The black and white photothermographic material according to claim 3, having at least 10 dislocation lines per one grain in the fringe portion.

5. The black and white photothermographic material according to claim 1, having an epitaxial junction at at least one of a corner portion and a fringe portion of the photosensitive silver halide grain.

6. The black and white photothermographic material according to claim 5, wherein the photosensitive silver halide grain has an epitaxial junction at a corner portion thereof.

7. The black and white photothermographic material according to claim 1, wherein the photosensitive silver halide comprises a complex of a transition metal selected from groups 3 to 14 in the periodic table.

8. The black and white photothermographic material according to claim 1, wherein the non-photosensitive organic silver salt comprises at least one selected from a silver salt of an azole compound and a silver salt of a mercapto compound.

9. The black and white photothermographic material according to claim 1, wherein the non-photosensitive organic silver salt is a silver salt of a nitrogen-containing heterocyclic compound.

10. The black and white photothermographic material according to claim 1, wherein the non-photosensitive organic silver salt comprises at least one selected from a silver salt of a triazole compound and a silver salt of a tetrazole compound.

11. The black and white photothermographic material according to claim 10, wherein the non-photosensitive organic silver salt is at least one selected from silver salts of benzotriazole and of derivatives thereof.

12. The black and white photothermographic material according to claim 1, wherein the reducing agent for silver ions is at least one selected from ascorbic acid and derivatives thereof.

13. The black and white photothermographic material according to claim 12, further containing at least one kind of compound selected from mercapto triazole and derivatives thereof as a toner.

14. The black and white photothermographic material according to claim 1, wherein the binder is at least one selected from gelatin and derivatives thereof.

15. The black and white photothermographic material according to claim 1, further containing a nucleator, wherein an average gradient in a photographic characteristic curve of the material is 1.8 to 4.3.

16. The black and white photothermographic material according to claim 1, having the image forming layer on both sides of the support.

17. An image forming method of forming an image by imagewise exposing a photothermographic material followed by thermal developing thereof, the method comprising the steps of:

(a) providing an assembly for forming an image by placing the black and white photothermographic material according to claim 1 between a pair of fluorescent intensifying screens, (b) putting an analyte between the assembly and an X-ray source, (c) applying imagewise exposure to the analyte using X-rays having an energy level in a range of 25 kVp to 125 kvp, (d) taking the black and white photothermographic material out of the assembly, and (e) thermally developing the thus taken out black and white photothermographic material in a temperature range of 90° C. to 180° C.

* * * * *